United States Patent [19]

Morigaki et al.

[11] Patent Number: 5,006,456

[45] Date of Patent: Apr. 9, 1991

[54] METHOD FOR PROCESSING SILVER HALIDE COLOR PHOTOGRAPHIC LIGHT-SENSITIVE MATERIALS USING SULPHINC ACIDS AND SALTS OR THEIR PRECURSORS

[75] Inventors: Masakazu Morigaki; Takatoshi Ishikawa; Kazuto Andoh; Nobuo Seto, all of Minami-Ashigara; Toshio Koshimizu, Tokyo; Shinji Ueda, Minami-Ashigara, all of Japan

[73] Assignee: Fuji Photo Film Co., Ltd., Minami-Ashigara, Japan

[21] Appl. No.: 202,558

[22] Filed: Jun. 6, 1988

[30] Foreign Application Priority Data

Jun. 8, 1987 [JP] Japan ..... 62-142941
Nov. 6, 1987 [JP] Japan ..... 62-280810

[51] Int. Cl.[5] ..... G03C 7/40; G03C 7/32; G03C 7/30

[52] U.S. Cl. ..... 430/372; 430/383; 430/393; 430/428; 430/429; 430/430; 430/434; 430/461; 430/463; 430/464; 430/467; 430/486; 430/490

[58] Field of Search ..... 430/383, 393, 428, 429, 430/430, 461, 463, 464, 467, 434, 490, 486, 372

[56] References Cited

U.S. PATENT DOCUMENTS

| | | | |
|---|---|---|---|
| 3,293,036 | 12/1966 | Meckl et al. | 430/393 |
| 4,038,079 | 7/1977 | Meckl et al. | 430/400 |
| 4,070,188 | 1/1978 | Nakamura et al. | 430/390 |
| 4,201,585 | 5/1980 | Pollet et al. | 430/376 |
| 4,336,324 | 6/1982 | Koboshi et al. | 430/421 |
| 4,410,619 | 10/1983 | Kubbota et al. | 430/234 |
| 4,547,452 | 10/1985 | Toya | 430/372 |
| 4,598,040 | 7/1986 | Netz et al. | 430/434 |
| 4,623,613 | 11/1986 | Ishikawa et al. | 430/372 |
| 4,752,556 | 6/1988 | Kishimoto | 430/398 |

FOREIGN PATENT DOCUMENTS

| | | |
|---|---|---|
| 2052698 | 5/1971 | Fed. Rep. of Germany . |
| 1308938 | 10/1970 | United Kingdom . |
| 2165954 | 4/1986 | United Kingdom . |

OTHER PUBLICATIONS

Research Disclosure, "Photographic Silver Halide Emulsions . . . ", Eastman Kodak Co., 12/78, pg. 25.
JP 61-4047 English translation of Abstract.

*Primary Examiner*—Charles L. Bowers, Jr.
*Assistant Examiner*—Patrick A. Doody
*Attorney, Agent, or Firm*—Burns, Doane, Swecker & Mathis

[57] ABSTRACT

A method for processing a silver halide color photographic light-sensitive material comprises the steps of developing the light-sensitive material with a color developer containing an aromatic primary amine color developing agent, desilvering, washing with water and/or stabilizing the material in which at least one processing solution used in at least one step of the processing contains at least one compound selected from the group consisting of sulfinic acids and salts and precursors thereof. This method makes it possible to effectively prevent the formation of stains due to not only the components of the light-sensitive material per se but also those attributable to the processing solutions, during processing or storage with time, and to enhance the stability of processing solutions.

18 Claims, No Drawings

METHOD FOR PROCESSING SILVER HALIDE COLOR PHOTOGRAPHIC LIGHT-SENSITIVE MATERIALS USING SULPHINC ACIDS AND SALTS OR THEIR PRECURSORS

BACKGROUND OF THE INVENTION (1) Field of the Invention

The present invention relates to a method for processing silver halide color photographic light-sensitive materials and more particularly to a method for processing silver halide color photographic light-sensitive materials which makes it possible to suppress the occurrence of stains generated on non-image portions (hereunder referred to as "white ground") after the processing or over the lapse of time (or during storage) and to enhance the stability of processing solutions.

(2) Prior Art

Heretofore, color developers containing an aromatic primary amine color developing agent have long been employed widely and are presently playing an important role in methods for forming color photographic images. However, such a color developing agent is very likely to undergo oxidation due to the action of air or a metal. Therefore, if a large amount of such a color developing agent remains in a light-sensitive material, it is often observed that undersirable stains are formed thereon after the processing and even in the course of the processing.

Over the years, various studies have been made regarding the suppression of yellow stain mainly due to decomposition of the magenta couplers employed. For instance, it is known that such stains can be suppressed by incorporating in photographic light-sensitive materials a compound such as hydroquinones, hindered phenols, tocopherols, chromans, coumarans and those obtained by etherifying the phenolic hydroxyl groups of these compounds (see, for instance, U.S. Pat. Nos. 3,935,016; 3,930,866; 3,700,455; 3,764,337; 3,432,300; 3,573,050 and 4,254,216; U.K. Patent Nos. 2,066,975 and 1,326,889 and Japanese Patent Publication for Opposition Purpose (hereinafter referred to as "J. P. KOKOKU") No. 51-30426).

This method is effective in inhibiting the formation of yellow stains due to the components of the light-sensitive material per se, but it is less effective in preventing the occurrence of stains due to the contamination of the light-sensitive materials with components of processing solutions.

Recently, it has been proposed, for example, in U.S. Pat. Nos. 4,463,085 and 4,483,918 and Japanese Patent Unexamined Publication (hereinafter referred to as "J.P. KOKAI") Nos. 59-218445 and 59-229557, that the use of certain amine type compounds is effective in preventing the occurrence of stains. However, none of these known compounds shows a satisfactory effect.

On the other hand, it is known to add a specific sulfinic acid to processing solutions (see, for instance, J.P. KOKOKU No. 49-33787; U.K. Patent No. 571,078 and U.S. Pat. No. 3,293,036). However, J.P. KOKOKU No. 49-33787 relates to monochromatic development and the method disclosed in U.K. Patent No. 571,078 is to be applied to silver dyestuff bleaching system. In other word, sulfinic acid is used for a different purpose and these patents do not refer to the stain inhibition of light-sensitive materials at all. Additionally, it was verified that the compounds disclosed in U.S. Pat. No. 3,293,036 showed no effect of inhibiting stains formed with time.

In addition, U.K. Patent No. 1,379,615 discloses the use of sulfinic acids in a bleach-fixing solution to enhance the stability thereof. However, it never refers to the inhibition of stains of color light-sensitive materials.

In recent methods for processing color photographic materials, the light-sensitive materials are generally bleached and fixed subsequent to the color development, and a combined bleaching and fixing bath or a bleaching-fixing bath is widely used, particularly in the processing of print materials so as to symplify the process, to reduce the number of baths and to obtain rapid processing. However, when an iron complex of amino polycarboxylic acid commonly used as a bleaching agent coexists with thiosulfates widely used as a fixing agent, the thiosulfates are oxidized to release elemental sulfur (so-called sulfidation phenomenon) which often leads to the deposition of undersirable substances on color photographic paper and to the occurrence of color stains. A stabilizer such as a sulfite ion source is generally used to solve such a problem, but the effect thereof is insufficient. In addition, OLS No. 2,102,713 discloses the use of aldehyde-bisulfite adducts. However, they cannot suppress the formation of stains with time.

The foregoing phenomenon causes, in addition to the aforesaid problems, another particularly severe problem, i.e., sulfidation of washing water occurs when the amount of a replenisher for water washing and/or stabilization processes after the bleach-fixing process is substantially reduced as disclosed in J.P. KOKAI No. 57-8543 and Japanese Patent Application Serial (hereunder referred to as "J.P.A.") No. 61-131632.

SUMMARY OF THE INVENTION

Accordingly, a primary object of the present invention is to provide a method for processing silver halide color photographic light-sensitive material (hereinafter simply referred to as "light-sensitive material(s)"), which enables prevention of the occurrence of stains in the course of the processing and during storage.

Another object of the present invention is to provide such a method which makes it possible to enhance the stability of processing solutions, particularly bleach-fixing and fixing solutions, as well as that of the water washing and/or stabilization processes.

The present invention has been completed on the basis of the finding that when developing light-sensitive materials with a color developer containing an aromatic primary amine color developing agent, the foregoing problems can effectively be solved by incorporating, into the developer or processing solutions subsequently used, such as bleaching solutions, a sulfinic acid, a salt or a precursor thereof.

Namely, the present invention provides a method for processing a light-sensitive material comprising the steps of developing the material with a color developer containing an aromatic primary amine color developing agent, desilvering, washing with water and/or stabilizing the material, in which at least one processing solution used in at least one step of the processing contains at least one compound selected from the group consisting of sulfinic acids and salts and precursors thereof.

DETAILED EXPLANATION OF THE INVENTION

If the replenishing amount of washing and/or stabilization process carried out after the bath having fixing ability is adjusted to 1 to 50 times the volume of the solution carried over from the preceding bath per unit area of the processed light-sensitive material, the sulfurization in the water washing and/or stabilization processes can extremely be retarded in particular in the case of multistage countercurrent system, the density increasment on the white ground can be prevented and the image-stability of the processed light-sensitive material can substantially enhanced. Therefore, the method of this invention can effectively be employed in such processing. In such case where the amount of replenisher is reduced, the sulfinic acids or salts thereof can be added to washing water or stabilization solution; or replenishers therefor; or further the preceding baths so that these compounds are carried over therefrom to washing water or stabilization solution.

The sulfinic acids herein used are compounds comprised of aliphatic, aromatic or heterocyclic groups to which at least one —$SO_2H$ group is bound.

The term "aliphatic group" means linear, branched or cyclic alkyl, alkenyl or alkynyl groups which may be substituted with substituents selected from the group consisting or, for instance, ethyl, t-butyl, sec-amyl, cyclohexyl and benzyl groups. The term "aromatic group" means cyclic hydrocarbon type aromatic groups such as phenyl and naphthyl groups; and heterocyclic aromatic groups such as furyl, thienyl, pyrazolyl, pyridyl and indolyl groups, which may be a monocyclic or condensed ring type one such as benzofuryl and phenanthridinyl groups. These aromatic rings may have substituents.

The among the members of the "heterocyclic group", those having 3 to 10-membered ring structures comprised of carbon, oxygen, nitrogen, sulfur or hydrogen atoms are preferable. The heterocyclic ring per se may be saturated or unsaturated and may further be substituted with substituents such as chromanyl pyrrolidyl, pyrrolinyl and morpholinyl groups.

Sulfinic acids salts used herein are, for instance, alkali metal salts, alkaline earth metal salts, salts of nitrogen-containing organic bases or ammonium salts. Examples of alkali metals are Na, K and Li and those of alkaline earth metals are Ca and Ba. Nitrogen atom-containing organic bases correspond to usual amines capable of forming salts with sulfinic acids. In this respect, if the sulfinic acids have a plurality of —$SO_2H$ groups per molecule, these salts may be a partial or complete salts thereof.

On account of the stain inhibiting effect, preferred examples of sulfinic acids and salts and precursors thereof are compounds composed of aromatic groups or heterocyclic groups to which at least one —$SO_2H$ is attached and alkali metal, alkaline earth metal, nitrogen atom-containing organic base or ammonium salts thereof, more preferably compounds composed of aromatic groups (particularly phenyl group) to which at least one —$SO_2H$ group is bounded and alkali metal or alkaline earth metal salts thereof. In other words, preferred are alkali metal or alkaline earth metal salts of aromatic sulfinic acids.

When the group —$SO_2H$ is bound to a phenyl group, the substituents for phenyl group are preferably a combination of groups of which the sum of Hammet's sigma values is at least 0.0.

On the other hand, on account of solubility in water, the sum of carbon atoms of the preferred sulfinic acids and salts and precursors thereof varies depending on the number of hydrophilic groups. However, it is preferably at most 20, in particular 1 to 15.

Specific examples of sulfinic acids and salts thereof are as follows:

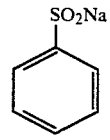

I-1

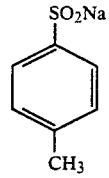

I-2

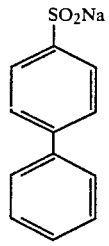

I-3

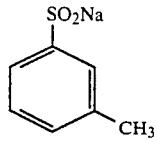

I-4

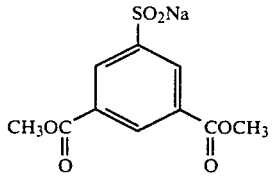

I-5

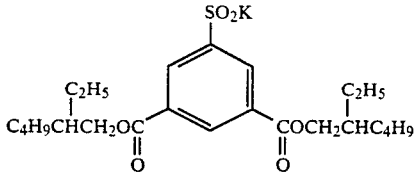

I-6

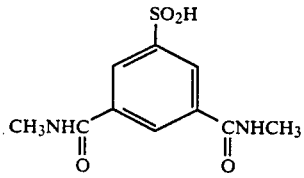

I-7

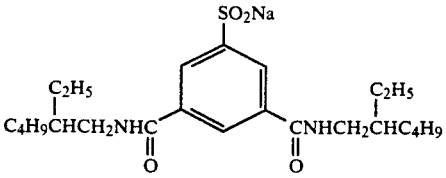

I-8

-continued
I-9
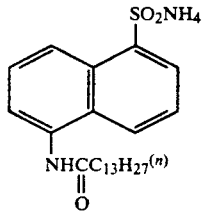
I-10
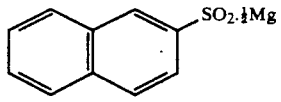
I-11
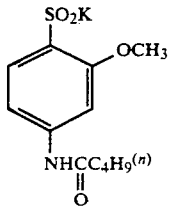
I-12
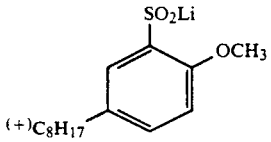
I-13
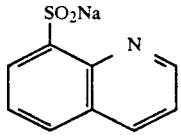
I-14
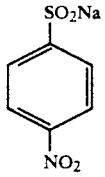
I-15
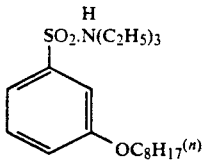
I-16
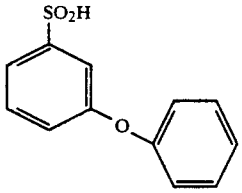
I-17
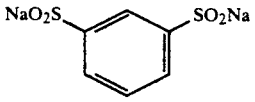
I-18
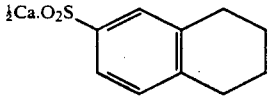
-continued
I-19
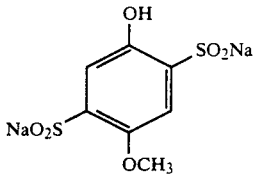
I-20
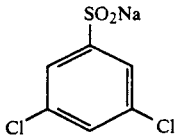
I-21
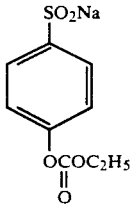
I-22
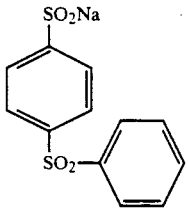
I-23
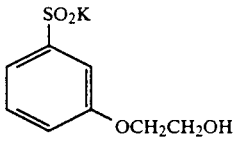
I-24
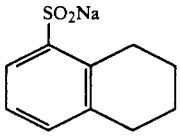
I-25
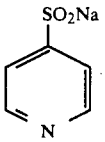
I-26
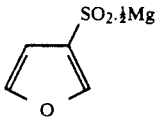
I-27
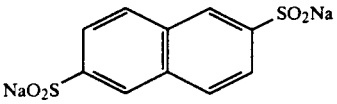
I-28 $^{(n)}C_4H_9SO_2Na$
I-29 $C_4H_9CH(C_2H_5)SO_2K$ -continued

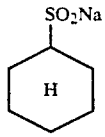

$CH_3OCH_2CH_2OCH_2CH_2SO_2NH_4$

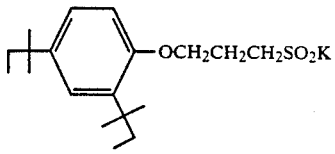

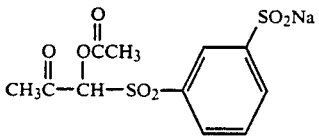

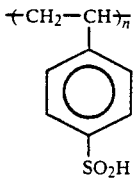

n = about 500

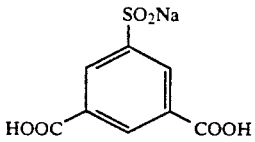

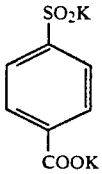

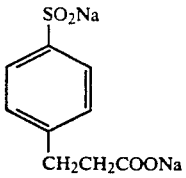

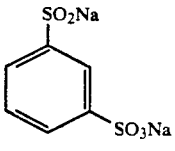

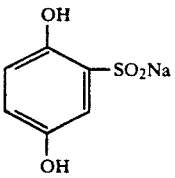

-continued

I-30

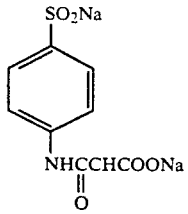

I-40

I-31

I-32

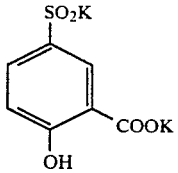

I-41

I-33 The above listed compounds can be use alone or in combination.

The aforementioned sulfinic acids may be prepared by, for instance, the method disclosed in J.P. KOKAI No. 62-14308 and those similar thereto.

I-34 In the invention, the foregoing sulfinic acids, and precursors and salts thereof can be incorporated into any processing solution used in the processing of light-sensitive materials.

Examples of such processing solutions are color developers, monochromatic developers, bleaching solutions, fixing solutions, bleach-fixing solutions, promoting solutions, stop solutions, washing solutions and stabilization solutions. Particularly, if they are added to I-35 bleach-fixing and fixing solutions, the formation of precipitates and floating substances mentioned above can effectively be prevented and the stability of images can remarkably be improved. When they are used in the desilvering process, they are preferably added to bleach-fixing solution. In this case, this effect becomes very noticeable if the ratio of the amount of replenisher I-36 to the amount carried over from the preceding bath, in the subsequent process (for instance, water washing process), is limited to 1 to 50. From the viewpoint of image stabilization, particularly stain inhibition as well as to prevent the formation of the aforesaid precipitation and floating substances, they are preferably added to washing water or stabilization solution which is used I-37 in the final processing step, particularly to the final bath in the case of multistage counter current system.

When these compounds are added to the color developer, it is possible to simultaneously prevent deterioration of the developer and coloration (formation of tar) and in turn to prevent the increment in color density on the white ground and the coloration thereof during continuous processing. Such effects are noteceable par- I-38 ticularly in the case where the color developer is substantially free from benzyl alcohol (not more than 2.0 ml/l).

The development processing processes will hereunder be explained, but the invention is not restricted to these specific processes. In this respect, the sulfinic I-39 acids, salts or precursors thereof are preferably used in the processes given in the parenthesis.

(i) color development - (desilvering) - (water washing);

(ii) color development - (desilvering) - (stabilization);

(iii) color development - (desilvering) - (water washing) (stabilization);

(iv) monochromatic development - water washing - reversal - color development - water washing (desilvering) - (water washing) - (stabilization);

wherein the desilvering process can be either of (1) (bleach-fixing), (2) bleaching - (bleach-fixing) and (3) bleaching - (fixing) and rinsing processes can be arranged between the color development and desilvering processes. Sulfinic acids and salts and precursors thereof must be added to at least one of the processes given in the parenthesis.

The amount of the sulfinic acids and salts and precursors thereof to be added to the processing solutions is not critical, but desirably $1\times10^{-4}$ to 1 mole/l, preferably $1\times10^{-3}$ to 0.5 mole/1. Moreover, sulfinic acids, salts or precursors thereof can be added directly to a tank solution or to a replenisher. When sulfinic acids, salts or precursors thereof are added to at least two processing solutions, either of them can be added thereto through the solution carried over from the preceding bath.

Particulaty preferred embodiments of the present invention are as follows:

1. A method for processing, with processing solutions containing at least one sulfinic acid or salt thereof, a color light-sensitive material obtained by employing at least one specific coupler detailed below, i.e., couplers represented by the following general formulas (I) to (V);

2. A method for processing a color light-sensitive material with processing solutions containing sulfinic acids or salts thereof, in which the ratio of the amount of replenisher for water washing and/or stabilization processes to the amount carried over per unit area of the processed light-sensitive material from the preceding process to these processes is adjusted to 1 to 50; and 3. A method for water washing and/or stabilizing a color light-sensitive material in the presence of sulfinic acids or salts thereof.

Each process will be explained in more detail below.

Color Developing Process

The color developer used in this process comprises known aromatic primary amine color developing agents. Preferred examples thereof are p-phenylenediamine derivatives of which typical examples are listed below, but the invention is not restricted to these specific examples:

D-1: N,N-diethyl-p-phenylenediamine;
D-2: 2-amino-5-diethylaminotoluene;
D-3: 2-amino-5-(N-ethyl-N-laurylamino)-toluene;
D-4: 4-(N-ethyl-N-(beta-hydroxyethyl)-amino)-aniline;
D-5: 2-methyl-4-(N-ethyl-N-(beta-hydroxyethyl)-(amino)-aniline;
D-6: 4-amino-3-methyl-N-ethyl-N-(beta-(methanesulfonamido)-ethyl)-aniline;
D-7: N-(2-amino-5-diethylaminophenylethyl)-methanesulfonamide;
D-8: N,N-dimethyl-p-phenylenediamine;
D-9: 4-amino-3-methyl-N-ethyl-N-methoxyethylaniline;
D-10: 4-amino-3-methyl-N-ethyl-N-beta-ethoxyethylaniline;
D-11: 4-amino-3-methyl-N-ethyl-N-beta-butoxyethylaniline.

These p-phenylenediamine derivatives may be salts thereof, such as sulfates, hydrochlorides, sulfites and p-toluenesulfonates. The amount of the aromatic primary amine color developing agents in the developer is preferably about 0.1 to about 20 g/l more preferably about 0.5 to about 10 g/l.

The color developer may optionally contain, as a preservative, sulfites such as sodium sulfite, potassium sulfite, sodium bisulfite, potassium bisulfite, sodium metasulfite and potassium metasulfite; or carbonyl-sulfurous acid adducts. However, a small amount of sulfite ions is preferably added to enhance the color developing ability of the color developer.

It is also preferable to add compounds capable of directly preserving the color developing agents, such as a variety of hydroxylamines; hydroxamic acids disclosed in J.P.A. No. 61-186559; hydrazines and hydrazides disclosed in J.P.A. No. 61-170756; phenols disclosed in J.P.A. Nos. 61-188741 and 61-203253; alpha-hydroxyketones and alphaaminoketones disclosed in J.P.A. No. 61-188741; and/or various sugars disclosed in J.P.A. No. 61-180616. The foregoing compounds are preferably used together with monoamines disclosed in J.P.A. Nos. 61-147823, 61-166674, 61-165621, 61-164515, 61-170789 and 61-168159; diamines disclosed in J.P.A. Nos. 61-173595, 61-164515 and 61-186560; polyamines disclosed in J.P.A. Nos. 61-165621, 61-169789 and 61-188619; nitroxy radicals disclosed in J.P.A. No. 61-197760; alcohols disclosed in J.P.A. Nos. 61-186561 and 61-197419; oximes disclosed in J.P.A. No. 61-198987; and/or tertiary amines disclosed in J.P.A. No. 61-265149.

The color developer may optionally contain other preservatives such as various metals disclosed in J.P. KOKAI Nos. 57-44148 and 57-53749; salicylic acids diosclosed in J.P. KOKAI No. 59-180588; alkanolamines disclosed in J.P. KOKAI No. 54-3532; polyethyleneimines disclosed in J.P. KOKAI No. 6-94349; and/or aromatic polyhydroxyl compounds disclosed in U.S. Pat. No. 3,746,544. Particularly, the use of aromatic polyhydroxyl compounds, triethanolamine and compounds disclosed in J.P.A. No. 61-265149 is preferred.

The color developer is preferably adjusted to pH 9 to 2, more preferably 9 to 11.0 and may further contain other known components.

To hold the foregoing pH range, the developer preferably contain various pH buffering agents such as carbonates, phosphates, borates, tetraborates, hydroxybenzoates, glycyl salts, N,N-dimethyl glycine salts, leucine salts, norluecine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lycine salts. It is particularly preferred to use, as such buffering agents, carbonates, phosphates, tetraborates and hydroxybenzoates because they exhibit good solubility, excellent buffering ability at high pH range of not less than 9.0 and they exert no influence (such as fog) on the photographic properties and are also cheap.

Specific examples thereof include sodium carbonate, potassium carbonate, sodium bicarbonate, potassium bicarbonate, trisodium phosphate, tripotassium phosphate, disodium hydrogen phosphate, dipotassium hydrogen phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the invention is not restricted to these specific examples.

The color developer preferably comprises these buffering agents in an amount of not less than 0.1 mole/l in particular 0.1 to 0.4 mole/l.

The color developer further comprises various chelating agents for solubilizing calcium and magnesium or for enhancing the stability of the color developer.

Preferred chelating agents are organic compounds and examples thereof include aminopolycarboxylic acids disclosed in J.P. KOKOKU Nos. 48-30496 and 44-30232; organic phosphonic acids disclosed in J.P. KOKAI No. 56-97347, J.P. KOKOKU No. 56-39359 and German Patent No. 2,227,639; phosphonocarboxylic acids disclosed in J.P. KOKAI Nos. 52-102726, 53-42730, 54-121127, 55-126241 and 55-659506; and other compounds disclosed in J.P. KOKAI Nos. 58-195845 and 58-203440 and J.P. KOKOKU No. 53-40900 Specific examples thereof will be listed below, but the invention is not restricted to these specific examples: Nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, trans-cyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)-ethylenediamine-N,N'-diacetic acid and hydroxyethyliminodiacetic acid. These chelating agents may optionally be used in combination.

These chelating agents may be used in an amount sufficient to sequester metal ions present in the color developer. For instance, they are used in the order of 0.1 to 10 g/l.

The color developer optionally comprises any development accelerators. However, the color developer used in the invention is preferably substantially free from benzyl alcohol from the viewpoint of environmental protection, easy preparation thereof and prevention of color stains. The term "substantially free from" herein means that the content of benzyl alcohol is not more than 2 ml/l and preferably zero.

Sulfinic acid and salt thereof used in the invention show remarkable effects in the process wherein a color developer substantially free from benzyl alcohol is used.

Examples of development accelerators usable in this invention are thioether type compounds disclosed in J.P. KOKOKU Nos. 37-16088, 37-5987, 38-7826, 44-12380 and 45-9019 and U.S. Pat. No. 3,813,247; p-phenylenediamine type compounds disclosed in J.P. KOKAI Nos. 52-49829 and 50-15554; quaternary ammonium salts disclosed in J.P. KOKAI Nos. 50-137726, 56-156826 and 52-43429 and J.P. KOKOKU No. 44-30074; amine type compounds disclosed in U.S. Pat. Nos. 2,494,903, 3,128,182, 4,230,796, 3,253,919, 2,482,546, 2,596,926 and 3,582,346 and J.P. KOKOKU No. 41-11431; polyalkylene oxides disclosed in J.P. KOKOKU Nos. 37-16088, 42-25201, 41-11431 and 42-23883 and U.S. Patent Nos. 3,128,183 and 3,532,501; 1- phenyl-3-pyrazolidones; and imidazoles.

The color developer as used herein may contain any antifoggants which may be alkali metal halides such as sodium chloride, potassium bromide and potassium iodide and organic antifoggants. Typical examples of the latter include nitrogen-containing heterocyclic compounds such as benzotriazole, 6-nitrobenzimidazole, 5-nitrosoindazole, 5-methylbenzotriazole, 5-nitrobenzotriazole, 5-chlorobenzotriazole, 2-thiazolyl-benzimidazole, 2-thiazolylmethylbenzimidazole, indazole, hydroxyazaindolizine and adenine.

The color developer used in the invention preferably comprises fluorescent whiteners, preferably 4,4'-diamino-2,2'-disulfostilbene type compounds. The amount thereof ranges from 0 to 5 g/l, preferably 0.1 to 4 g/l.

It may also contain, if necessary, various surfactants such as alkyl sulfonic acids, aryl sulfonic acids, aliphatic carboxylic acids and aromatic carboxylic acids.

The temperature of the color developer during processing ranges from 20° to 50° C., preferably 30° to 40° C. while the processing time thereof ranges from 20 seconds to 5 minutes, preferably 30 seconds to 2 minutes. The amount of replenisher is preferably as low as possible, but it is generally 20 to 600 ml, preferably 50 to 300 ml and more preferably 100 to 200 ml per 1 $m^2$ of the processed light-sensitive material.

Referring now to the desilvering process in the method of this invention, it may be either of bleaching and fixing processes; fixing and bleach-fixing processes; bleaching and bleach-fixing processes; and bleach-fixing process. In the present invention, remarkable intended effects can be attained by shortening the desilvering time. Thus, the desilvering time is generally not more than 2 minutes, preferably 15 to 60 seconds.

Desilvering Process

The bleaching, bleach-fixing and fixing solutions used in this process will be explained in detail below.

Any bleaching agent may be used in the bleaching and bleach-fixing solutions, and preferred examples thereof are organic complex salts of iron(III) such as iron(III) salts with aminopolycarboxylic acids (e.g., ethylenediaminetetraacetic acid and diethylenetriaminepentaacetic acid), aminopolyphosphonic acids, phosphonocarboxylic acids and organic phosphonic acids; organic acids such as citric acid, tartaric acid and malic acid; persulfates; and hydrogen peroxide The organic complex salts of iron(III) are particularly preferred in view of environmental protection and rapid processing. Examples of aminopolycarboxylic acids, aminopolyphosphonic acids, organic phosphonic acids and salts thereofuseful for forming such organic complex salts of iron(III) are ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycol ether diaminetetraacetic acid.

These compounds can be sodium, potassium, lithium or ammonium salts. Among these, preferred are ferric salts of ethylenediaminetetraacetic acid, diethylenetriaminepentaacetic acid, 1,3-diaminopropanetetraacetic acid and methyliminodiacetic acid because of their high bleaching ability.

The ferric ion complex salt may be used as it is or it may be formed in situ by reacting, in a solution, a ferric salt such as ferric sulfate, ferric chloride, ferric nitrate, ferric ammonium sulfate or ferric phosphate with a chelating agent such as an aminopolycarboxylic acid, an aminopolyphosphonic acid or a phosphonocarboxylic acid, in which the latter may be used in excess amount greater than the stoichiometric amount thereof. Preferred ferric complexes are those with aminopolycarboxylic acids and the amount thereof to be added is 0.01 to 1.0 mole/l preferably 0.05 to 0.50 mole/l.

Various bleaching accelerators can be added to bleaching, bleach-fixing and/or the preceding baths thereof. Preferred examples thereof include compounds having mercapto groups or disulfide bonds disclosed in U.S. Pat. No. 3,893,858, German Patent No. 1,290,812, J.P. KOKAI No. 53-95630 and Reserach Disclosure No. 17129 (July, 1978); thiourea type compounds disclosed in J.P. KOKOKU No. 45-8506, J.P. KOKAI Nos 52-20832 and 53-32735 and U.S. Pat. No. 3,706,561; or halides such as iodide or bromide in view of their high bleaching ability.

In addition, the bleaching and bleach-fixing solutions may contain rehalogenating agents such bromides as potassium bromide, sodium bromide and ammonium bromide; such chlorides as potassium chloride, sodium chloride and ammonium chloride; or such iodides as ammonium iodides. These solutions may optionally contain at least one inorganic acids, organic acids or their alkali metal or ammonium salts having pH buffering ability such as boric acid, borax, sodium metaborate, acetic acid, sodium acetate, sodium carbonate, potassium carbonate, phosphorous acid, phosphoric acid, sodium phosphate, citric acid, sodium citrate and tartaric acid; anticorrosive agents such as ammonium nitrate and guanidine; and the like.

Fixing agents used in the fixing and bleach-fixing solutions used in the invention are water-soluble silver halide solubilizing agents such thiosulfates as sodium thiosulfate and ammonium thiosulfate; such thiocyanates as sodium thiocyanate and ammonium thiocyanate; such thioether compounds as ethylene-bis(thioglycolic acid) and 3,6-dithia-1,8-octanediol; and thioureas, which may be used alone or in combination. Moreover, specific bleach-fixing solutions may also be used. One example of such solution comprises a combination of fixing agents and a large amount of potassium iodide and is disclosed in J.P. KOKAI No. 55-155534. In the invention, the use of thiosulfates, in particular, ammonium thiosulfate is preferable. The amount of the fixing agents used is preferably 0.3 to 2 mole/l, more preferably 0.5 to 1.0 mole/l. The pH thereof preferably ranges from 3 to 10, particularly 5 to 9.

The bleach-fixing solution may further comprises various fluorescent whiteners, antifoaming agents or surfactants, polyvinyl pyrrolidone, organic solvents such as methanol and the like.

The bleach-fixing and fixing solutions used in the invention may contain, as preservatives, sulfite ion-releasing compounds such sulfites as sodium sulfite, potassium sulfite and ammonium sulfite; such bisulfites as ammonium bisulfite, potassium bisulfite and sodium bisulfite; and such metabisulfites as potassium metabisulfite, sodium metabisulfite and ammonium metabisulfite. The amount of these compounds is preferably about 0.02 to 0.50 mole/l and more preferably 0.04 to 0.40 mole/l expressed in the amount of sulfite ions.

Generally, sulfites are used as the preservatives, but it is also possible to use other preservatives such as ascorbic acid, carbonyl/bisulfite adducts or carbonyl compounds.

These solutions may optionally contain buffering agents, fluorescent whiteners, chelating agents, antifoaming agents, mold controlling agents and the like.

Water Washing and/or Stabilization Process

In the processing of the present invention, the light-sensitive materials desilvered by fixing and/or bleach-fixing processes are generally water washed and/or stabilized.

The amount of washing water may widely vary depending on various factors such as properties and applications of the processed light-sensitive material which depend on, for instance, the materials used such as couplers; temperature of the washing water; the number of washing tanks (step number); methods for replenishing such as countercurrent flow system and direct flow system; and other various factors. Among these, the relation between the number of washing baths and the amount of water in the multistage countercurrent flow system can be determined by the method disclosed in Journal of the Society of Motion Picture and Television Engineers, Vol. 64, pp. 248–253 (May, 1955). The step number in this flow system is preferably 2 to 6, particularly 2 to 4.

The multistage countercurrent flow system permits the reduction in the amount of washing water, for instance, to not more than 1.0 liter, preferably not more than 0.5 1, whereby noticeable effects of the invention can be ensured, while bacteria proliferate in the tanks because of increase in the residence time of water therein and as a result, problems of adhesion of the resultant floating substances to the processed light-sensitive materials arise. In processing the light-sensitive materials, the method for reducing the amount of calcium and magnesium disclosed in U.S. Ser. No. 057254 filed on June 3, 1987 may conveniently be employed to solve the foregoing problem. This problem may also be solved by using antibacterial agents such as isothiazolone compounds or thiabendazoles disclosed in J.P. KOKAI No 57-8542; such chlorine type antibacterial agents as sodium chlorinated isocyanurates disclosed in J.P. KOKAI No. 61-120145; benzotriazoles disclosed in J.P.A. No. 60-105487; copper ions; or other antibacterial agents disclosed in "BOKIN BOBAIZAI NO KAGAKU" (Chemistry of Antibacterial and Antifungus Agents)", Hiroshi HORIGUCHI; "BISEIBUTSU NO MEKKIN, SAKKIN AND BOBAI GIJUTSU (Sterilization, Pasteurization and Mold Controlling Techniques)", edited by Sanitary Engineering Society; and "Dictionary of Antibacterial and Antifungus Agents", edited by Japan Bacteria and Fungi Controlling Society.

Moreover, the washing water may contain surfactants as a water drainage and chelating agents such as EDTA as a softener for hard water.

The stabilization process may be carried out directly without carryinbg out the water washing process or subsequent thereto. The stabilization solution contains compounds capable of stabilizing images, such as aldehyde compounds (e.g., formalin); buffering agents for adjusting film pH to a value suitable for stabilizing dye images; and ammonium compounds. To prevent the proliferation of bacteria and to impart the mold controlling property to the processed light-sensitive materials, the aforementioned antibacterial and mold controlling agents may be used The stabilization solution may contain surfactants, fluorescent whiteners and film hardening agents. When the stabilization process is carried out without carrying out the water washing in the invention, it is possible to employ any known methods disclosed in J.P. KOKAI Nos. 57-8543, 58-14834 and 60-220345.

In a preferred embodiment, the stabilization solution may further contain chelating agents such as 1-hydroxyethylidene-1,1-diphosphonic acid and ethylenediaminetetramethylenephosphonic acid; and magnesium and bismuth compounds.

In the present invention, so-called rinsing solutions may likewise be employed instead of washing water and/or stabilization solutions used after the desilvering process.

The pH of washing water or stabilization solution is 4 to 10, preferably 5 to 8. The temperature thereof may vary depending on factors such as applications and properties of the light-sensitive material to be processed, but it it generally 15° to 45° C., preferably 20° to 40°. The processing time is not critical. However, noticeable effects can be ensured when it is set as short as possible. It is preferably 30 seconds to 4 minutes and more preferably 30 seconds to 2 minutes. The amount of replenishers for these solutions is preferably rather small from the viewpoint of running cost, reduction in the amount of waste liquor and handling properties and more excellent effects can thereby be achieved.

Specifically, the preferred amount thereof to be replenished is 1.0 to 50 times, more preferably 3 to 40 times the volume of the solution carried over from the preceding bath per unit area of the processed light-sensitive material. Alternatively, it is not more than one liter, preferably not more than 500 ml per 1 $m^2$ of the processed light-sensitive material. The replenishment thereof may be carried out continuously or intermittently.

The used solutions for water washing and/or stabilization processes may be recycled to the preceding process. One such example is to let the overflow of washing water, the amount of which is reduced by employing multistage countercurrent flow system, flow into the preceding bath or the bleach-fixing bath while replenishing a concentrate to the latter to reduce the amount of waste liquor.

The method of this invention may be applied to processings of any light-sensitive material such as color paper, color reversal paper color direct positive light-sensitive materials, color positive films, color negative films and color reversal films, particularly color paper and color reversal paper.

The silver halide color photographic light-sensitive materials processed by the present invention will be detailed below.

It is required to incorporate various color couplers into the light-sensitive materials processed in this invention. The term "color coupler(s)" herein means compounds capable of forming a dye through a coupling reaction with an oxidized form of an aromatic primary amine developing agent. Typical examples of color couplers useful in the invention include naphtholic or phenolic compounds, pyrazolone or pyrazoloazole type compounds and linear or heterocyclic ketomethylene compounds. Specific examples of these cyan-, magenta- and yellow-couplers usable in the invention are disclosed in the patents cited in Research Disclosure No. 17643 (December, 1987), Item VII-D; and No. 18717 (November, 1979).

Color couplers included in the light-sensitive materials are preferably made non-diffusible by imparting thereto ballast groups or polymerizing them. 2-Equivalent color couplers in which the active site for coupling is substituted with an elimination group are rather preferred than 4-equivalent color couplers in which the active site for coupling is hydrogen atom, this is because the amount of coated silver may thereby be reduced and more excellent effects of the invention can be attained. Moreover, couplers in which a formed dye has a proper diffusibility, non-color couplers, DIR couplers which can release a development inhibitor through the coupling reaction or couplers which can release a development accelerator may also be used.

Typical yellow couplers usable in the invention are acylacetamide type couplers of an oil protect type. Examples of such yellow couplers are disclosed in U.S. Pat. Nos. 2,407,210; 2,875,057 and 3,265,506. 2-Equivalent yellow couplers are preferably used in the invention. Typical examples thereof are the yellow couplers of an oxygen atom elimination type disclosed in U.S. Pat. Nos. 3,408,194; 3,447,928; 3,933,501 and 4,022,620, or the yellow couplers of a nitrogen atom elimination type disclosed in J.P. KOKOKU No. 58-10739, U.S. Pat. Nos 4,401,752 and 4,326,024, Research Disclosure No. 18053 (April, 1979), U.K. Patent No. 1,425,020, DEOS Nos. 2,219,917; 2,261,361; 2,329,587 and 2,433,812. Alpha-pivaloyl acetanilide type couplers are excellent in fastness, particularly light fastness, of formed dye. On the other hand, alpha-benzoyl acetanilide type couplers yield high color density.

Magenta couplers usable in the invention include couplers of an oil protect type of indazolone, cyanoacetyl, or preferably pyrazoloazole type ones such as 5-pyrazolones and pyrazolotrizaoles. Among 5-pyrazolone type couplers, couplers whose 3-position is substituted with an arylamino or acylamino group are preferred from the viewpoint of color phase and color density of the formed dye. Typical examples thereof are disclosed in U.S. Pat. Nos. 2,311,082; 2,343,703; 2,600,788; 2,908,573; 3,062,653; 3,152,896 and 3,936,015. An elimination group of the 2-equivalent 5-pyrazolone type couplers is preferably a nitrogen atom elimination group disclosed in U.S. Pat. No. 4,310,619 and an arylthio group disclosed in U.S. Pat. No. 4,351,897. The 5-pyrazolone type couplers having ballast groups such as those disclosed in European Patent No. 73,636 provide high color density.

As examples of pyrazoloazole type couplers, there may be mentioned such as pyrazolobenzimidazoles disclosed in U.S. Pat. No. 3,369,879, preferably pyrazolo(5,1-c)(1,2,4)triazoles disclosed in U.S. Pat. No. 3,725,067; pyrazolotetrazoles disclosed in Research Disclosure No. 24220 (June, 1984) and pyrazolopyrazoles disclosed in Research Disclosure No. 24230 (June, 1984). Imidazo(1,2-b)pyrazoles such as those disclosed in European Patent No. 119,741 are preferred on account of small yellow minor absorption of formed dye and light fastness. Pyrazolo(1,5-b)(1,2,4)triazoles such as those disclosed in European Patent No. 119,860 are particularly preferred.

Cyan couplers usable in the invention include naphtholic or phenolic couplers of an oil protect type. Typical examples of naphthol type couplers are those disclosed in U.S. Pat. No. 2,474,293. Typical preferred 2-equivalent naphtholic couplers of oxygen atom elimination type are disclosed in U.S. Pat. Nos. 4,052,212; 4,146,396; 4,228,233; and 4,296,200. Typical phenol type couplers are those disclosed in U.S. Pat. Nos. 2,369,929; 2,801,171; 2,772,162 and 2,895,826.

Cyan couplers resistant to humidity and heat are preferably used in the invention. Examples of such couplers are phenol type cyan couplers having an alkyl group higher than methyl group at a metha-position of a phenolic nucleus as disclosed in U.S. Pat. No. 3,772,002; 2,5-diacylamino-substituted phenol type couplers as disclosed in U.S. Pat. Nos. 2,772,162; 3,758,308; 4,126,396; 4,334,011 and 4,327,173; DEOS No. 3,329,729 and J.P. KOKAI No. 59-166956; and phenol type couplers having a phenylureido group at 2-position and an acylamino group at 5-position of the phenol nucleus as disclosed in U.S. Pat. Nos. 3,446,622; 4,333,999; 4,451,559 and 4,427,767.

In the present invention, if the sulfinic acids or salts thereof are added to a bath having fixing ability (e.g., bleach-fixing bath), a water washing bath or a stabilization bath, it is particularly preferable to use, as a coupler contained in the light-sensitive material to be processed, at least one coupler represented by the following general formulas (I) to (V). This is because the storability of images after processing is greatly improved or the formation of stains after processing is substantially suppressed. The use of the following cyan, magenta and yellow couplers is particularly preferable.

Particularly preferred 2-equivalent couplers used in the invention are as follows:

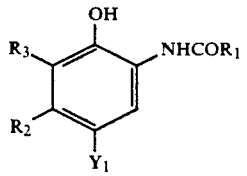

(I)

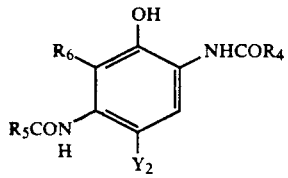

(II)

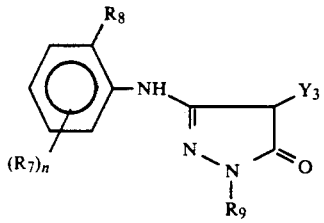

(III)

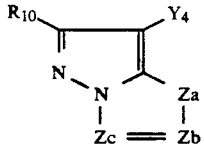

(IV)

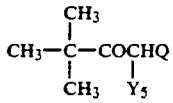

(V)

In the foregoing formulas, $R_1$, $R_4$ and $R_5$ each independently represents an aliphatic, aromatic, heterocyclic, aromatic amino or heterocyclic amino group; $R_2$ represents an aliphatic group having at least two carbon atoms; $R_3$ and $R_6$ each independently represent a hydrogen or halogen atom, or an aliphatic, aliphatic oxy or acylamino group; $R_7$ represents a substituent on a benzene ring; $R_8$ is halogen atom, or an alkoxy or alkyl group; $R_9$ is a substituted or unsubstituted phenyl group; $R_{10}$ is a hydrogen atom or a substituent; Q is a substituted or unsubstituted N-phenylcarbamoyl group; Za, Zb and Zc each represents a methine, a substituted methine, =N-or —NH—, provided that one of the bonds Za-Zb and Zb-Zc is a double bond while the other is a single bond, that if Zb-Zc bond is a carbon-carbon double bond, this bond may be a part of an aromatic ring and that if Za, Zb and/or Zc are substituted methines, these may form a dimer or a higher polymer at the positions of the substituted methines; and $Y_1$ to $Y_5$ each is a halogen atom or a group capable of being eliminated through a coupling reaction with an oxidized form of the developing agent (hereunder referred to as "elimination group").

In the formulas (I) and (II), pairs of $R_2$ and $R_3$; and $R_5$ and $R_6$ may form a 5- to 7-membered ring respectively.

These compounds represented by the formulas (I) to (V) may form a dimer or a higher polymer at least one position selectred from those where $R_1$ to $R_{10}$, $Y_1$ to $Y_5$, Za to Zc and Q are present.

The term "aliphatic group" herein means linear, branched or cyclic alkyl, alkenyl or alkynyl group.

In the formulas (I) to (V), the elimination group represented by $Y_1$ to $Y_5$ is one which links the active carbon atom for coupling with an aliphatic, aromatic or heterocyclic group; an aliphaticm, aromatic or heterocyclic sulfonyl group; or an aliphatic, aromatic or heterocyclic carbonyl group through an oxygen, nitrogen, sulfur or carbon atom; a halogen atom or an aromatic azo group. The aliphatic, aromatic and heterocyclic group included in the elimination groups may be substituted with substituents such as those defined below in connection with $R_1$. If they have at least two substituents, these substituents may be the same or different and these substituents may further be substituted with such substituents as those defined below in connection with $R_1$.

Specific examples of elimination groups include halogen atoms such as fluorine, chlorine and bromine; alkoxy groups such as ethoxy, dodecyloxy, methoxyethylcarbamoylmethoxy, carboxypropyloxy and methylsulfonylethoxy groups; aryloxy groups such as 4-chlorophenoxy, 4-methoxyphenoxy and 4-carboxyphenoxy groups; acyloxy groups such as acetoxy, tetradecanoyloxy and benzoyloxy groups; aliphatic or aromatic oxy groups such as methanesulfonyloxy and toluene-sulfonyloxy groups; acylamino groups such as dichloroacetyl-amino and heptafluorobutyrylamino groups; aliphatic or aromatic sulfonamido groups such as methanesulfonamido and p-toluenesulfonamido groups; alkoxycarbonyloxy groups such as ethoxycarbonyloxy and benzyloxycarbonyloxy groups; aryloxycarbonyloxy groups such as phenoxycarbonyloxy group; aliphatic, aromatic or heterocyclic thio groups such as ethylthio, phenylthio and tetrazolylthio groups; carbamoylamino groups such as N-methylcarbamoylamino and N-phenylcarbamoylamino groups; 5- or 6-membered nitrogen-containing heterocyclic groups such as imidazolyl, pyryzolyl, triazolyl, tetrazolyl, 1,2-dihydro-2-oxo-1-pyridyl groups; imido groups such as succinimido and hydantoinyl groups; and aromatic azo groups such as phenylazo group. These groups may be substituted with such substituents as those defined in connection with $R_1$. Examples of couplers having elimination groups bonded thereto through a carbon atom include bis-type couplers obtained by condensing 4-equivalent couplers with aldehydes or ketones. The elimination groups used in the invention may include photographically useful groups such as development inhibiting or development accelerating groups. The preferred elimination groups in each formula will be detailed below.

Cyan couplers represented by the formulas (I) and (II) may be prepared by any known method, for instance, disclosed in U.S. Pat. Nos. 2,423,730 and 3,772,002 (couplers represented by the formula (I)) and U.S. Pat. Nos. 2,895,826; 4,333,999 and 4,327,173 (couplers represented by the formula (II)).

In the formulas (I) and (II), preferred $R_1$, $R_4$ and $R_5$ are aliphatic groups preferably having 1 to 36 carbon atoms; or aromatic, heterocyclic groups or aromatic or heterocyclic amino groups preferably having 6 to 36 carbon atoms, which may be substituted with substituents selected from hydroxyl, cyano, carboxy, nitro and sulfo groups; halogen atoms; and alkyl, aryl, heterocyclic, alkoxy, aryloxy, alkenyloxy, acyl, ester, amido, sulfamido, imido, ureido, aliphatic or aromatic sulfonyl and aliphatic or aromatic thio groups having preferably not more than 24, more preferably not more than 12 carbon atoms.

Typical examples of the aliphatic groups include methl, ethyl, butyl, dodecyl, octadecyl, eicosenyl, isopropyl, tert-butyl, tert-octyl, tert-dodecyl, cyclohexyl, cyclopentyl, allyl, vinyl, 2-hexadecenyl and propargyl groups.

$R_2$ in the formula (I) is preferably aliphatic groups having 1 to 20 carbon atoms optionally substituted by substituents such as those defined in connection with $R_1$.

$R_3$ and $R_6$ in the formulas (I) and (II) each represents a hydrogen arom, a halogen atom, an aliphatic group preferably having 1 to 20 carbon atoms, an aliphatic oxy group preferably having 1 to 20 carbon atoms, or an acylamino group preferably having 1 to 20 carbon atoms. The aliphatic, aliphatic oxy and acylamino groups may have substituents such as those defined in connection with $R_1$.

As explained above, $R_2$ and $R_3$ in the formula (I) and $R_5$ and $R_6$ in the formula (II) may form a 5- to 7-membered ring respectively.

Coupler (I) may be a dimer or a higher polymer at either of the positions at which $R_1$ to $R_3$ and $Y_1$ are attached and coupler (II) may also form a dimer or a higher polymer at either of the positions at which $R_4$ to $R_6$ and $Y_2$ are attached. When the couplers are dimers, these groups may preferably be a single bond or a bivalent linking group such as an alkylene, arylene, ether, ester and amido group. On the other hand, when the couplers are oligomers or polymers, these groups may preferably constitute main chains or may be side chains bonded to a main chain through bivalent group listed above. In the latter, the polymer may be homopolymers of such coupler derivatives or copolymers with at least one ethylenic non-dye-forming monomer such as acrylic acid, methacrylic acid, methyl acrylate, n-butyl acrylamide, beta-hydroxymethacrylate, vinyl acetate, acrylonitrile, styrene, crotonic acid, maleic anhydride and N-vinylpyrrolidone.

Preferred $R_1$ and $R_5$ are substituted or unsubstituted alkyl or aryl groups. Substituents for alkyl group are selected from optionally substituted phenoxy groups and halogen atoms (preferred substituents for phenoxy group are alkyl, alkoxy, sulfonamido and sulfamido groups and halogen atoms). Particularly preferred aryl groups are phenyl groups substituted with at least one substituent selected from halogen atoms and alkyl, sulfonamido and acylamino groups.

Preferred substituents $R_4$ in the formula (II) are substituted alkyl groups and substituted or unsubstituted aryl groups. Particularly preferred substituents for alkyl groups are halogen atoms. Particularly preferred aryl group is phenyl group and a phenyl group optionally substituted with at least one substituent seleted from halogen atoms and sulfonamido group.

Preferred substituents $R_2$ in the formula (I) are optionally substituted alkyl groups having 1 to 20 carbon atoms and more preferably alkyl groups having 2 to 4 carbon atoms. Preferred examples of the substituents for $R_2$ are alkyl- or aryl-oxy, acylamino, alkyl- or aryl-thio, imido, ureido, or alkyl- or aryl-sulfonyl groups.

Preferred examples of $R_3$ in the formula (I) are a hydrogen atom, halogen atoms (particularly fluorine or chlorine atom), and acylamino groups, particularly halogen atoms.

Preferred examples or $R_6$ in the formula (II) are a hydrogen atom, and alkyl and alkenyl groups having 1 to 20 carbon atoms, particularly a hydrogen atom.

In the formula (II), $R_5$ and $R_6$ preferably form a 5- to 6-membered nitrogen atom-containing heterocyclic ring.

In the formulas (I) and (II), $Y_1$ and $Y_2$ are preferably halogen atoms respectively, more preferably chlorine atoms.

The couplers represented by the formulas (I) and (II) may be used alone or in combination. Specific preferred examples of the couplers represented by the formulas (I) and (II) are as follows:

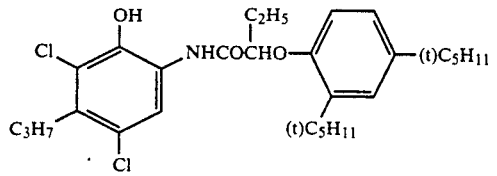

C-1

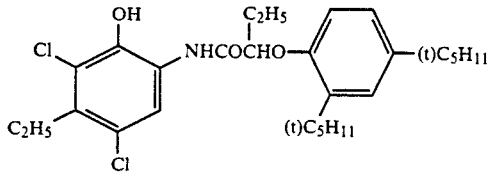

C-2

-continued
C-3
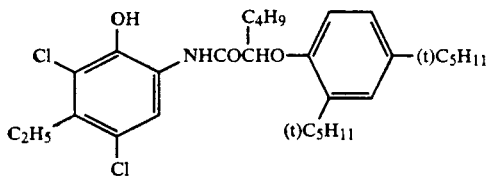
C-4
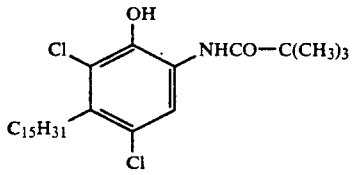
C-5
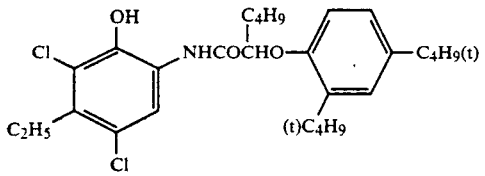
C-6
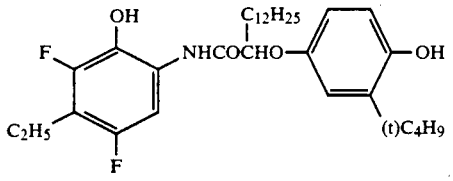
C-7
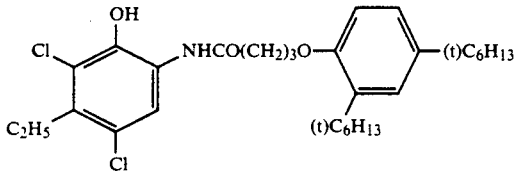
C-8
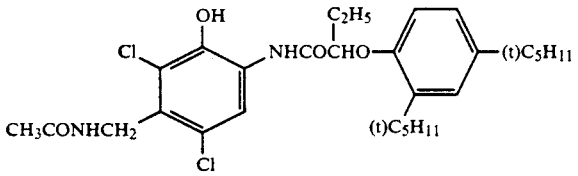
C-9
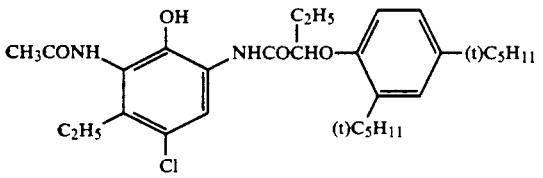
C-10
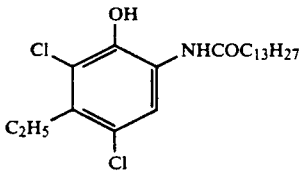

-continued
C-11
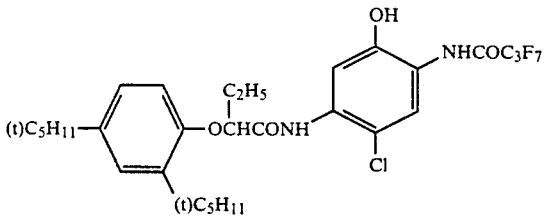
C-12
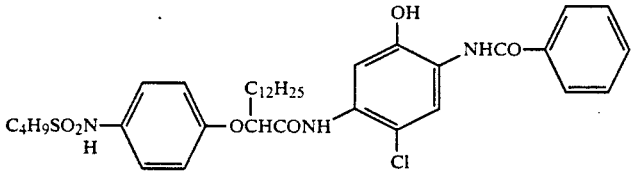
C-13
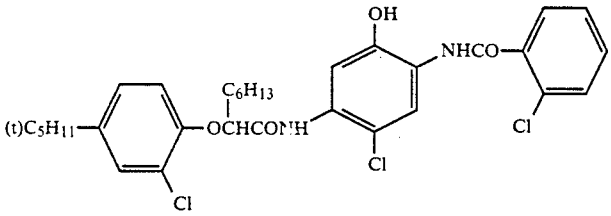
C-14
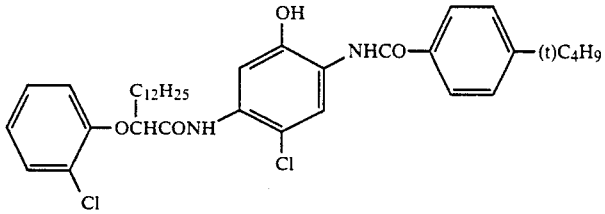
C-15
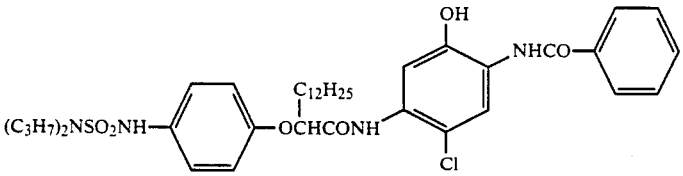
C-16
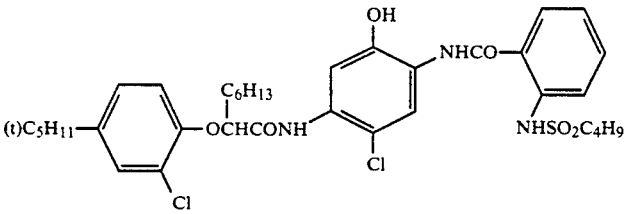
C-17
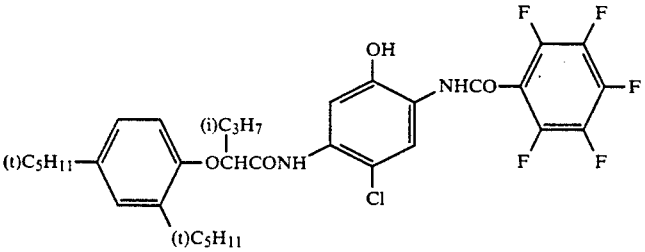

-continued
C-18
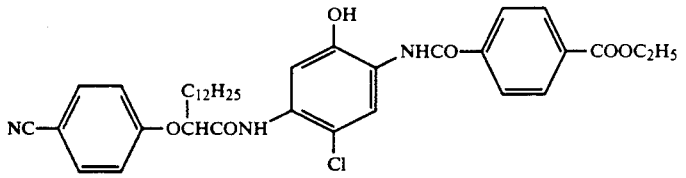
C-19
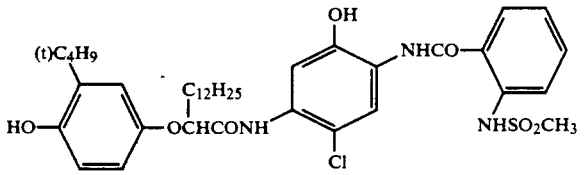
C-20
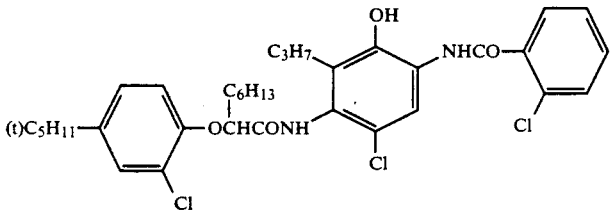
C-21
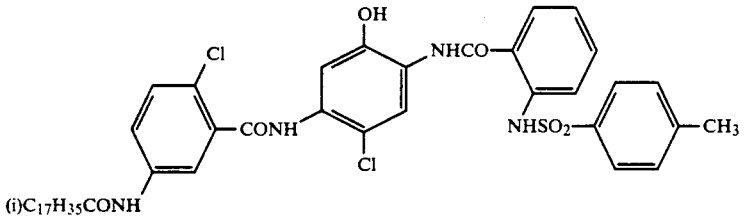
C-22
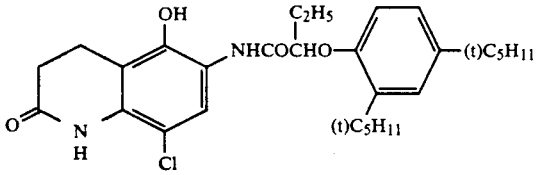
C-23
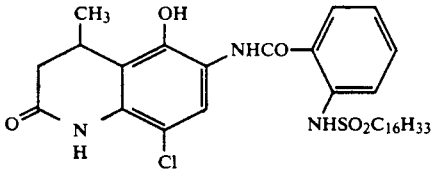
C-24
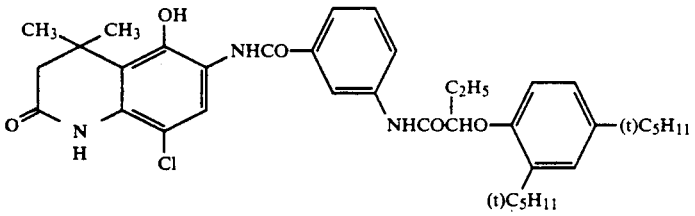
C-25
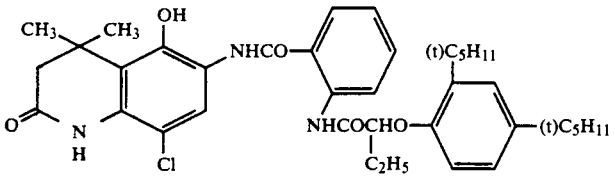

-continued

C-26

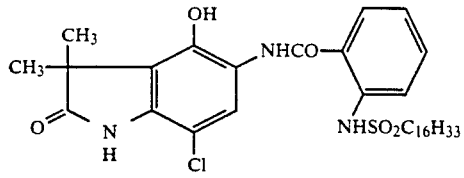

C-27

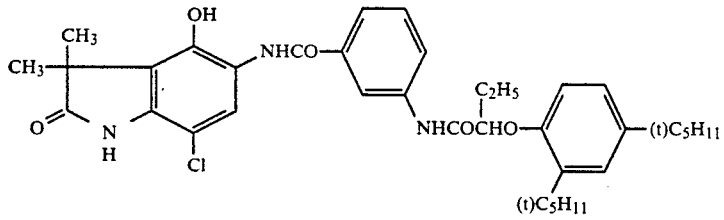

C-28

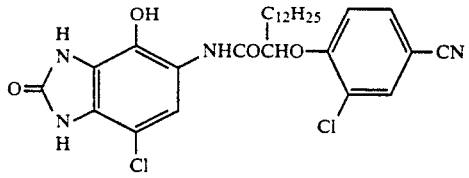

C-29

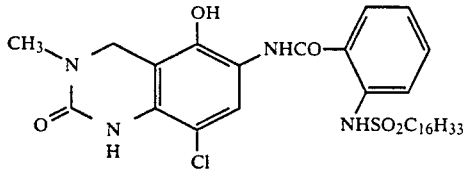

C-30

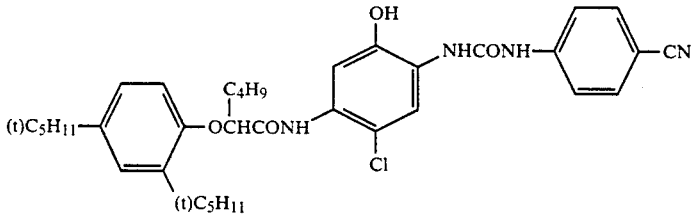

C-31

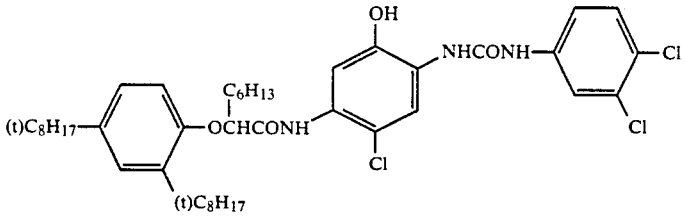

C-32

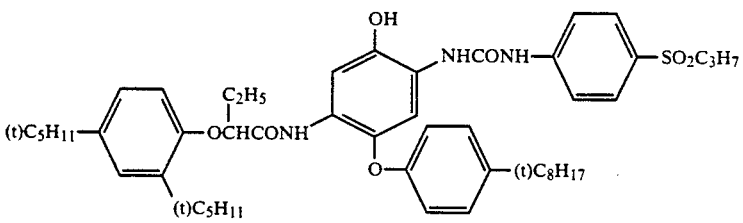

As the magenta couplers represented by the formula (III), those disclosed in J.P. KOKAI Nos. 60-262161 and 60-238832 can be employed in the invention.

In the formula (III), $R_9$ is a phenyl group, in particular a phenyl group substituted by, for instance, at least one substituent selected from halogen atoms, alkyl groups preferably having 1 to 5 carbon atoms, alkoxy groups preferably having 1 to 5 carbon atoms, aryloxy, alkoxycarbonyl, cyano, carbamoyl, sulfamoyl, sulfonyl, sulfonamido and acylamino groups, more preferably halogen atoms in particular chlorine atom.

$Y_3$ represents a group eliminated from the coupler through a coupling reaction with the oxidized form of the aromatic primary amine color developing agent to form a dye. Specifically, $Y_3$ represents a halogen atom, an alkoxy group, an aryloxy group, an acyloxy group, an arylthio group, an alkylthio group or a group represented by the formula:

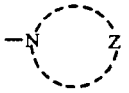

wherein Z represents an atomic group containing carbon, oxygen, nitrogen and/or sulfur atoms, required to form a 5- to 6-membered ring together with the nitrogen atom.

$R_8$ is a halogen atom, an alkoxy group or an alkyl group wherein preferred alkoxy and alkyl groups are those having 1 to 5 carbon atoms. Particularly preferred are halogen atoms, inter alia, chlorine atom.

$R_7$ is a substituent on a benzene ring and n is an integer of 1 or 2. If n is 2, two $R_7$ may be the same or different. Examples of $R_7$ are halogen atoms, R'—, R'O—, R'—CO—NR''—, R'—$SO_2$—NR''—, R''—O—CO—NR''—, R'—COO—, R'—NR''—CO—, R'—NR''—$SO_2$—, R'—OCO—, R'—NR''—CONR'''— and a group represented by the formula (a):

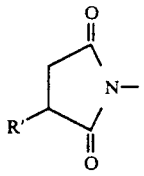

(a)

wherein R', R'', and R''' may be the same or different and each represents a hydrogen atom or an optionally substituted alky, alkenyl or aryl group. Preferred examples thereof are R'—CONH—, R'—$SO_2$NH— and group (a).

Specific examples of the magenta couplers represented by the formula (III) are M-1 to M-37 disclosed in J.P. KOKAI No. 60-262161 and M-1 to M-34 disclosed in J.P. KOKAI No. 60-238832 which may be used alone or in combination. Preferred are those listed below and those used in Examples given below.

m-1

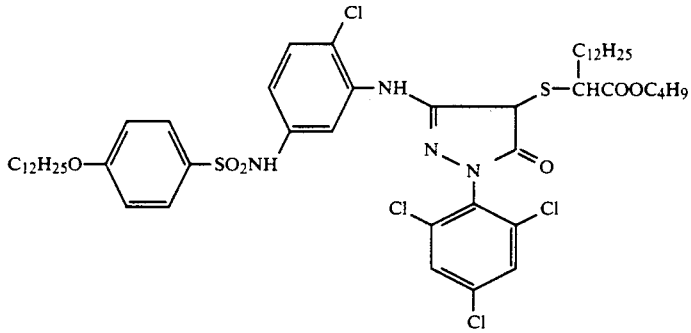

m-2

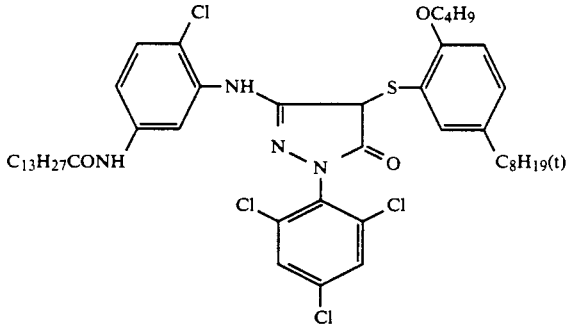

m-3

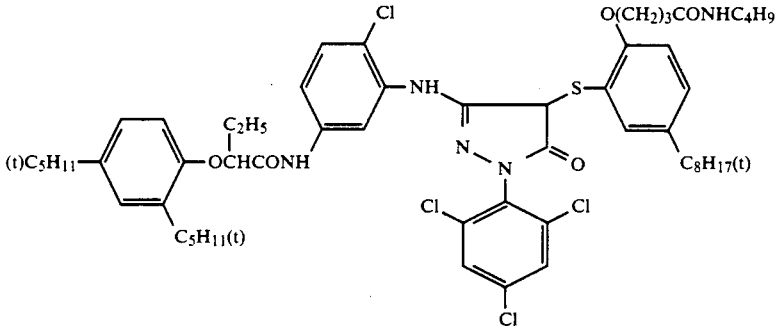

-continued
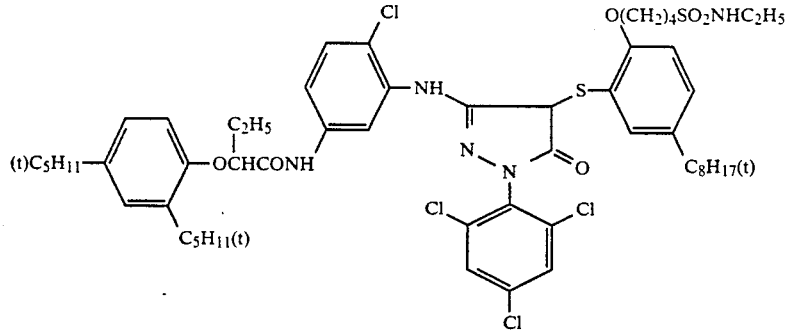
m-4
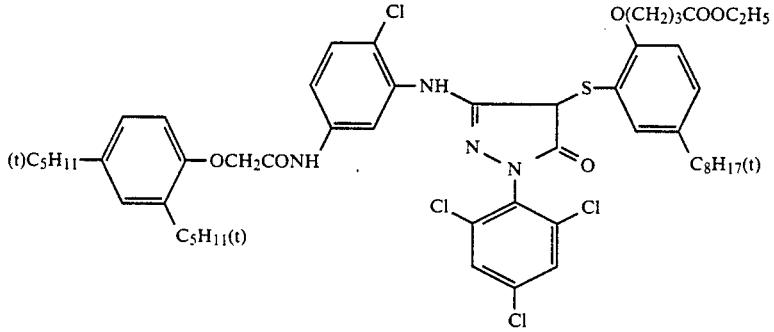
m-5
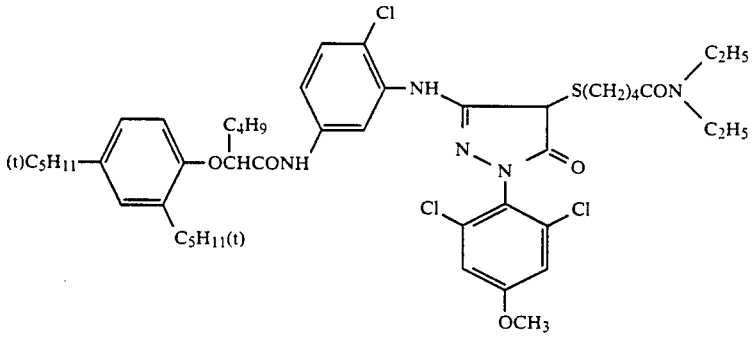
m-6
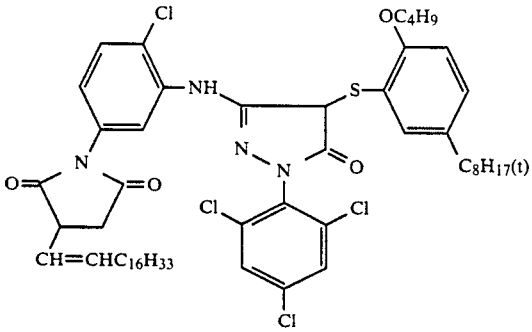
m-7
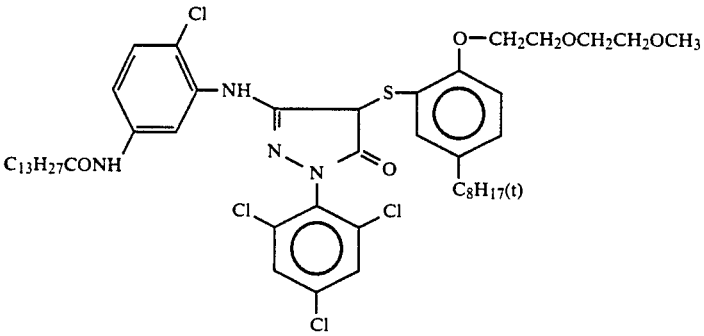
m-8

-continued m-9

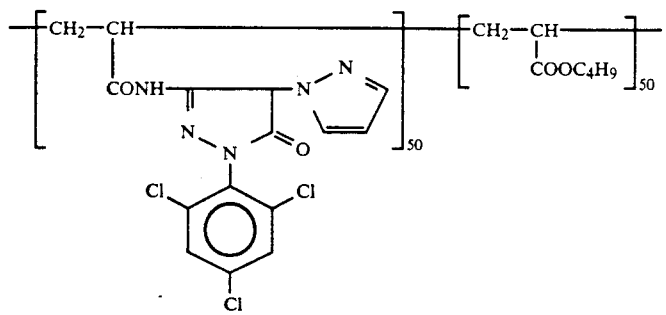

m-10

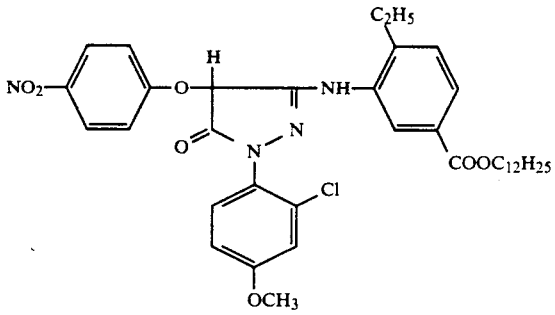

m-11

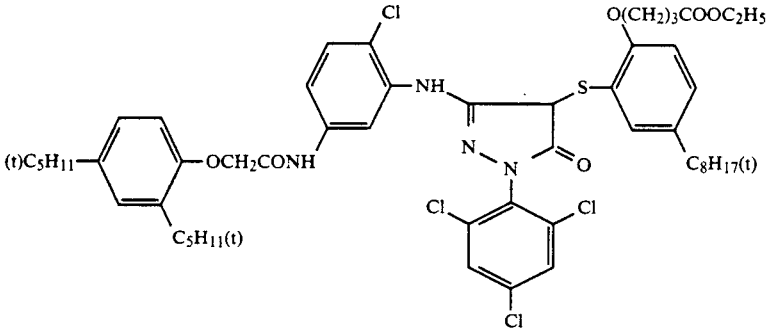

m-12

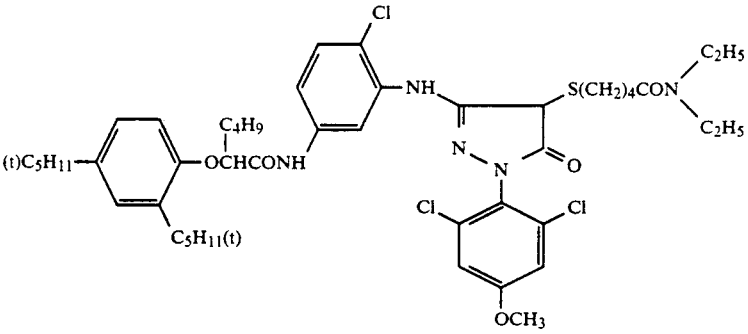

Examples of the magenta couplers represented by the formula (IV) are those disclosed in J. P. KOKAI No. 62-30250 and these may be used in the invention.

In the formula (IV), the term "polymer" means those having at least two repeating units derived from compounds (IV) per molecule and includes bis-forms and polymeric couplers. The polymeric couplers may be a homopolymer composed of only repeating units derived from monomers (VI) (preferably those containing vinyl groups, hereunder referred to as "vinyl monomer(s)) or a copolymer with non-dye forming ethylenic monomers which never cause coupling reaction with the oxidized form of the aromatic primary amine developing agent.

The compounds represented by the formula (IV) are condensed 5-memebered ring/5-memebered ring nitrogen atom-containing heterocyclic couplers and the coloring nucleus thereof exhibits an aromaticity electrically equivalent to that of naphthalene. The compounds have a structure known generically as azapentalene. Preferred examples thereof are 1H-imidazo(1,2-b)pyrazoles, 1H-pyrazolo(1,5-b)pyrazoles, 1H-pyrazola(5,1-c)(1,2,4)triazoles, 1H-pyrazolo(1,5-b)(1,2,4,)triazoles, 1H-pyrazolo(1,5-d)tetrazoles and 1H-pyrazolo(1,5-a) benzimidazoles which are respectively represented by the following general formulas (Ia) to (If). Preferred examples are those represented by the formulas (Ia), (Ic) and (Id), particularly (Id).

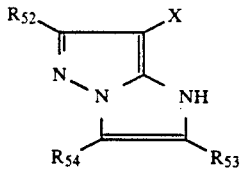
(Ia)

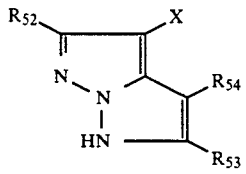
(Ib)

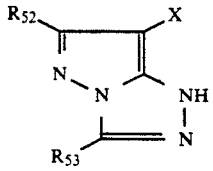
(Ic)

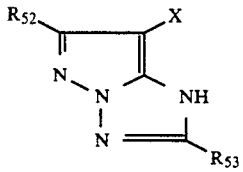
(Id)

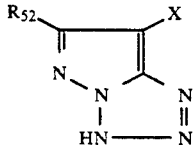
(Ie)

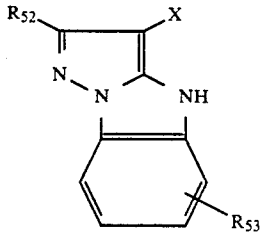
(If)

In the formulas (Ia) to (If), $R_{52}$ to $R_{54}$ each independently repreents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, an ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X is a halogen atom, a carboxyl group or a group wich is bonded to the carbon atom at the coupling position through an oxygen, nitrogen or sulfur atom and can be eliminated through the coupling reaction.

$R_{52}$ to $R_{54}$ or X may be a bivalent group to form a bisform of a coupler. Moreover, if the parts represented by the formulas (Ia) to (If) are moieties of vinyl monomers, one of $R_{52}$ to $R_{54}$ is a single bond or a linking group through which the vinyl group and the moieties (Ia) to (If) are bonded together. $R_{52}$ to $R_{54}$ are detailed in J.P. KOKAI No. 62-30250.

X is a halogen atom, a carboxyl group, a group linked through an oxygen atom such as an acetoxy group, a group linked through a nitrogen atom such as benzenesulfonamido and N-ethyl-toluenesulfonamido groups, or a group linked through a sulfur atom such as phenylthio, 2-carboxyphenyl-thio and 2-butoxy-5-tert-octylphenylthio groups.

If $R_{52}$ to $R_{54}$ or X is a bivalent group to form a bisform of a coupler, examples of such bivalent groups are substituted or unsubstituted alkylene groups such as methylene, ehtylene, 1,10-decylene and $—CH_2CH_2—O—CH_2CH_2—$ groups; substituted or unsubstituted phenylene groups such as 1,4-phenylene, 1,3-phenylene,

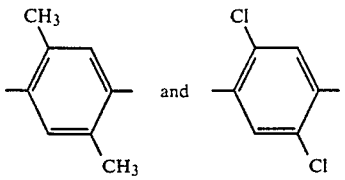

and —NHCO—$R_{55}$—CONH— (wherein $R_{55}$ represents a substituted or unsubstituted alkylene or phenylene group).

If the moieties represented by the formulas (Ia) to (If) are included in the vinyl monomers, examples of the linking groups represented by one of $R_{52}$ to $R_{54}$ are selected from the group consisting of: substituted or unsubstituted alkylene groups such as methylene, ethylene, 1,10-decylene and $—CH_2CH_2—O—CH_2CH_2—$ group; substituted or unsubstituted phenylene groups such as 1,4-pehnylene, 1,3-phenylene,

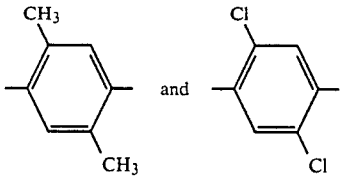

—NHCO—, —CONH—, —O—, —OCO— and aralkylene groups such as

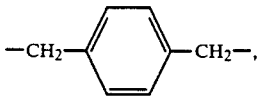

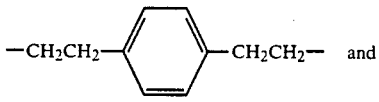

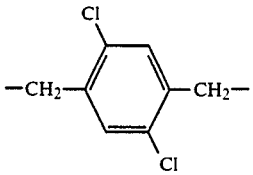

The vinyl monomers may have substituents other than those represented by the formulas (Ia) to (If). Preferred examples of such substituents include a hydrogen atom, a chlorine atom or a lower alkyl group having 1 to 4 carbon atoms.

Examples of the monomers which do not cause coupling reaction with the oxidized form of an aromatic primary amine developing agent are acrylic acid, alpha-chloroacrylic acid, alpha-alacrylic acids such as methacrylic acid, or esters or amides derived from these acrylic acids such as acrylamide, diacetone acrylamide, methacrylamide, methyl acrylate, tertbutyl acrylate, lauryl acrylate, ethyl methacrylate, n-butyl methacrylate and beta-hydroxymethacrylate, methylene dibisacrylamide, vinyl esters such as vinyl acetate, vinyl propionate and vinyl laurate, acrylonitrile, methacrylonitrile, aromatic vinyl compounds such as styrene and derivatives thereof, vinyltoluene, divinylbenzene, vinylacetophenone and sulfostyrene, itaconic acid, citraconic acid, crotonic acid, vinylidene chloride, vinyl alkyl ethers such as vinyl ethyl ether, maleic acid, maleic anhydride, maleates, N-vinyl-2-pyrrolidone, N-vinylpyridine and 2- and 4-vinylpyridine, which may be used alone or in combination.

Examples of the couplers represented by the formulas (Ia) to (If) and methods for preparing these are disclosed in the following articles:

Compounds (Ia) are disclosed in, for instance, J.P. KOKAI No. 59-162548; compounds (Ib) in J.P. KOKAI No. 60-43659; compounds (Ic) in J.P. KOKOKU No. 47-27411; compounds (Id) in J.P. KOKAI Nos. 59-171956 and 60-172982; compounds (Ie) in J.P. KOKAI No. 60-33552; and compounds (If) in U.S. Pat. No. 3,061,432.

The ballast groups exhibiting high coloring properties disclosed in J.P. KOKAI Nos. 58-42045, 59-214854, 59-177553, 59-177544 and 59-177557 may be applied to any compounds (Ia) to (If).

Specific examples of these compounds represented by the foregoing general formula (IV) are M-1 to M-67 or a mixture thereof disclosed in J.P. KOKAI No. 62-30250, but, particularly preferred are those listed below and those employed in Examples.

M-1

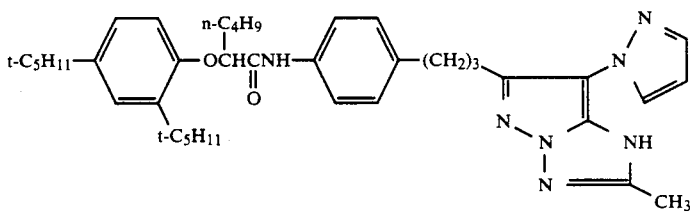

M-2

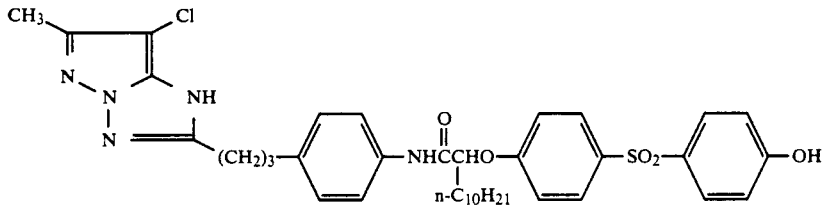

M-3

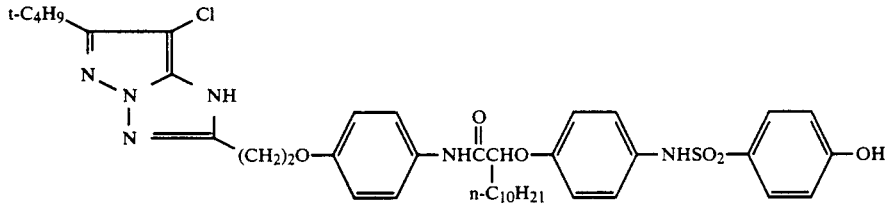

M-4

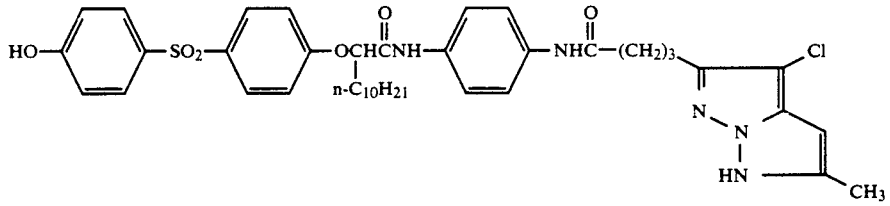

M-5

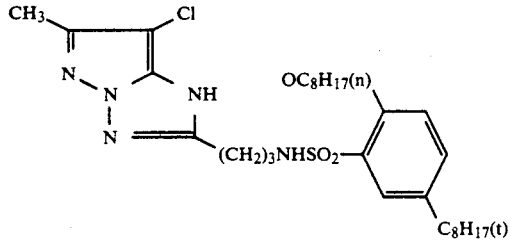

-continued
M-6
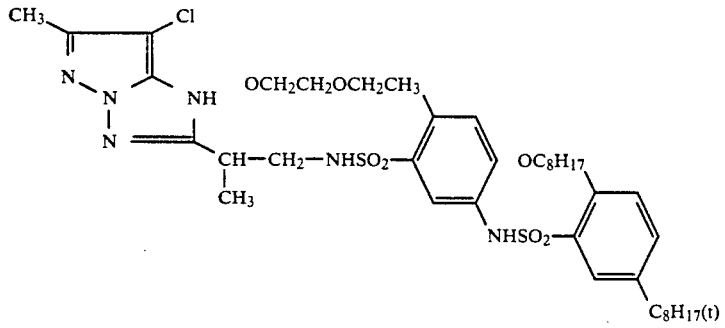
M-7
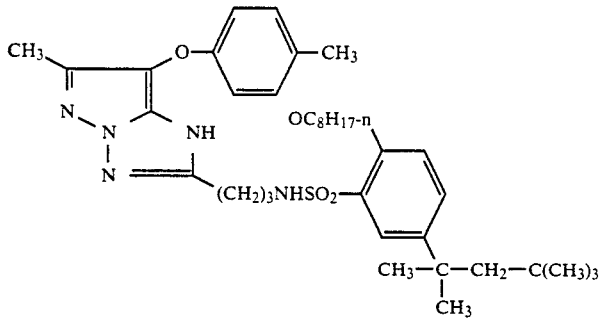
M-8
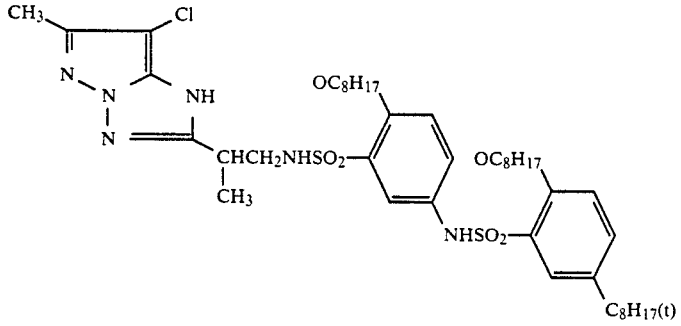
M-9
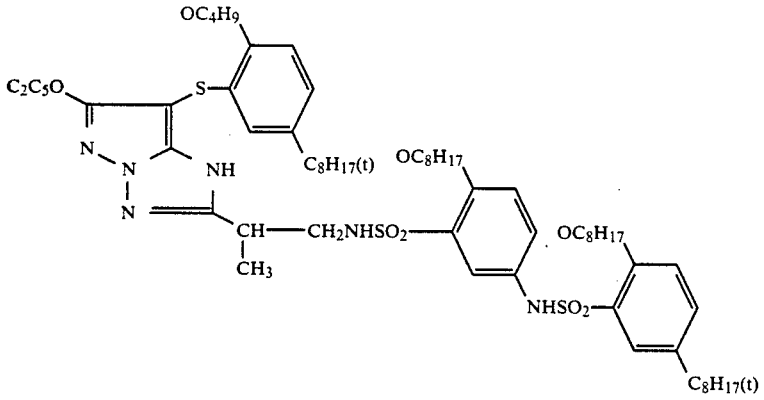

-continued
M-10
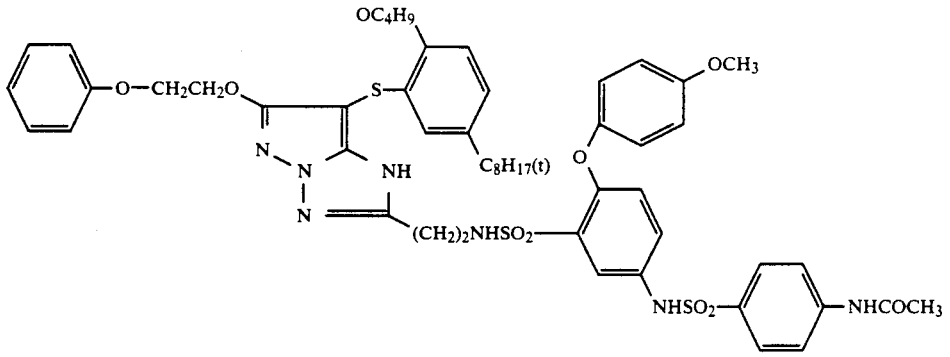
M-11
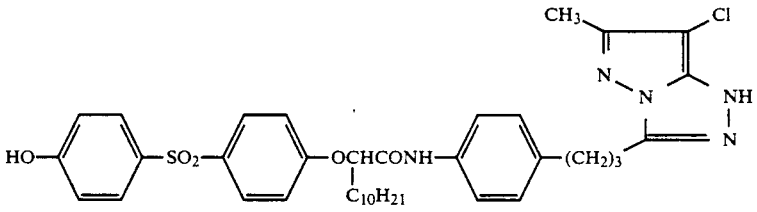
M-12
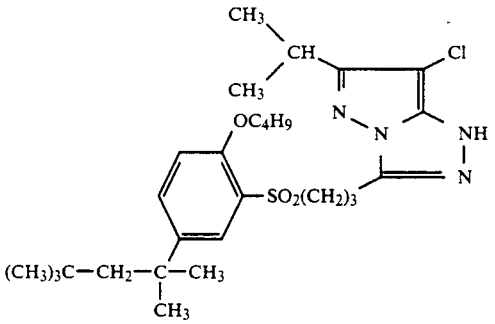
M-13
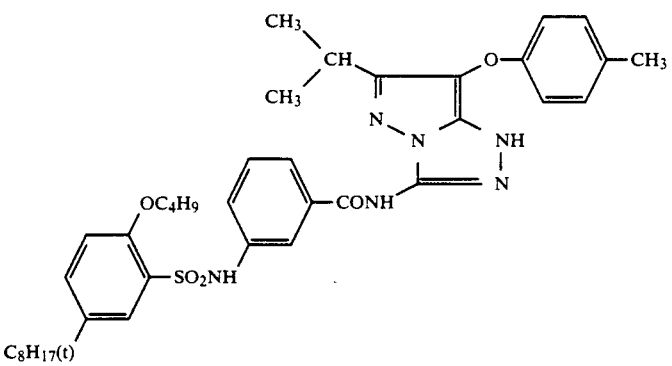
M-14
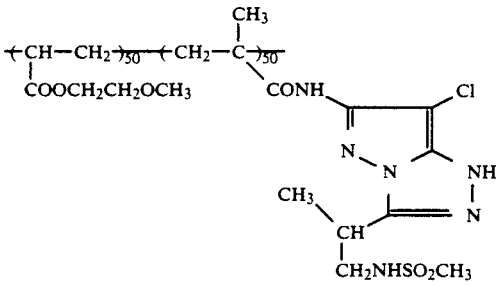

-continued
M-15
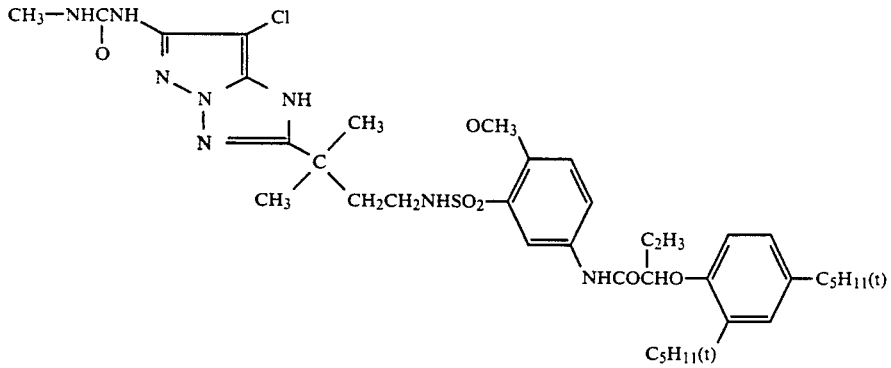
M-16
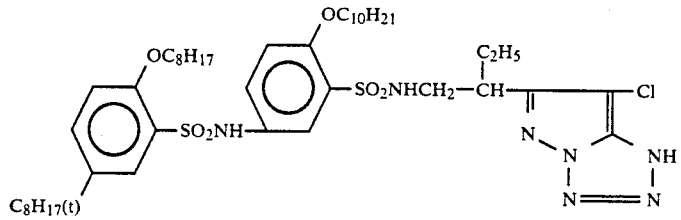
M-17
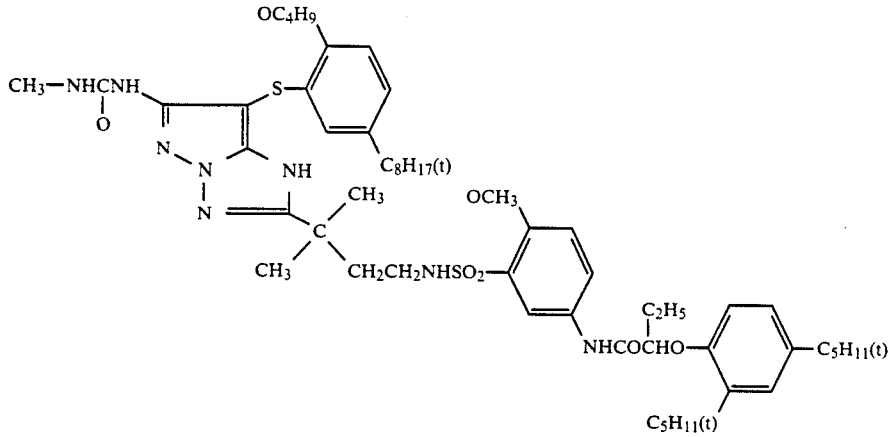
M-18
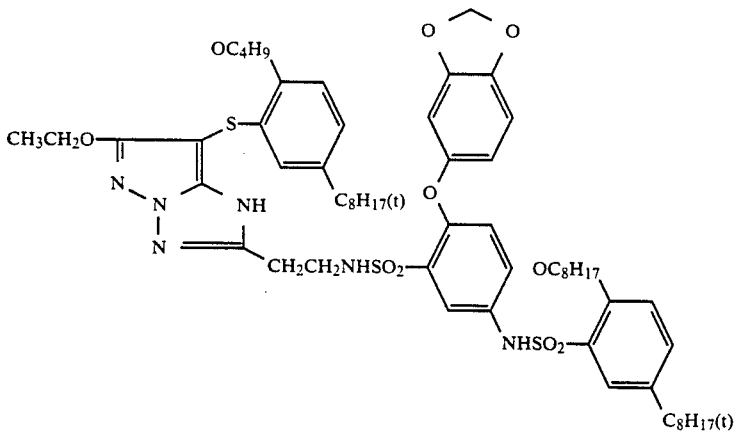
M-19
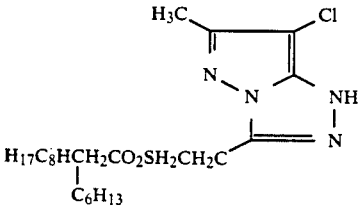

The compounds represented by the formula (V) are disclosed in J.P. KOKAI No. 63-11939 (EP 231832A). In this formula, substituents of the phenyl group of the N-phenylcarbamoyl group, Q, may freely be selected from the groups which is acceptable when the aforementioned $R_1$ is an aromatic group and the phenyl group has at least two substituents which may be the same or different.

Preferred substituent Q are those represented by the following formula (V-A):

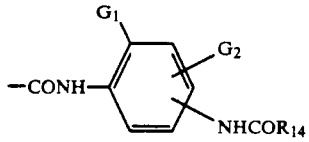

(V-A)

wherein $G_1$ is a halogen atom or an alkoxy group; $G_2$ is a hydrogen atom, a halogen atom or an optionally substituted alkoxy group; and $R_{14}$ is an optionally substituted alkyl group.

Typical examples of substituents for $G_2$ and $R_{14}$ in the formula (V-A) are alkyl groups, alkoxy groups, aryl groups, aryloxy groups, amino groups, dialkylamino groups, heterocyclic groups such as N-morpholino, N-piperidino and 2-furyl groups, halogen atoms, nitro group, hydroxyl group, carboxyl group, sulfo groups and alkoxycarbonyl groups.

Preferred elimination groups $Y_5$ are those represented by the following general formulas (X) to (XVI):

$$-OR_{20} \qquad (X)$$

wherein $R_{20}$ is an optionally substituted aryl or heterocyclic group;

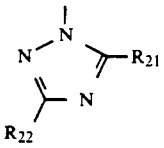

(XI)

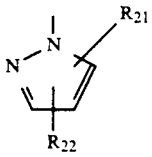

(XII)

wherein $R_{21}$ and $R_{22}$ may be the same or different and each represents a hydrogen atom, a halogen atom, a carboxylate group, an amino groups, an alkyl group, an alkylthio group, an alkoxy group, an alkylsulfonyl group, an alkylsulfinyl group, a carboxyl group, a sulfonic acid group, or a substituted or unsubstituted phenyl or heterocyclic group;

(XIII)

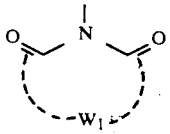

wherein $W_1$ is a non-metallic atom or atoms required to form 4- to 6-membered ring together with

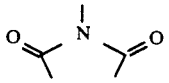

Among groups (XIII), preferred are those represented by the following formulas (XIV) to (XVI):

(XIV)

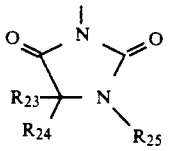

(XV)

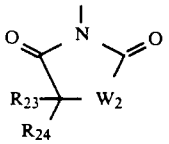

(XVI)

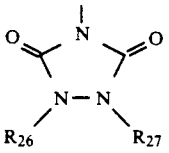

wherein $R_{23}$ and $R_{24}$ each independently represents a hydrogen atom, an alkyl group, an aryl group, an alkoxy group, an aryloxy group or a hydroxyl group; $R_{25}$ to $R_{27}$ each represents a hydrogen atom, an alkyl group, an aryl group, an aralkyl group or an acyl group; and $W_2$ is an oxygen or sulfur atom.

Yellow couplers represented by the formula (V) may be prepared by the methods disclosed in J.P. KOKAI No. 54-48541, J.P. KOKOKU No. 48-10739, U.S. Pat. No. 4,326,024 and Research Disclosure No. 18053.

Preferred specific examples of couplers (V) are as follows:

Y-1

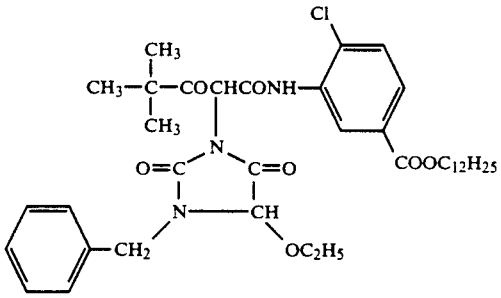

-continued
Y-2
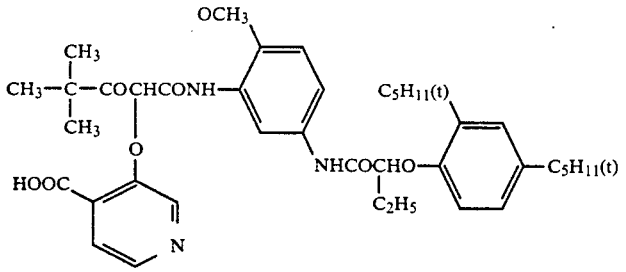
Y-3
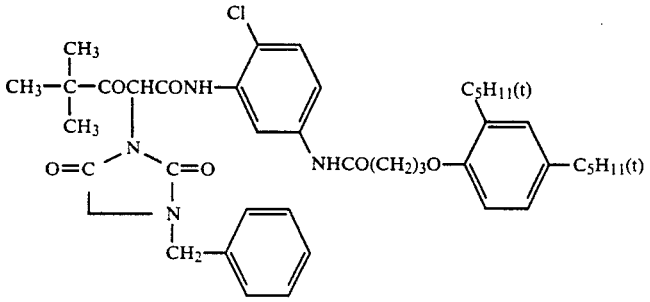
Y-4
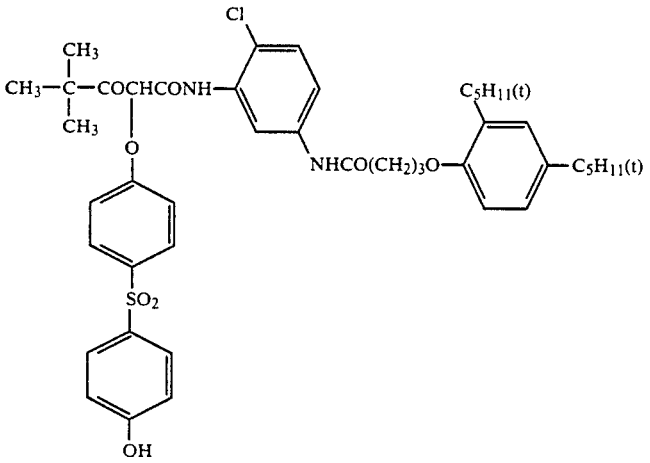
Y-5
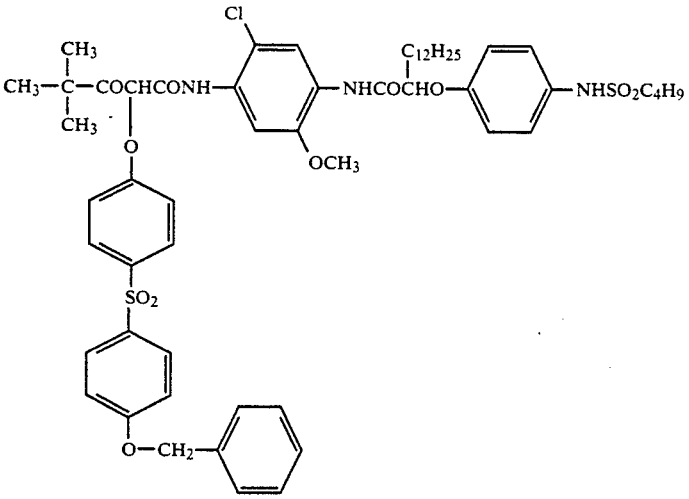

-continued
Y-6
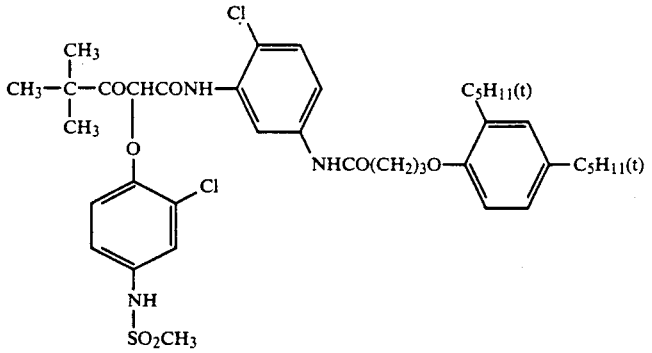
Y-7
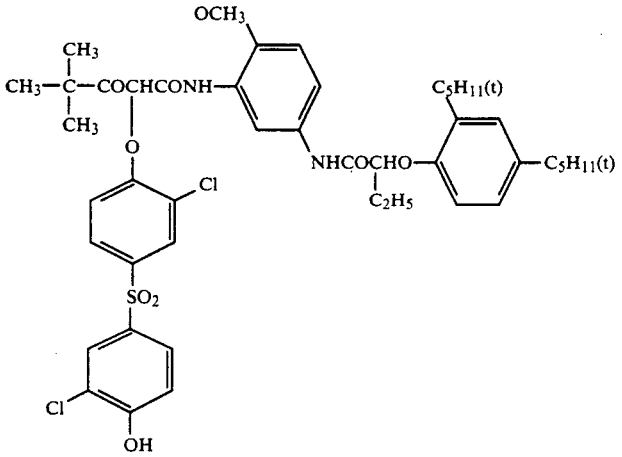
Y-8
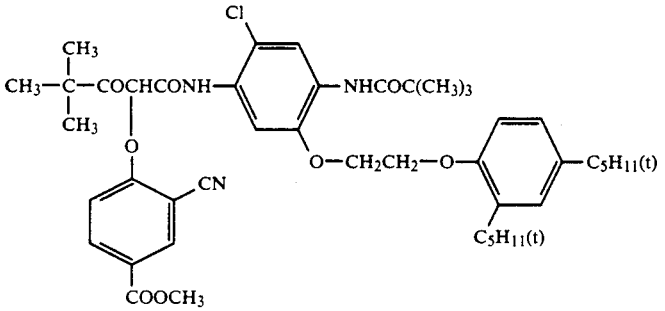
Y-9
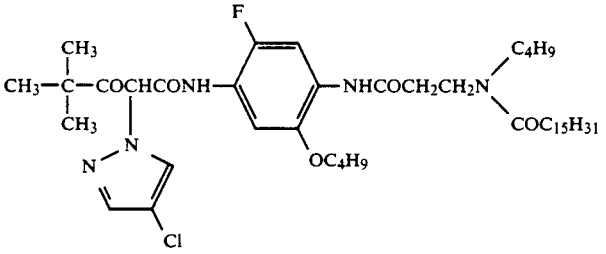
Y-10
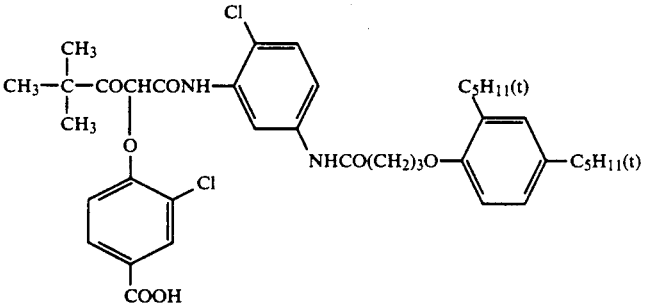

-continued
Y-11
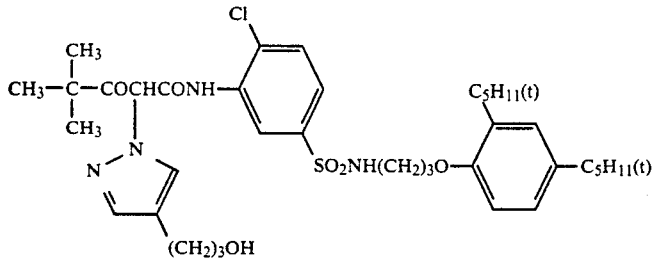
Y-12
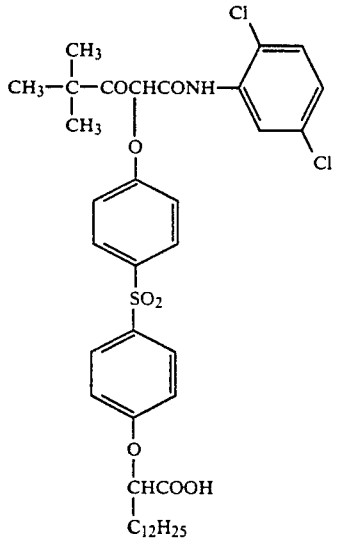
Y-13
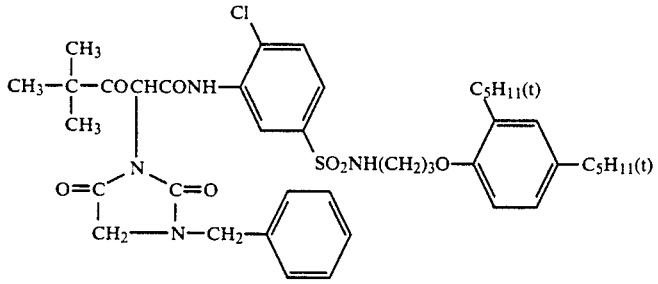
Y-14
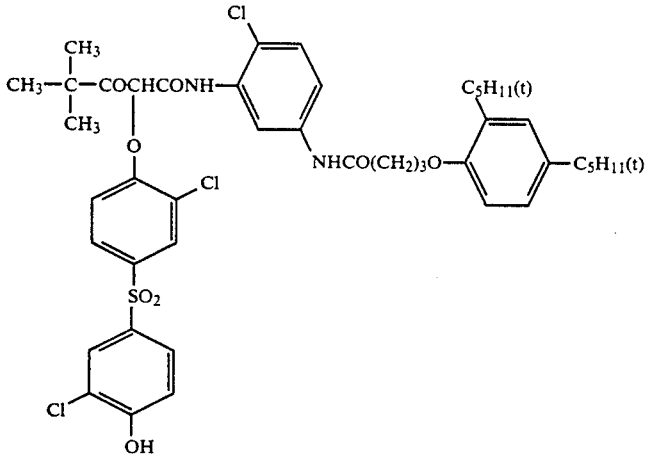

-continued
Y-15
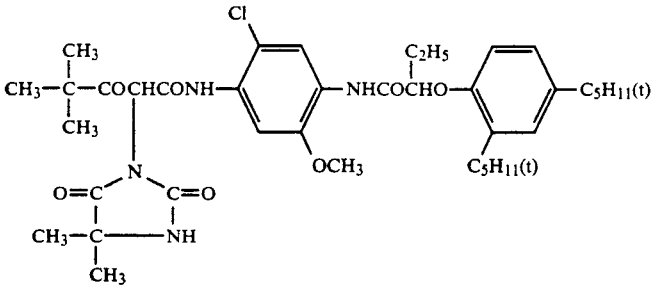
Y-16
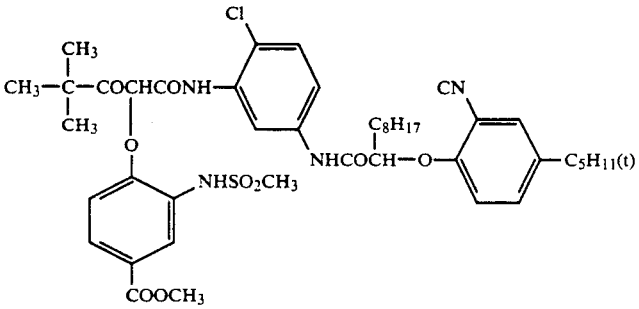
Y-17
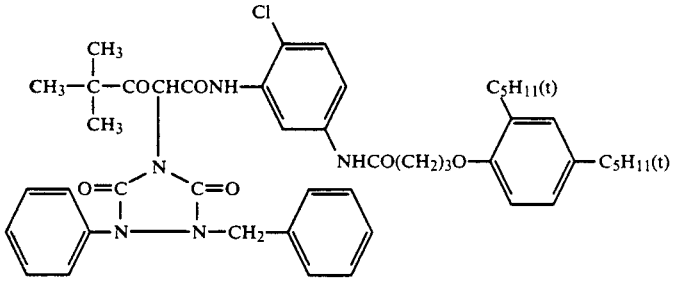
Y-18
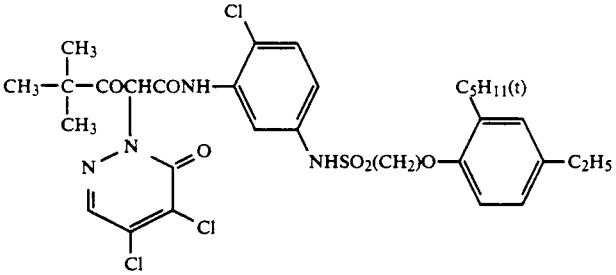
Y-19
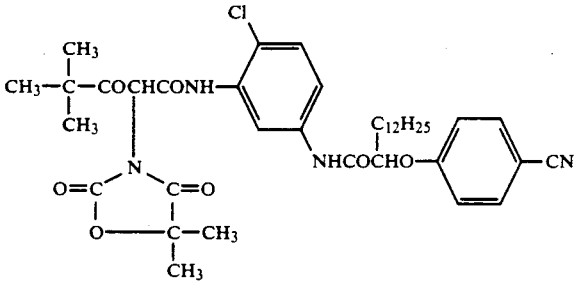

-continued
Y-20
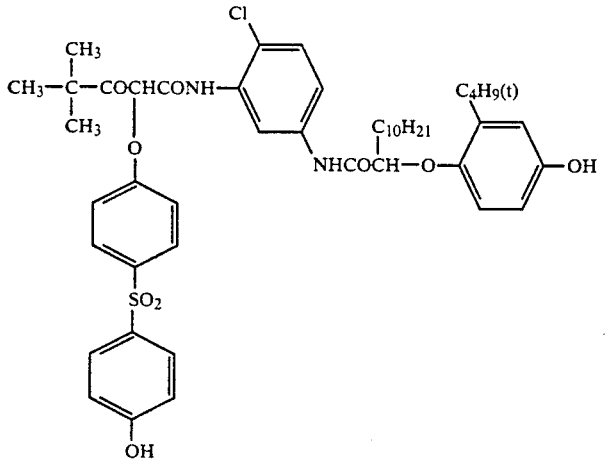
Y-21
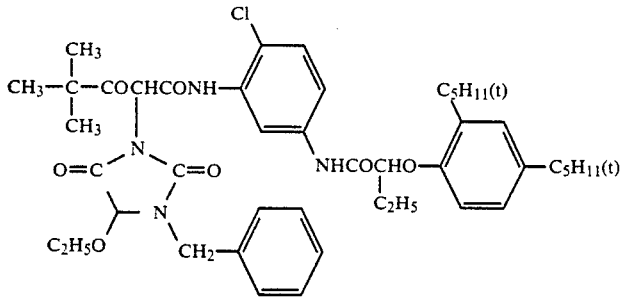
Y-22
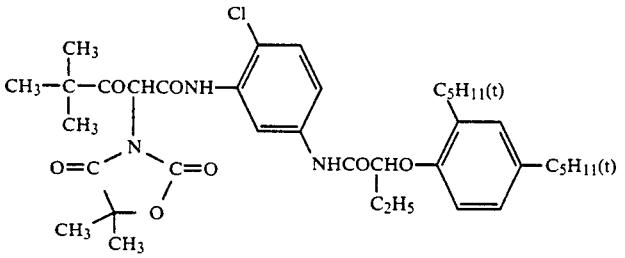
Y-23
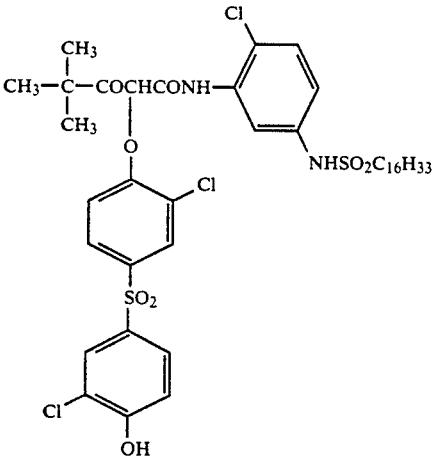

-continued

Y-24

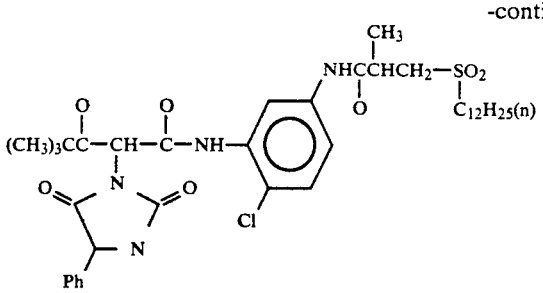

Y-25

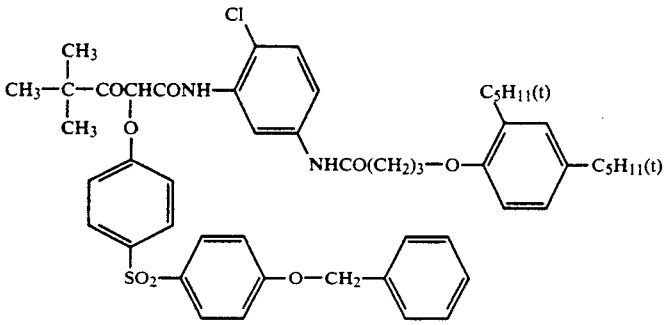

Y-26

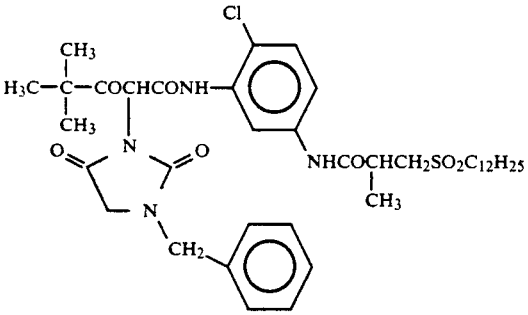

In the invention, other 4-equivalent couplers may optionally be used simultaneously. In addition, graininess may be improved by using a coupler capable of forming a dye having a moderate diffusibility. As such dye-forming couplers, some magenta couplers are specifically disclosed in U.S. Pat. No. 4,366,237 and U.K. Patent No. 2,125,570 and some yellow, magenta and cyan couplers are specifically described in European Patent No. 96,570 and DEOS No. 3,234,533.

Dye-forming couplers and the aforementioned special couplers may be a dimer or a higher polymer. Typical examples of such polymerized dye-forming couplers are described in U.S. Pat. Nos. 3,451,820 and 4,080,211. Examples of such polymerized magenta couplers are described in U.K. Patent No. 15 2,102,173 and U.S. Pat. No. 4,367,282.

In the present invention, at least two such couplers may be added to a single layer or one such coupler may be added to two or more different layers to impart desired properties to the light-sensitive materials.

The standard amount of the color couplers is 0.001 to 1 mole per mole of light-sensitive silver halide and preferably 0.01 to 0.5 moles for yellow couplers; 0.003 to 0.3 moles for magenta couplers; and 0.002 to 0.3 moles for cyan couplers.

The couplers used in the invention can be introduced, into the light-sensitive materials by various known methods for dispersion. Examples of high boiling organic solvents used in the oil-in-water dispersion method are disclosed in U.S. Pat. No. 2,322,027. Specific examples of processes, effects and latexes for impregnation for latex dispersion method are, for instance, disclosed in U.S. Pat. No. 4,199,363 and OLS Nos. 2,541,274 and 2,541,230.

The silver halide emulsion used for preparing light-sensitive materials to be processed by the invention may have any silver halide composition such as those containing silver iodobromide silver bromide, silver chlorobromide and silver chloride. For instance, when rapid processing or replenisher-saved processing light-sensitive materials such as color paper, it is preferable to use silver chlorobromide emulsion having a silver chloride content of preferably not less than 60 mole % (inclusive of silver bromide), more preferably 80 to 100 mole %. Alternatively, if high sensitivity is required and the fog must be limited to a low level during preparation, storage and/or processing, it is preferred to use silver chlorobromide emulsions having the silver bromide content of not less than 50 mole % or pure silver bromide emulsions which may contain not more than 3 mole % of silver iodide and more preferably those containing not less than 70 mole % of silver bromide. The light-sensitive materials for taking photographs are preferably prepared from silver iodobromide or silver chloroiodobromide emulsions in which the content of silver iodide is preferably 3 to 15 mole %.

The gains of silver halide used in the invention may have different phases in the inner part and the outer part; multiphase structure such as those having contact structures; a uniform phase or a combination thereof.

The size distribution of silver halide grains may be wide or narrow, but it is preferred to use, in the invention, so-called monodisperse silver halide emulsions in which the value (the rate of variation) of the standard deviation in the size distribution curve of the silver halide emulsion divided by the average grain size is not more than 20% and preferably not more than 15%. Moreover, to impart the desired gradation to the light-sensitive materials, it is possible, in the emulsion layers having substantially the same color-sensitivity, to use a mixture of at least two monodisperse silver halide emulsions (preferably those having the foregoing rate of variation) having different grain sizes in a single layer or these monodisperse emulsions may be coated in a multilayered structure as different layers. Alternatively, at least two polydisperse silver halide emulsions or a combination of monodisperse and polydisperse silver halide emulsions may be used as a mixed layer or multilayered structure.

The silver halide grains used in the invention may be in the regular crystal forms such as cubic, octahedral, rhombo decahedral and tetradecahedral forms; or in the irregular crystal forms such as spheric form; or further in the composite forms thereof. They may be tabular grains and in particular an emulsion in which at least 50% of the whole projected areas of the grains included are occupied by tabular grains having a diameter/thickness ratio of 5 to 8 or not less than 8 can be used. The emulsions may be composed of a combination of grains having different crystal forms.

These various emulsions may be those containing grains in which the latent images are principally formed on the surface thereof or grains in which the latent images are mainly formed interior thereof.

The photographic emulsions used in the invention may be prepared by the methods disclosed in Research Disclosure, Vol. 176, No. 17643 (Items I, II and III) (December, 1978).

The emulsions used in the invention are generally physically or chemically ripened and spectrally sensitized before use. The additives used in such processes are disclosed in Research Disclosure, Vol. 176, No. 17643 (December, 1978) and ibid, Vol. 187, No. 18716 (November, 1979) and the relevant passages are listed in the following Table.

Known additives for photographic paper used in the invention are also disclosed in aforesaid two articles (Research Disclosure) and the relevant passages are also listed in the following Table.

| Kind of Additive | RD17643 | RD18716 |
|---|---|---|
| 1. chemical sensitizer | p 23 | p 648, right column |
| 2. sensitivity enhancing agent | | p 648, right column |
| 3. spectral sensitizing agent | p 23–24 | p 648, right column |
| 4. supersensitizing agent | p 649, right | column |
| 5. whitener | p 24 | |
| 6. antifoggant and stabilizer | p 24–25 | p 649, right column |
| 7. coupler | p 25 | |
| 8. organic solvent | " | |
| 9. light absorber and filter dye | p 25–26 | p 649, right column to p 650, left column |
| 10. ultraviolet absorber | " | p649, right column to p 650, left column |
| 11. stain resistant agent | p 25, right column | p 650, left to right column |
| 12. dye image stabilizer | p 25 | |
| 13. hardening agent | p 26 | p 651, left column |
| 14. binder | " | p 651, left column |
| 15. plasticizer and lubricant | p 27 | p 650, right column |
| 16. coating aid and surfactant | p 26–27 | p 650, right column |
| 17. antistatic agent | p 27 | p 650, right column |

The light-sensitive materials used in the invention are applied to the surface of a substrate commonly used such a flexible substrate as a plastic film (e.g., cellulose nitrate, cellulose acetate and polyethylene terephthalate) and paper or such a rigid substrate as a glass plate. Substrates and coating methods are detailed in Research Disclosure, Vol. 176, No. 17643, Items XV (p 27) and XVII (p 28) (December, 1978). In the invention, reflecting substrates are preferably used. The "reflecting substrate" herein means a substrate having improved reflective power and makes the dye images formed on silver halide emulsion layer clearer. Examples of such substrates include those covered with a hydrophobic resin film including a reflective material dispersed therein, such as titanium oxide, zinc oxide, calcium carbonate and calcium sulfate and those composed of such a hydrophobic resin including a dispersed reflective material.

As discussed above in detail, the method of the present invention for processing light-sensitive materials makes it possible to effectively prevent the formation of stains during processing or storage with time and to enhance the stability of processing solutions by using specific sulfinic acids and salts or precursors thereof. The method of this invention is effective to suppress the occurrence of yellow stains due to not only the components of the light-sensitive material per se but also the components of the processing solutions.

The present invention will hereunder be explained in more detail with reference to the following non-limitative working Examples and the effects practically achieved will also be discussed comparing with those of Comparative Examples.

EXAMPLE 1

A multilayered photographic paper having the following layer structure was produced by applying coating solutions to the surface of a paper substrate of which both sides had been laminated with polyethylene films. The coating solutions were prepared as follows:

Preparation of the Coating Solution for 1st Layer

To yellow couplers ExY-1 na ExY-2 (10.2 g and 9.1 g respectively) and 4.4 g of a dye image stabilizer (Cpd-1) there were added 27.2 cc of ethyl acetate and 7.7 cc (8.0 g) of a high boiling point solvent (Solv-1) to dissolve them and the resulting solution was dispersed in 185 cc of 10% aqueous gelatin solution containing 8 cc of 10% sodium dodecylbenzene sulfonate to form an emulsion. This emulsion was mixed with and dispersed in emulsions EM 1 and EM 2 and the concnetration of gelatin was adjusted to be consistent with the following composition to obtain the coating solution for 1st layer. The coating solutions for 2nd to 7th layers were also prepared in the same manner. To each layer, sodium salt of 1-oxy-3,5-dichloro-s-triazine was added as a gelatin hardening agent. Moreover, Cpd-2 was used as a thickeners.

Layer Structure

The composition of each layer is given below Numerical values represent coated amounts expressed in g/m$^2$. The amount of silver halide emulsion is expressed in the amount of elemental silver.

Substrate

Paper laminated with polyethylene films (the polyethylene film on the side of the 1st layer includes a white pigent ($TiO_2$) and a blueing dye).

| | |
|---|---|
| 1st Layer: Blue-sensitive Emulsion Layer | |
| Monodisperse silver chlorobromide emulsion spectrally sensitized with sensitizing dye ExS-1 (EM-1) | 0.13 |
| Monodisperse silver chlorobromide emulsion spectrally sensitized with sensitizing dye ExS-1 (EM-2) | 0.13 |
| Gelatin | 1.86 |
| Yellow coupler ExY-1 | 0.44 |
| Yellow coupler ExY-2 | 0.39 |
| Color image stabilizer Cpd-1 | 0.19 |
| Solvent Solv-1 | 0.35 |
| 2nd Layer: Color Mixing Inhibiting Layer | |
| Gelatin | 0.99 |
| Color mixing inhibitor Cpd-3 | 0.08 |
| 3rd Layer: Green-sensitive Emulsion Layer | |
| Monodisperse silver chlorobromide emulsion spectrally sensitized with sensitizing dye ExS-2,3 (EM-3) | 0.05 |
| Monodisperse silver chlorobromide emulsion spectrally sensitized with sensitizing dye ExS-2,3 (EM-4) | 0.11 |
| Gelatin | 1 80 |
| Magenta coupler ExM-1 | 0.39 |
| Color image stabilizer Cpd-4 | 0.20 |
| Color image stabilizer Cpd-5 | 0.02 |
| Color image stabilizer Cpd-6 | 0.03 |
| Solvent Solv-2 | 0.12 |
| Solvent Solv-3 | 0.25 |
| 4th Layer: Ultraviolet absorbing Layer | |
| Gelatin | 1.60 |

-continued

| | |
|---|---|
| Ultraviolet absorber (Cpd-7/Cpd-8/Cpd-9 = 3/2/6; weight ratio) | 0.70 |
| Color mixing inhibitor Cpd-10 | 0.05 |
| Solvent Solv-4 | 0.27 |
| 5th Layer: Red-sensitive Emulsion Layer | |
| Monodisperse silver chlorobromide emulsion spectrally sensitized with sensitizing dye ExS-4,5 (EM-5) | 0.07 |
| Monodisperse silver chlorobromide emulsion spectrally sensitized with sensitizing dye ExS-4,5 (EM-6) | 0.16 |
| Gelatin | 0.92 |
| Cyan coupler ExC-1 | 0.32 |
| Color image stabilizer (Cpd-8/Cpd-9/Cpd-12 = 3/4/2; weight ratio) | 0.17 |
| Polymer for dispersion Cpd-11 | 0.28 |
| Solvent Solv-2 | 0.20 |
| 6th Layer: Ultraviolet absorbing Layer | |
| Gelatin | 0.54 |
| Ultraviolet absorber (Cpd-7/Cpd-9/Cpd-12 = 1/5/3; weight ratio) | 0.21 |
| Solvent Solv-2 | 0.08 |
| 7th Layer: Protective Layer | |
| Gelatin | 1.33 |
| Acryl modified copolymer of polyvinyl alcohol (degree of modification = 17%) | 0.17 |
| Liquid paraffin | 0.03 |

In this case, Cpd-13 and Cpd-14 were used as irradiation inhibiting dyes.

In addition to the foregoing components, each layer contained Alkanol XC (available from Dupont Co., Ltd.), sodium alkylbenzenesulfonate, succinate and Magafacx F-120 (available from DAINIPPON INK AND CHEMICALS, INC.) as an emulsifying and dispersing agent and a coating aid. Moreover, Cpd-15 and Cpd-16 were used as stabilizers for silver halide.

The details of the emulsions used are as follows:

| Emulsion | Grain Size (micron) | Br Content (mole %) | Coefficient of Variation |
|---|---|---|---|
| EM-1 | 1.0 | 80 | 0.08 |
| EM-2 | 0.75 | 80 | 0.07 |
| EM-3 | 0.5 | 83 | 0.09 |
| EM-4 | 0 4 | 83 | 0 10 |
| EM-5 | 0.5 | 73 | 0.09 |
| EM-6 | 0.4 | 73 | 0.10 |

The structural formulas of the compounds used in this Example are as follows:

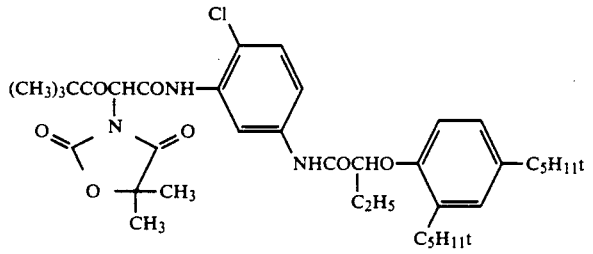

ExY-1

-continued
ExY-2 (Y-21)
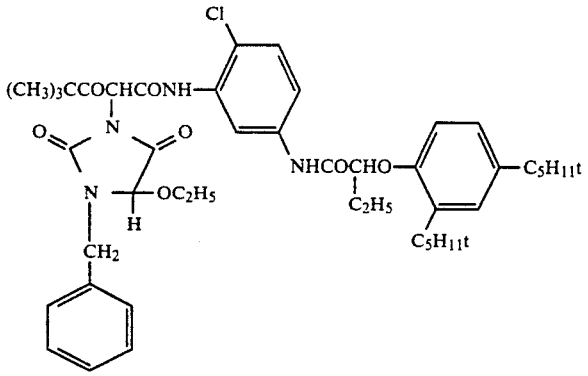
ExM-1 (M-6)
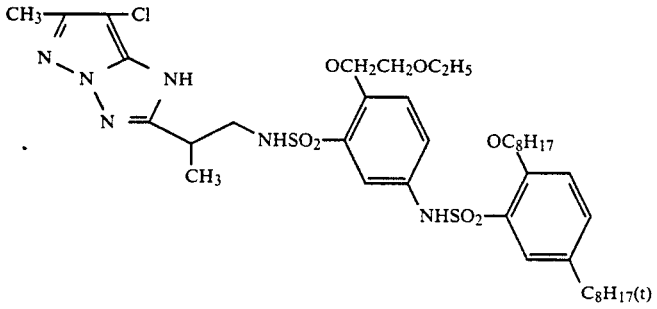
ExC-1 (C-10)
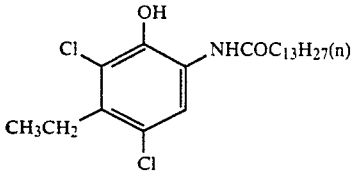
ExS-1
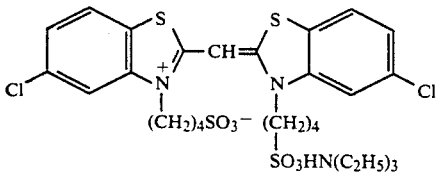
ExS-2
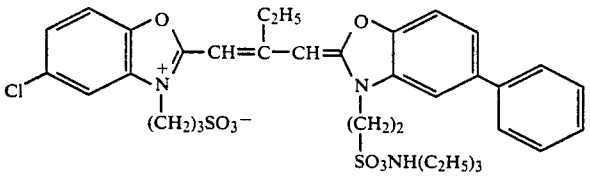
ExS-3
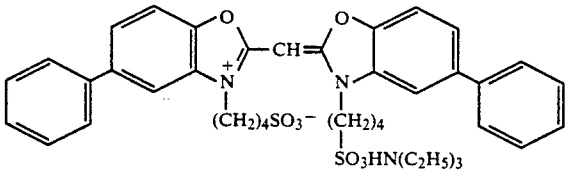
ExS-4
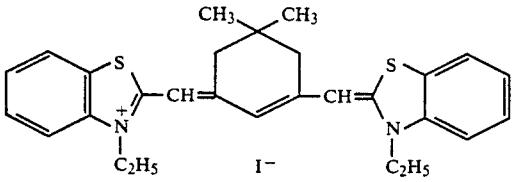

-continued
ExS-5
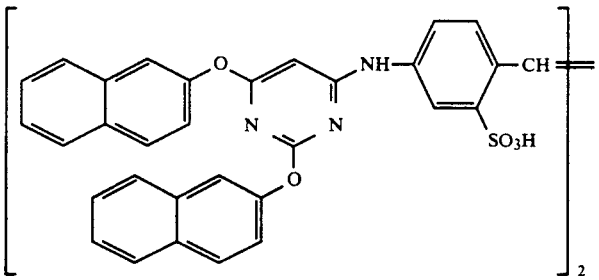
Cpd-1
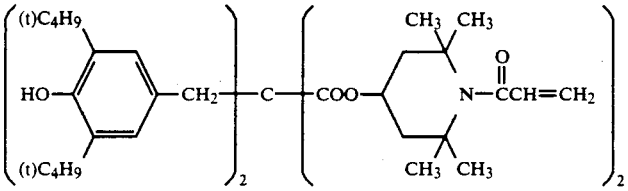
Cpd-2
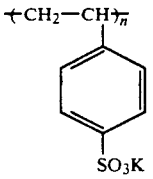
Cpd-3
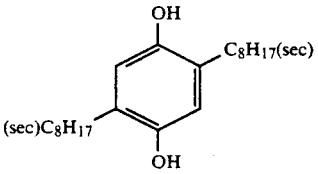
Cpd-4
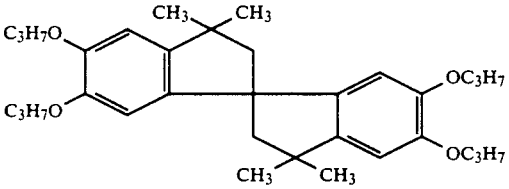
Cpd-5
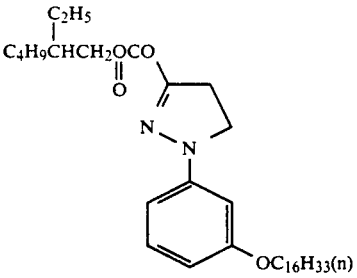
Cpd-6
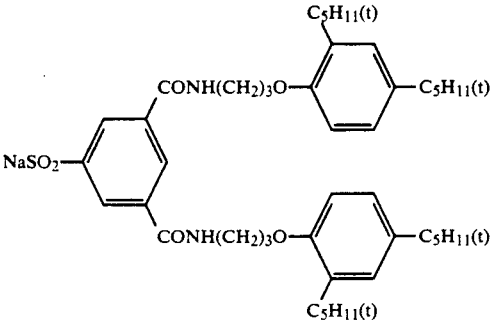

-continued
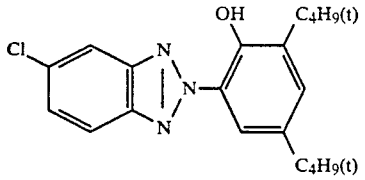
Cpd-7
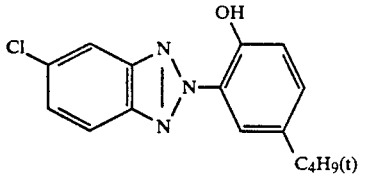
Cpd-8
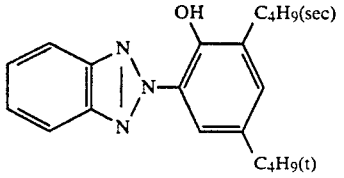
Cpd-9
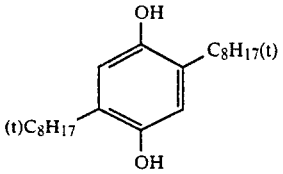
Cpd-10
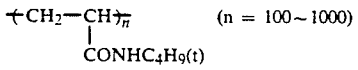
Cpd-11
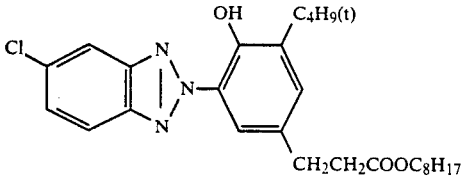
Cpd-12
Solv-1: Dibutyl Phthalate;
Solv-2: Tricresyl Phosphate;
Solv-3: Trioctyl Phosphate;
Solv-4: Trinonyl Phosphate;
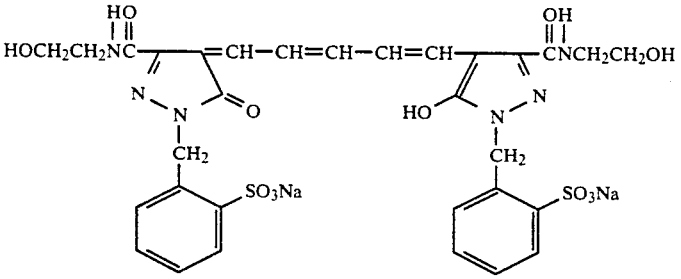
Cpd-13
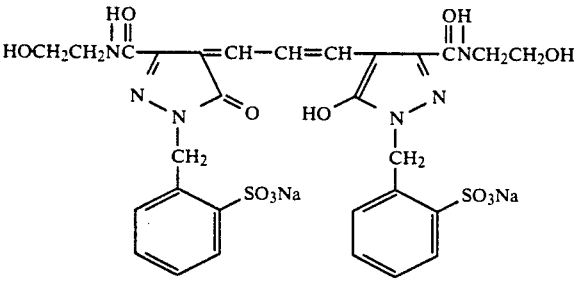
Cpd-14

-continued

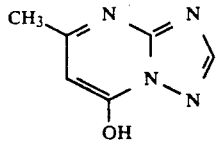

Cpd-15

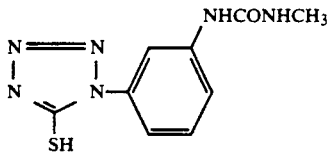

Cpd-16

All the gelatins used in this Example were alkali treated ones having an isoelectric point of 5. The material obtained is referred to as Sample 1-A.

Sample 1-A was imagewise exposed to light and then continuously processed according to the following processes until the amount of replenisher for color development reached 2 times the volume of the tank therefor.

| Process | Temp. (°C.) | Time (sec.) | Amount replenished (ml) | Volume of tank (1) |
|---|---|---|---|---|
| Color Development | 38 | 100 | 290 | 17 |
| Bleach-fixing | 33 | 60 | 100 | 9 |
| Water Washing (1) | 30 to 34 | 15 | — | 4 |
| Water Washing (2) | 30 to 34 | 15 | — | 4 |
| Water Washing (3) | 30 to 34 | 15 | 200 | 4 |
| Drying | 70 to 80 | 50 | | |

*The amount replenished is expressed in the amount per 1 $m^2$ of the processed light-sensitive material.
**The water washing was carried out by 3-tank countercurrent system from (3) to (1).

The composition of each processing solution is as follows:

| | Tank Soln. (g) | Replenisher (g) |
|---|---|---|
| Color Developer | | |
| Water | 800 (ml) | 800 (ml) |
| Diethylenetriaminepentaacetic acid | 1.0 | 1.0 |
| Nitrilotriacetic acid | 2.0 | 2.0 |
| 1-Hydroxyethylidene-1,1-diphosphonic acid | 2.0 | 2.0 |
| Potassium bromide | 0.5 | — |
| Potassium carbonate | 30 | 30 |
| N-Ethyl-N-(beta-methanesulfonamidoethyl)-3-methyl-4-amino-aniline sulfate | 5.5 | 7.5 |
| N,N-Diethylhydroxylamine | 3.6 | 5.5 |
| Fluorescent whitener (available from Sumitomo Chemical Company, Limited under the trade name of WHITEX 4) | 1.5 | 2.0 |
| Triethylenediamine-1,4-diazabicyclo(2,2,2)octane | 5.0 | 5.0 |
| Water | to 1000 ml | to 1000 ml |
| pH (at 25° C.) | 10.20 | 10.06 |
| Bleach-Fixing Soln. | | |
| Water | 400 (ml) | 400 (ml) |
| 70% Ammonium thiosulfate | 200 (ml) | 300 (ml) |
| Sodium sulfite | 20 | 40 |
| Ferric ammonium ethylenediaminetetraacetate | 60 | 120 |
| Disodium ethylenediaminetetraacetate | 5 | 10 |
| Water | to 1000 ml | to 1000 ml |
| pH (at 25° C.) | 6.70 | 6.30 |

Washing Water: Deionized water was used (contents of calcium and magnesium are not more than 3 ppm respectively).

The resulting running solutions were collected and particularly each of the washing water (1) to (3) was divided into portions of 500 ml and the following compounds were added to each portion to obtain washing water (a) to (h).

Washing Water (a): running solution per se;
Washing Water (b): 5 g/l of $NaH_2PO_4$; pH=5.0 (with NaOH);
Washing Water (c): 5 g/l of ammonium chloride;
Washing Water (d): 0.01 mole/l of compound I-1;
Washing Water (e): 0.01 mole/l of compound I-5;
Washing Water (f): 0.01 mole/l of compound I-8;
Washing Water (g): 0.01 mole/l of compound I-28;
Washing Water (h): 0.01 mole/l of compound I-33.

Washing water (d) to (h) were adjusted to pH 7.0 with NaOH/HCl.

Sample 1-A was wedge exposed to light, then processed by the foregoing processes utilizing each running solution and the densities of yellow (B), magenta (G) and cyan (R) thereof were determined immediately after the processing using a reflection densitometer. These densities were also determined after storing the same at 60° C./70% RH for one month and the variation in Dmin (i.e., ΔDmin) and the amount of variation at the exposed point of which density immediately after the processing was 2.0 (i.e., ΔD2.0) were determined and the results obtained were listed in Table I below.

TABLE I

| No. | Washing Water | Δ Dmin B | Δ Dmin G | Δ Dmin R | Δ D2.0 B | Δ D2.0 G | Δ D2.0 R |
|---|---|---|---|---|---|---|---|
| 1 (*) | (a) | +0.20 | +0.10 | +0.11 | −0.02 | +0.03 | −0.25 |
| 2 (*) | (b) | +0.15 | +0.10 | +0.11 | −0.10 | +0.03 | −0.30 |
| 3 (*) | (c) | +0.15 | +0.08 | +0.08 | −0.15 | +0.02 | −0.30 |
| 4 | (d) | +0.10 | +0.06 | +0.05 | 0 | +0.01 | −0.21 |
| 5 | (e) | +0.10 | +0.05 | +0.06 | +0.02 | 0 | −0.22 |
| 6 | (f) | +0.10 | +0.05 | +0.06 | +0.02 | +0.02 | −0.23 |
| 7 | (g) | +0.12 | +0.06 | +0.06 | +0.01 | +0.02 | −0.23 |
| 8 | (h) | +0.11 | +0.06 | +0.06 | +0.01 | +0.02 | +0.24 |

(*) Comparative Examples

The results in Table I clearly verify that the present invention makes it possible to substantially prevent the ocurrence of yellow, magenta and cyan stains and that the dye images obtained by the invention exhibit good shelf stability. The techniques utilizing washing water (b) and (c) which lower the film pH are somewhat effective to prevent stains, but these are not preferred because they cause extreme discoloration of, particularly, yellow images.

EXAMPLE 2

Samples 1-B, to 1-F were prepared in the same manner as in Example 1 except that yellow, magenta and cyan couplers as listed in the following Table were substituted for those used in Example 1. In this respect, the amount of silver halide in Samples 1-E and 1-F were 2 times that in Sample 1-A.

| Sample | Yellow Coupler | Magenta Coupler | Cyan Coupler |
|---|---|---|---|
| 1-B | Y-22 | m-22 | C-1 + C-13 (50 mole % each) |
| 1-C | Y-3 | M-10 | C-1 + C-17 (50 mole % each) |
| 1-D | Y-23 | M-11 | C-2 |
| 1-E | Y-A | M-A | C-A |
| 1-F | Y-B | M-B | C-B |

Y-A

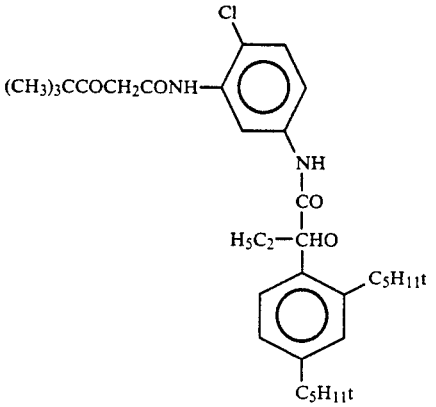

Y-B

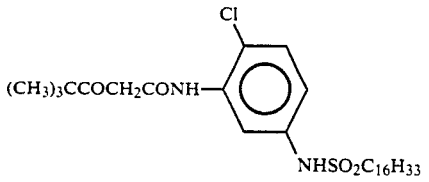

M-A

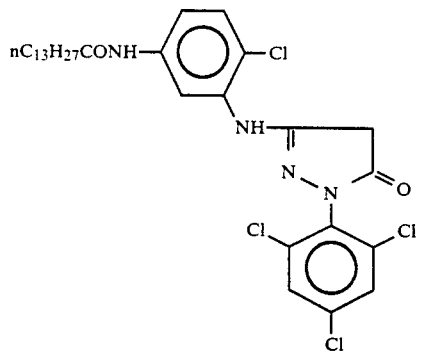

M-B

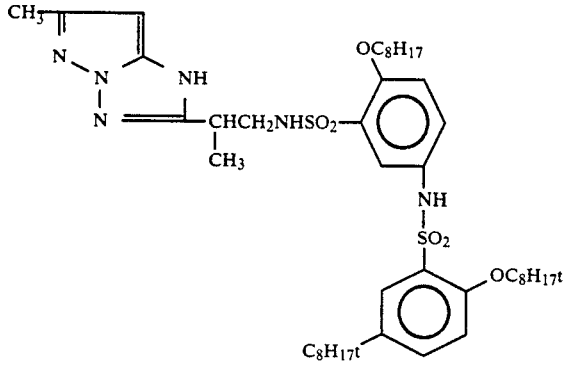

C-A

-continued

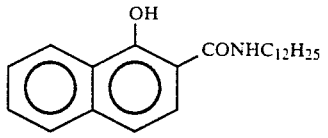

C-B

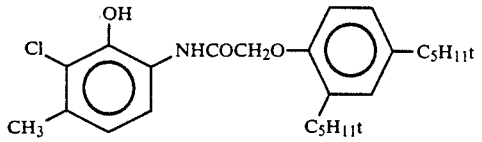

Samples 1-B to 1-F thus prepared were processed in the same manner as in Example 1 utilizing washing water (a), (b), (d) and (e) and changes in the photographic properties (ΔDmin and ΔD2.0) were determined. The results obtained are summarized in Table II.

TABLE II

| Light-sensitive material | Δ Dmin | | | Δ D2.0 | | |
|---|---|---|---|---|---|---|
| | B | G | R | B | G | R |
| | | (I) Comparative Examples | | | | |
| | | (i) Washing Water (a) | | | | |
| 1-B | +0.20 | +0.09 | +0.05 | −0.03 | +0.03 | −0.23 |
| 1-C | +0.21 | +0.11 | +0.05 | −0.03 | +0.03 | −0.23 |
| 1-D | +0.19 | +0.11 | +0.06 | −0.02 | +0.03 | −0.27 |
| 1-E | +0.35 | +0.12 | +0.06 | −0.04 | −0.02 | −0.30 |
| 1-F | +0.25 | +0.12 | +0.06 | −0.04 | −0.03 | −0.32 |
| | | (ii) Washing Water (b) | | | | |
| 1-B | +0.17 | +0.08 | +0.05 | −0.10 | +0.03 | −0.30 |
| 1-C | +0.18 | +0.09 | +0.05 | −0.11 | +0.03 | −0.30 |
| 1-D | +0.17 | +0.09 | +0.05 | −0.11 | +0.03 | −0.35 |
| 1-E | +0.33 | +0.11 | +0.05 | −0.14 | −0.01 | −0.41 |
| 1-F | +0.23 | +0.11 | +0.05 | −0.15 | −0.01 | −0.45 |
| | | (II) Present Invention | | | | |
| | | (i) Washing Water (d) | | | | |
| 1-B | +0.13 | +0.05 | +0.03 | −0.02 | +0.01 | −0.21 |
| 1-C | +0.12 | +0.05 | +0.03 | −0.03 | 0 | −0.21 |
| 1-D | +0.12 | +0.05 | +0.03 | −0.03 | 0 | −0.24 |
| 1-E | +0.15 | +0.06 | +0.04 | −0.01 | 0 | −0.29 |
| 1-F | +0.15 | +0.06 | +0.04 | 0 | +0.01 | −0.31 |
| | | (ii) Washing Water (e) | | | | |
| 1-B | +0.11 | +0.05 | +0.03 | −0.03 | 0 | −0.20 |
| 1-C | +0.11 | +0.05 | +0.03 | −0.02 | 0 | −0.20 |
| 1-D | +0.12 | +0.05 | +0.03 | −0.02 | +0.01 | −0.22 |
| 1-E | +0.15 | +0.06 | +0.04 | 0 | +0.02 | −0.29 |
| 1-F | +0.14 | +0.06 | +0.04 | 0 | +0.02 | −0.31 |

As seen from the results shown in Table II, the method of this invention makes it possible to restrict the stains and the degree of discoloration of images to an extremely low level. Particularly good results were observed on Samples 1-B to 1-D in which 2-equivalent couplers were used.

EXAMPLE 3

Running tests were carried out according to the following processes using Sample 1-A while changing the concentration of benzyl alcohol in the color developer and the composition of the stabilization solution used as summarized in Table III.

| Process | Temp. (°C.) | Time (sec.) | Amount replenished (ml) | Volume of tank (l) |
|---|---|---|---|---|
| Color Development | 38 | 100 | 290 | 17 |
| Bleach-fixing | 33 | 60 | 150 | 9 |

-continued

| Process | Temp. (°C.) | Time (sec.) | Amount replenished (ml) | Volume of tank (1) |
|---|---|---|---|---|
| Stabilization (1) | 30 to 34 | 20 | — | 4 |
| Stabilization (2) | 30 to 34 | 20 | — | 4 |
| Stabilization (3) | 30 to 34 | 20 | 364 | 4 |
| Drying | 70 to 80 | 50 | | |

*The amount replenished is expressed in the amount per 1 $m^2$ of the processed light-sensitive material.
**The water washing was carried out by 3-tank countercurrent system from (3) to (1).

The composition of each processing solution is as follows:

| | Tank Soln. (g) | Replenisher (g) |
|---|---|---|
| Color Developer | | |
| Water | 800 (ml) | 800 (ml) |
| Diethylenetriaminepentaacetic acid | 1.0 | 1.0 |
| Nitrilotriacetic acid | 2.0 | 2.0 |
| 1-Hydroxyethylidene-1,1-diphosphonic acid | 2.0 | 2.0 |
| Benzyl alcohol | (see Table III) | |
| Diethylene glycol | 10 (ml) | 10 (ml) |
| Sodium sulfite | 2.0 | 2.5 |
| Potassium bromide | 0.5 | — |
| Potassium carbonate | 30 | 30 |
| N-Ethyl-N-(beta-methanesulfonamidoethyl)-3-methyl-4-amino-aniline sulfate | 5.5 | 7.5 |
| Hydroxylamine sulfate | 2.0 | 2.5 |
| Fluorescent whitener (available from Sumitomo Chemical Company, Limited under the trade name of WHITEX 4) | 1.5 | 2.0 |
| Water | to 1000 ml | to 1000 ml |
| pH (at 25° C.) | 10.20 | 10.60 |
| Bleach-Fixing Soln. | | |
| Water | 400 (ml) | 400 (ml) |
| 70% Ammonium thiosulfate | 200 (ml) | 300 (ml) |
| Sodium sulfite | 20 | 40 |
| Ferric ammonium ethylenediaminetetraacetate | 60 | 120 |
| Disodium ethylenediaminetetraacetate | 5 | 10 |
| Water | to 1000 ml | to 1000 ml |
| pH (at 25° C.) | 6.70 | 6.30 |

| Stabilization Solution (Tank Soln. and Replenisher) | |
|---|---|
| 1-Hydroxyethylidene-1,1-diphosphonic acid (60%) | 1.6 ml |
| Bismuth chloride | 0.3 g |
| Polyvinyl pyrrolidone | 0.3 g |
| 26% Aqueous ammonia | 2.5 ml |
| Nitrilotriacetic acid | 1.0 g |
| 5-Chloro-2-methyl-4-isothiazolin-3-one | 0.05 g |
| 2-Octyl-4-isothiazolin-3-one | 0.05 g |
| Fluorescent whitener (4,4'-diaminostilbene type) | 1.0 g |
| Sulfinic acid or salt thereof | (see Table III) |
| Water | ad. 1000 ml |
| pH (25° C.) | 7.5 |

Sample 1-A was wedge exposed to light, then processed with each running solution and color densities thereof were determined by a reflection densitometer in the same manner as in Example 1.

The measurement of the densities were also carried out after storing Sample at 40° C./70% RH for 2 months to estimate the change in stains (ΔDmin). The results obtained are listed in Table III.

TABLE III

| Ex. No. | Benzyl Alcohol (ml) Tank Soln./ Replenisher | Additives for Stabilization (0.01 mole/l) | Dmin B | Dmin G | Dmin R |
|---|---|---|---|---|---|
| 1 (*) | — | — | +0.18 | +0.10 | +0.10 |
| 2 (*) | 15/20 | — | +0.20 | +0.13 | +0.13 |
| 3 | 15/20 | I-5 | +0.13 | +0.06 | +0.05 |
| 4 | 15/20 | I-7 | +0.13 | +0.06 | +0.06 |
| 5 | 15/20 | I-19 | +0.14 | +0.06 | +0.06 |
| 6 | — | I-5 | +0.09 | +0.03 | +0.04 |
| 7 | — | I-7 | +0.09 | +0.02 | +0.03 |
| 8 | — | I-19 | +0.10 | +0.03 | +0.04 |

(*): Comparative Examples

The results listed in Table III show that the occurrence of stains was effectively suppressed to a low level and remarkable effect was achieved by the systems free from benzyl alcohol.

EXAMPLE 4

A multilayered photographic paper having the following layer structure was produced by applying coating solutions to the surface of a paper substrate of which both sides had been laminated with polyethylene films. The coating solutions were prepared as follows;

Preparation of the Coating Solution for 1st Layer

To 19.1 g of yellow coupler ExY-1 and 4.4 g of a dye image stabilizer (Cpd-2) there were added 27.2 cc of ethyl acetate and 7.7 cc (8.0 g) of a high boiling point solvent (Solv-1) to dissolve them and the resulting solution was dispersed in 185 cc of 10% aqueous gelatin solution containing 8 cc of 10% sodium dodecylbenzene sulfonate to form an emulsion. This emulsion was mixed with and dispersed in emulsions EM 7 and EM 8 and the concentration of gelatin was adjusted to be consistent with the following composition to obtain the coating solution for 1st layer. The coating solutions for 2nd to 7th layers were also prepared in the same manner. To each layer, sodium salt of 1-oxy-3,5-dichloro-s-triazine was added as a gelatin hardening agent. Moreover, Cpd-1 was used as a thickener.

Layer Structure

The composition of each layer is given below. Numerical values represent coated amounts expressed in g/$m^2$. The amount of silver halide emulsion is expressed in the amount of elemental silver.

Substrate

Paper laminated with polyethylene films (the polyethylene film on the side of the 1st layer includes a white pigment ($TiO_2$) and a blueing dye).

| | |
|---|---|
| 1st Layer: Blue-sensitive Emulsion Layer | |
| Monodisperse silver chlorobromide emulsion spectrally sensitized with sensitizing dye ExS-1 (EM-7) | 0.15 |
| Monodisperse silver chlorobromide emulsion spectrally sensitized with sensitizing dye ExS-1 (EM-8) | 0.15 |
| Gelatin | 1.86 |
| Yellow coupler ExY-1 | 0.82 |
| Color image stabilizer Cpd-2 | 0.19 |
| Solvent Solv-1 | 0.35 |
| 2nd Layer: Color Mixing Inhibiting Layer | |
| Gelatin | 0.99 |
| Color mixing inhibitor Cpd-3 | 0.08 |
| 3rd Layer: Green-sensitive Emulsion Layer | |
| Monodisperse silver chlorobromide emulsion spectrally sensitized with sensitizing dye | 0.12 |

-continued

| | |
|---|---|
| ExS-2,3 (EM-9) | |
| Monodisperse silver chlorobromide emulsion spectrally sensitized with sensitizing dye ExS-2,3 (EM-10) | 0.24 |
| Gelatin | 1.24 |
| Magenta coupler ExM-1 | 0.39 |
| Color image stabilizer Cpd-4 | 0.25 |
| Color image stabilizer Cpd-5 | 0.12 |
| Solvent Solv-2 | 0.25 |
| 4th Layer: Ultraviolet absorbing Layer | |
| Gelatin | 1.60 |
| Ultraviolet absorber (Cpd-6/Cpd-7/Cpd-8 = 3/2/6; weight ratio) | 0.70 |
| Color mixing inhibitor Cpd-9 | 0.05 |
| Solvent Solv-3 | 0.42 |
| 5th Layer: Red-sensitive Emulsion Layer | |
| Monodisperse silver chlorobromide emulsion spectrally sensitized with sensitizing dye ExS-4,5 (EM-11) | 0.07 |
| Monodisperse silver chlorobromide emulsion spectrally sensitized with sensitizing dye ExS-4,5 (EM-12) | 0.16 |
| Gelatin | 0.92 |
| Cyan coupler ExC-1 | 1.46 |
| Cyan coupler ExC-2 | 1.84 |
| Color image stabilizer (Cpd-7/Cpd-8/Cpd-10 = 3/4/2; weight ratio) | 0.17 |
| Polymer for dispersion Cpd-11 | 0.14 |
| Solvent Solv-1 | 0.20 |
| 6th Layer: Ultraviolet absorbing Layer | |
| Gelatin | 0.54 |
| Ultraviolet absorber (Cpd-6/Cpd-8/Cpd-10 = 1/5/3; weight ratio) | 0.21 |
| Solvent Solv-4 | 0.08 |
| 7th Layer: Protective Layer | |

-continued

| | |
|---|---|
| Gelatin | 1.33 |
| Acryl modified copolymer of polyvinyl alcohol (degree of modification = 17%) | 0.17 |
| Liquid paraffin | 0.03 |

In this case, Cpd-12 and Cpd-13 were used as irradiation inhibiting dyes.

In addition to the foregoing components, each layer contained Alkanol XC (available from Dupont Co., Ltd.), sodium alkylbenzenesulfonate, succinate and Magefacx F-120 ( available from DAINIPPON INK AND CHEMICALS, INC.) as an emulsifying and dispersing agent and a coating aid. Moreover, Cpd-14 and Cpd-15 were used as stabilizers for silver halide.

The details of the emulsions used are as follows:

| Emulsion | Grain Size (micron) | Br Content (mole %) | Coefficient of Variation |
|---|---|---|---|
| EM-7 | 1.1 | 1.0 | 0.10 |
| EM-8 | 0.8 | 1.0 | 0.10 |
| EM-9 | 0.45 | 1.5 | 0.09 |
| EM-10 | 0.34 | 1.5 | 0.09 |
| EM-11 | 0.45 | 1.5 | 0.09 |
| EM-12 | 0.34 | 1.6 | 0.10 |

*Coefficient of variation means the distribution of grains (standard deviation/average size of the grains).

**Silver halide grains used in each emulsion were in the form of cubic crystal.

The structural formulas of the compounds use in this Example are as follows:

ExY-2 (Y-21)

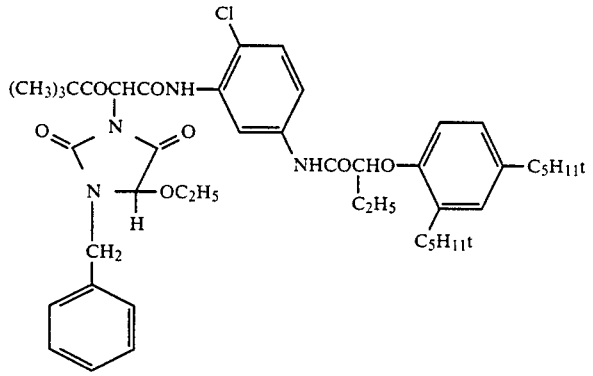

ExM-1

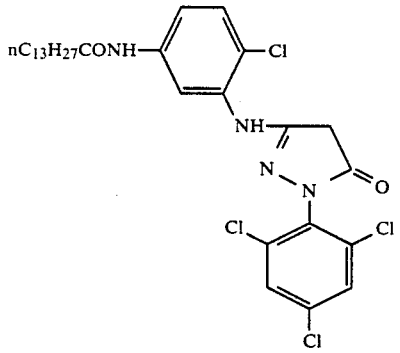

ExC-1 (C-1)

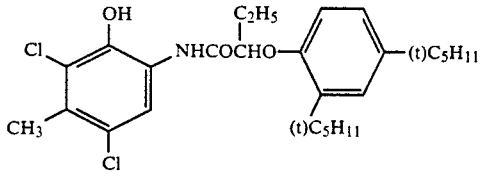

-continued
ExC-2 (C-13)
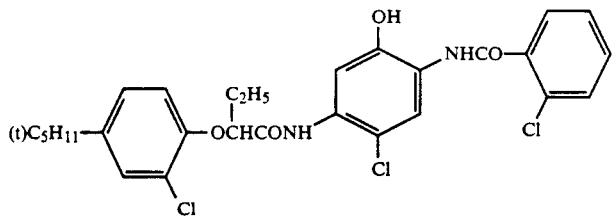
ExS-1
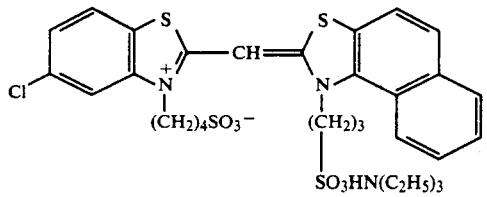
ExS-2
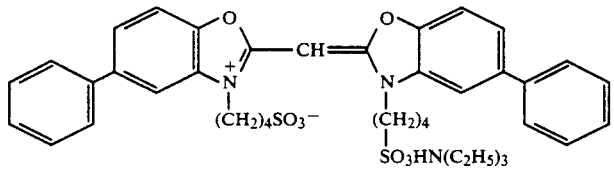
ExS-3
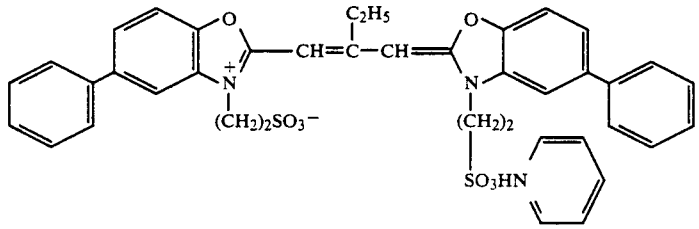
ExS-4
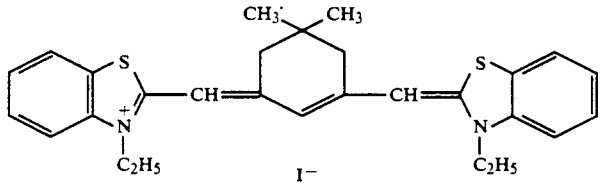
ExS-5
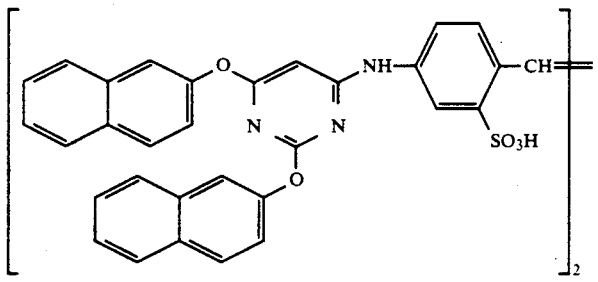
Cpd-1
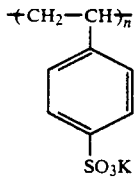

-continued
Cpd-2
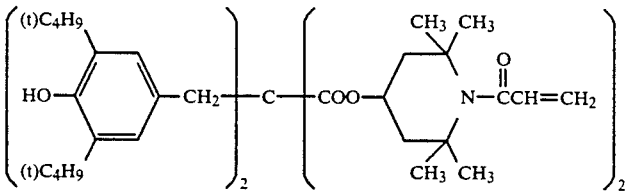
Cpd-3
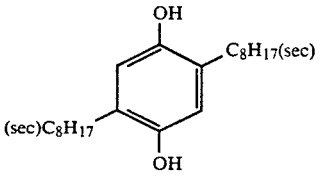
Cpd-4
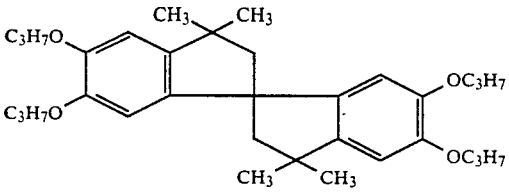
Cpd-5
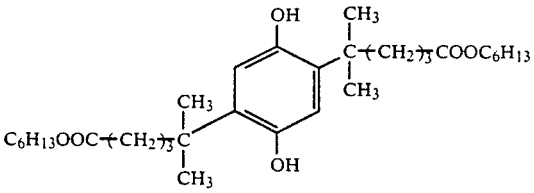
Cpd-6
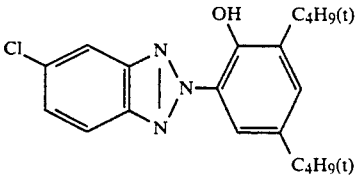
Cpd-7
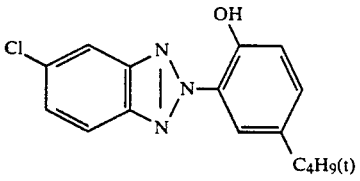
Cpd-8
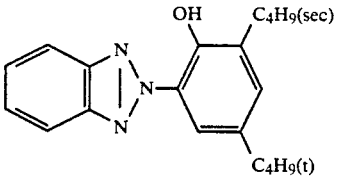
Cpd-9
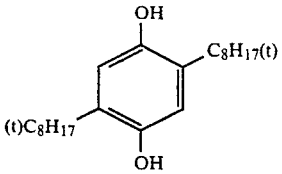

-continued

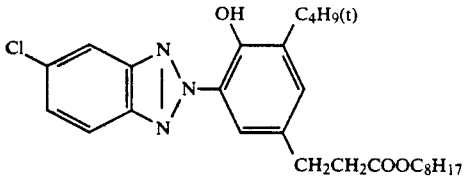

Cpd-10

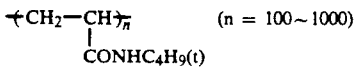

Cpd-11

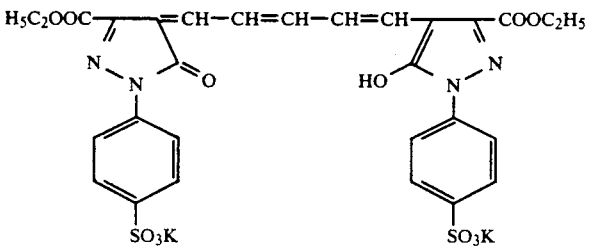

Cpd-12

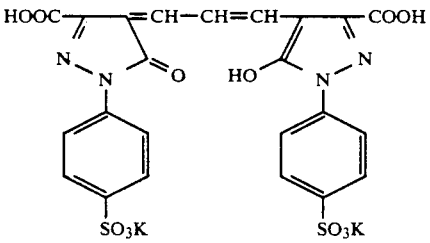

Cpd-13

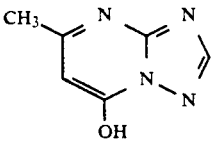

Cpd-14

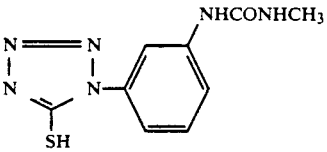

Cpd-15

Solv-1: Dibutyl Phthalate
Solv-2: Trioctyl Phosphate
Solv-3: Trinonyl Phosphate
Solv-4: Tricresyl Phosphate All the gelatins used in this Example were alkali treated ones having an isoelectric point of 5. The material thus obtained was referred to as Sample 4-A.

Running tests were carried out according to the following processes using Sample 4-A while changing the compositions of the stabilization solutions and changes in stains (ΔDmin) were determined in the same manner as in Example 3.

| Process | Temp. (°C.) | Time (sec.) | Amount replenished (ml) | Volume of tank (1) |
|---|---|---|---|---|
| Color Development | 35 | 45 | 161 | 17 |
| Bleach-fixing | 30 to 36 | 45 | 215 | 17 |
| Stabilization (1) | 30 to 37 | 20 | — | 10 |
| Stabilization (2) | 30 to 37 | 20 | — | 10 |
| Stabilization (3) | 30 to 37 | 20 | — | 10 |
| Stabilization (4) | 30 to 37 | 20 | 200 | 10 |

-continued

| Process | Temp. (°C.) | Time (sec.) | Amount replenished (ml) | Volume of tank (1) |
|---|---|---|---|---|
| Drying | 70 to 85 | 60 | | |

*The amount replenished is expressed in the amount per 1 $m^2$ of the processed light-sensitive material.

**The stabilization process was carried out by 4-tank countercurrent system from (4) to (1).

The composition of each processing solution is as follows:

| Color Developer | Tank Soln. (g) | Replenisher (g) |
|---|---|---|
| Water | 800 (ml) | 800 (ml) |
| Ethylenediaminetetraacetic acid | 2.0 | 2.0 |
| 5,6-dihydroxybenzene-1,2,4-trisulfonic acid | 0.3 | 0.3 |
| Triethanolamine | 8.0 | 8.0 |

-continued

| | | |
|---|---|---|
| Sodium chloride | 1.4 | — |
| Potassium carbonate | 25 | 25 |
| N-Ethyl-N-(beta-methanesulfonamidoethyl)-3-methyl-4-amino-aniline sulfate | 5.0 | 7.0 |
| Diethylhydroxylamine | 4.2 | 6.0 |
| Fluorescent whitener (4,4'-diamino-stilbene type) | 2.0 | 2.5 |
| Water | to 1000 ml | to 1000 ml |
| pH (at 25° C.) | 10.05 | 10.45 |
| Bleach-Fixing Soln. (Tank Soln. and Replenisher (g)) | | |
| Water | 400 (ml) | |
| 70% Ammonium thiosulfate | 100 (ml) | |
| Sodium sulfite | 17 | |
| Ferric ammonium ethylenediaminetetraacetate | 55 | |
| Disodium ethylenediaminetetraacetate | 5 | |
| Glacial acetic acid | | |
| Water | to 1000 ml | |
| pH (at 25° C.) | 5.45 | |
| Stabilization Solution (Tank Soln. and Replenisher) | | |
| Formalin | 0.1 g | |
| Formalin/sulfurous acid adduct | 0.7 g | |
| 5-Chloro-2-methyl-4-isothiazolin-3-one | 0.02 g | |
| 2-Methyl-4-isothiazolin-3-one | 0.01 g | |
| Copper sulfate | 0.005 g | |
| Sulfinic acid or salt thereof (see Table IV) | 0.01 mole | |
| Water | to 1000 ml | |
| pH (25° C.) | 4.0 | |

The results obtained are listed in Table IV.

TABLE IV

| Ex. No. | Sulfinic acid or salt thereof | ΔDmin B | G | R |
|---|---|---|---|---|
| 1(*) | — | +0.25 | +0.11 | +0.06 |
| 2 | I-2 | +0.20 | +0.08 | +0.04 |
| 3 | I-5 | +0.19 | +0.07 | +0.04 |
| 4 | I-8 | +0.18 | +0.07 | +0.03 |
| 5 | I-14 | +0.19 | +0.07 | +0.04 |
| 6 | I-19 | +0.19 | +0.07 | +0.04 |
| 7 | I-21 | +0.20 | +0.08 | +0.04 |
| 8 | I-34 | +0.20 | +0.08 | +0.04 |

(*)Comparative Examples

The results listed in Table IV show that the occurrence of stains was effectively suppressed to a low level by the method of this invention.

In the foregoing processing Nos. 1 to 8, the running treatments were carried out until the amount of the replenishers reached 3 times the volume of the tanks and one liter each of the stabilization solution (1), (2) or (3) was allowed to stand at room temperature to determine the number of days elapsed till floating substances were formed or the sulfidation was caused. The results obtained are summarized in Table V.

TABLE V

| No. | Stabilization Solution (1) | Stabilization Solution (2) | Stabilization Solution (3) |
|---|---|---|---|
| 1(*) | 12 | 16 | 18 |
| 2 | 25 | 30 | 33 |
| 3 | 25 | 32 | 34 |
| 4 | 23 | 29 | 31 |

TABLE V-continued

| No. | Stabilization Solution (1) | Stabilization Solution (2) | Stabilization Solution (3) |
|---|---|---|---|
| 5 | 23 | 28 | 30 |
| 6 | 21 | 27 | 29 |
| 7 | 20 | 26 | 28 |
| 8 | 22 | 29 | 32 |

As seen from Table V, the present invention makes it possible to increase the stability of the stabilization solutions by about two factors compared to conventional methods.

EXAMPLE 5

A light-sensitive material having the following multilayered structure was prepared using a paper substrate of which both sides had been laminated with polyethylene films.

E9th Layer: Protective Layer
E8th Layer: Ultraviolet Absorbing Layer
E7th Layer: Blue-sensitive Emulsion Layer
E6th Layer: Ultraviolet Absorbing Layer
E5th Layer: Yellow Filter Layer
E4th Layer: Ultraviolet Absorbing Layer
E3rd Layer: Green-sensitive Emultion Layer
E2nd Layer: Ultraviolet Absorbing Layer
E1st Layer: Red-sensitive Emulsion Layer Substrate B1st Layer: Curling Inhibiting Layer
B2nd Layer: Protective Layer Coating solutions were prepared as follows:

Preparation of the Coating Solution for 1st Layer

To 13.4 g of a cyan coupler (ExCC-1), 5.7 g of a dye image stabilizer (ExSA-1) and 10.7 g of a polymer (ExP-1) there were added 40 cc of ethyl acetate and 7.7 cc of a solvent (ExS-1) to dissolve them and the resultant solution was dispersed in 185 cc of 10% aqueous gelatin solution containing 8 cc of 10% sodium dodecybenzenesulfonate solution to form an emulsion. Another emulsion was separately prepared by adding, to an emulsion containing silver halide grains in which the latent images were mainly formed in the inner portion thereof (containing 63 g/kg of silver), the following red-sensitive sensitizing dye in an amount of $2.5\times10^{-4}$ moles per mole of silver. These two emulsions were mixed and dispersed one another while adjusting the amount of the components to consist with the following composition to thereby obtain the coating solution for 1st layer. The coating solutions for E2nd to E9th and B1st to B2nd layers were also prepared in the manner similar to that for E1st layer. Each layer contained sodium salt of 1-oxy-3,5-dichloro-s-triazine as a gelatin hardening agent.

The spectral sensitizing dye used in each layer was as follows:

Red-sensitive Emulsion Layer:

-continued

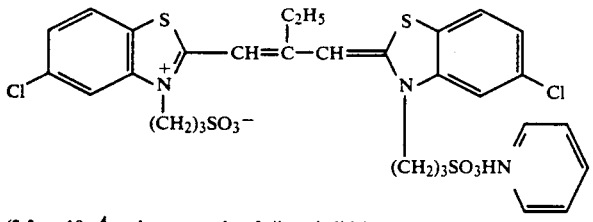

(2.5 × $10^{-4}$ moles per mole of silver halide)

Green-sensitive Emulsion Layer:

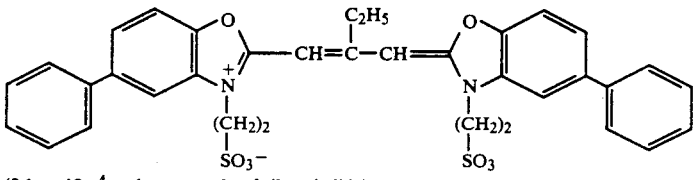

(3.1 × $10^{-4}$ moles per mole of silver halide)

Blue-sensitive Emulsion Layer:

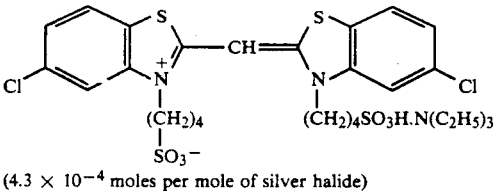

(4.3 × $10^{-4}$ moles per mole of silver halide)

The following dyes were used as irradiation inhibiting dyes:

Irradiation Inhibiting Dye for Green-sensitive Emulsion Layer:

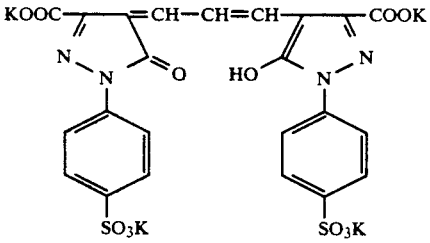

Irradiation Inhibiting Dye for Red-sensitive Emulsion Layer:

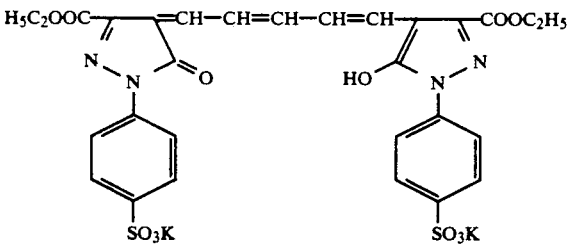

Layer Structure

The composition of each layer is given below. The numerical values appearing in the compositions are amounts coated per 1 $m^2$ of each layer. The coated amount of silver halide emulsions and colloidal silvers are expressed in the amount of elemental silver.

Substrate

Paper laminated with polyethylene films (the film on the side of the 1st layer includes a white pigment ($TiO_2$) and a blueing dye (Ultramarine Blue)).

| | | |
|---|---|---|
| E1st Layer: | | |
| Silver halide emulsion | 0.39 | g |
| Gelatin | 1.35 | g |
| Cyan coupler (ExCC-1) | 0.40 | g |
| Dye image stabilizer (ExSA-1) | 0.17 | g |
| Polymer (ExP-1) | 0.32 | g |
| Solvent (ExS-1) | 0.23 | g |
| Development controlling agent (ExGC-1) | 32 | mg |
| Stabilizer (ExA-1) | 5.8 | mg |
| Nucleation promoting agent (ExZS-1) | 0.37 | g |
| Nucleating agent (ExZK-1) | 9.9 | micro g |
| E2nd Layer: | | |
| Gelatin | 1.6 | g |
| Ultraviolet absorbing agent (ExUV-1) | 0.62 | g |
| Color mixing inhibitor (ExKB-1) | 0.06 | g |
| Solvent (ExS-2) | 0.24 | g |
| E3rd Layer: | | |
| Silver halide emulsion | 0.27 | g |
| Gelatin | 1.79 | g |
| Magenta coupler (ExMC-1) | 0.32 | g |
| Dye image stabilizer (ExSA-2) | 0.20 | g |
| Solvent (ExS-3) | 0.65 | g |
| Development controlling agent (ExGC-1) | 22 | mg |
| Stabilizer (ExA-1) | 4 | mg |
| Nucleation promoting agent (ExZS-1) | 0.26 | g |
| Nucleating agent (ExZK-1) | 3.4 | micro g |
| E4th Layer | | |
| Gelatin | 0.53 | g |
| Ultraviolet absorbing agent (ExUV-1) | 0.21 | g |
| Color mixing inhibitor (ExKB-2) | 0.02 | g |
| Solvent (ExS-2) | 0.08 | g |
| E5th Layer: | | |
| Colloidal silver | 0.10 | g |
| Gelatin | 0.53 | g |
| Ultraviolet absorbing agent (ExUV-1) | 0.21 | g |
| Color mixing inhibitor (ExKB-2) | 0.02 | g |
| Solvent (ExS-2) | 0.08 | g |
| E6th Layer: The same as E4th Layer. | | |
| E7th Layer: | | |
| Silver halide emulsion | 0.26 | g |
| Gelatin | 1.83 | g |
| Yellow coupler (ExYC-1) | 0.83 | g |
| Dye image stabilizer (ExSA-3) | 0.19 | g |

-continued

| | |
|---|---|
| Solvent (ExS-4) | 0.35 g |
| Development controlling agent (ExGC-1) | 32 mg |
| Stabilizer (ExA-1) | 2.9 mg |
| Nucleation promoting agent (ExZS-1) | 0.2 mg |
| Nucleating agent (ExZK-1) | 2.5 micro g |
| E8th Layer: | |
| Gelatin | 0.53 g |
| Ultraviolet absorbing agent (UV-1) | 0.21 g |
| Solvent (Solv-3) | 0.08 g |
| E9th Layer: | |
| Gelatin | 1.33 g |

-continued

| | |
|---|---|
| Acryl modified copolymer of polyvinyl alcohol (degree of modification = 17%) | 0.17 g |
| Liquid paraffin | 0.03 g |
| Latex particles of polymethylmethacrylate (average particle size = 2.8 microns) | 0.05 g |
| B1st Layer: | |
| Gelatin | 8.7 g |
| B2nd Layer: The same as E9th Layer. | |

The structural formulas of the compounds used in this Example are as follows:

ExCC-1: Cyan Coupler

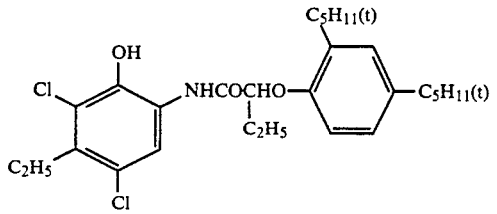

ExMC-1: Magenta Coupler

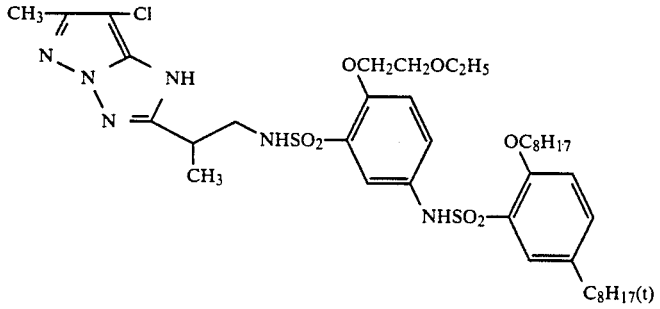

ExYC-1: Yellow Coupler

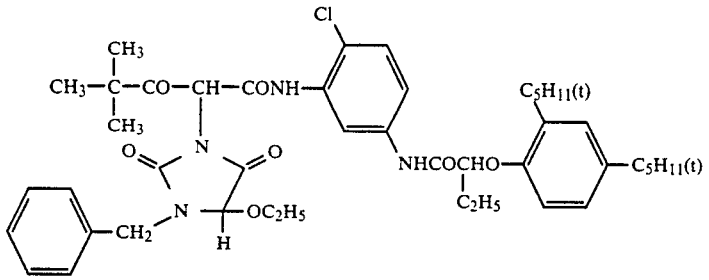

ExSA-1: Dye Image Stabilizer

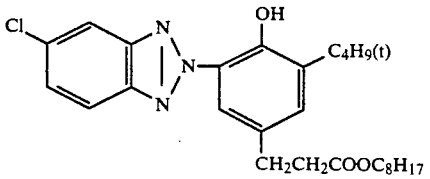

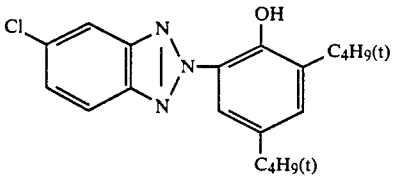

-continued
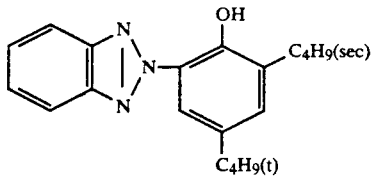
(5:8:9 mixture of these three compounds; weight ratio)
ExSA-2: Dye Image Stabilizer
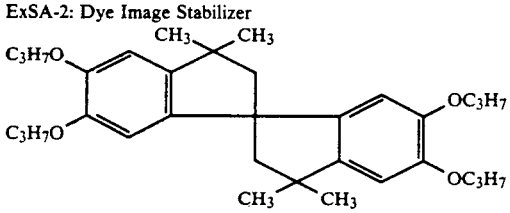
ExSA-3: Dye Image Stabilizer
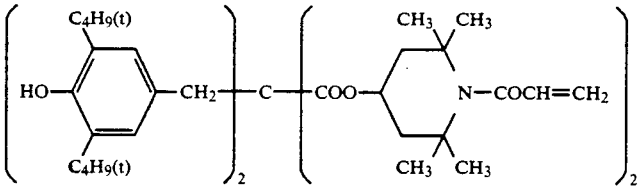
ExUV-1: Ultraviolet Absorber
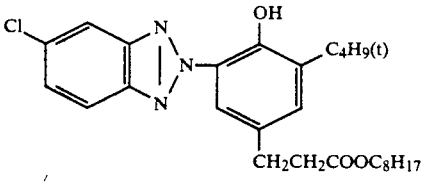
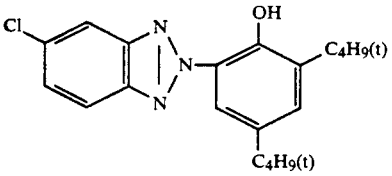
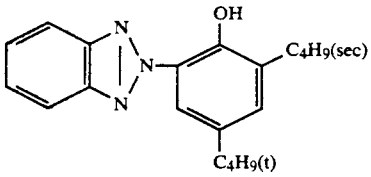
(2:9:8 mixture of these three compounds; weight ratio)
ExKB-1: Color Mixing Inhibitor
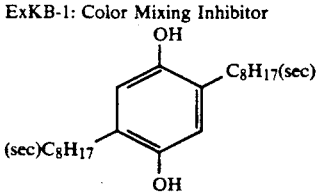
ExKB-2: Color Mixing Inhibitor
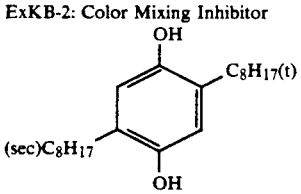
ExGC-1: Development Controlling Agent

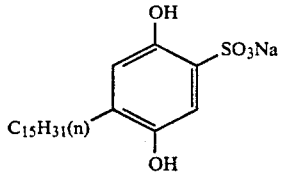

ExA-1 Stabilizer

4-Hydroxy-6-methyl-1,3,3a,7-tetrazaindene

ExZS-1

2-(3-Dimethylaminopropylthio)-5-mercapto-1,3,4-thiadiazole hydrochloride

ExZK-1

6-Ethoxythiocarbonylamino-2-methyl-1-propargylquinolinium trifluoromethanesulfonate The light-sensitive material 6-A was imagewise exposed to light and then running treated in accordance with the following processes while changing the composition of the washing water (A).

| Process | Temp. (°C.) | Time (sec.) | Amount replenished (ml) | Volume of tank (l) |
|---|---|---|---|---|
| Color Development | 38 | 100 | 300 | 10 |
| Bleach-fixing | 33 | 60 | 300 | 5 |
| Water Washing (1) | 30 to 34 | 20 | — | 2 |
| Water Washing (2) | 30 to 34 | 20 | 300 | 2 |
| Drying | 70 to 80 | 50 | | |

*The amount replenished is expressed in the amount per 1 $m^2$ of the processed light-sensitive material.

**The water washing was carried out by 2-tank countercurrent system from (2) to (1).

The composition of each processing solution is as follows:

| | Tank Soln. (g) | Replenisher (g) |
|---|---|---|
| Color Developer | | |
| Water | 800 (ml) | 800 (ml) |
| Diethylenetriaminepentaacetic acid | 1.0 | 1.0 |
| Nitrilotriacetic acid | 2.0 | 2.0 |
| 1-Hydroxyethylidene-1,1-diphosphonic acid | 2.0 | 2.0 |
| Triethylenediamine-1,4-diazabicyclo(2,2,2)octane | 5.0 | 5.0 |
| Potassium bromide | 1.5 | — |
| Potassium carbonate | 30 | 30 |
| N-Ethyl-N-(beta-methanesulfonamidoethyl)-3-methyl-4-amino-aniline sulfate | 5.5 | 7.5 |
| N,N-Diethylhydroxylamine | 3.6 | 5.5 |
| Triethanolamine | 10.0 | 10.0 |
| Fluorescent whitener (WHITEX 4: available from Sumitomo Chemical Company, Limited) | 1.5 | 2.0 |
| Water | to 1000 ml | to 1000 ml |
| pH (at 25° C.) | 10.20 | 10.60 |

-continued

| | Tank Soln. (g) | Replenisher (g) |
|---|---|---|
| Bleach-Fixing Soln. | | |
| Water | 400 (ml) | 400 (ml) |
| Ammonium thiosulfate solution | 200 (ml) | 300 (ml) |
| Sodium sulfite | 20 | 40 |
| Ferric ammonium ethylenediaminetetraacetate | 60 | 120 |
| Disodium ethylenediaminetetraacetate | 5 | 10 |
| Water | to 1000 ml | to 1000 ml |
| pH (at 25° C.) | 6.70 | 6.30 |

Washing Water: Tank Soln. and Replenisher (A): Deionized water (the contents of calcium and magnesium are not more than 3 ppm respectively). Washing water (B) to (d) were prepared by adding the following compound to the same deionized water:

(B): 5.0 g/l of ammonium chloride;

(C): 0.02 mole/l of compound I-5; and (D): 0.02 mole/l of compound I-8.

In the same manner as in Example 1, the properties ΔDmin and ΔD2.0 were determined. The results obtained are listed in Table VI.

TABLE VI

| No. | Washing Water | ΔDmin B | ΔDmin G | ΔDmin R | ΔD 2.0 B | ΔD 2.0 G | ΔD 2.0 R |
|---|---|---|---|---|---|---|---|
| 1(*) | (A) | +0.25 | +0.13 | +0.07 | −0.03 | +0.03 | −0.30 |
| 2(*) | (B) | +0.20 | +0.10 | +0.06 | −0.03 | +0.02 | −0.39 |
| 3 | (C) | +0.15 | +0.06 | +0.04 | 0 | −0.01 | −0.27 |
| 4 | (D) | +0.16 | +0.07 | +0.05 | +0.01 | −0.01 | −0.27 |

(*)Comparative Example.

As seen from Table VI, the light-sensitive materials processed by the present invention exhibited good image stability and did not cause stains.

EXAMPLE 6

A silver halide emulsion (1) for blue-sensitive silver halide emulsion layer was prepared as follows:

| | |
|---|---|
| (Solution 1) | |
| Water | 1,000 ml |
| NaCl | 5.8 g |
| Gelatin | 25 g |
| (Solution 2) | |
| 1N Sulfuric acid | 20 ml |
| (Solution 3) | |
| 1% Solution of the following compound: | 3 ml |

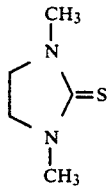

-continued

| | |
|---|---|
| (Solution 4) | |
| KBr | 0.18 g |
| NaCl | 8.51 g |
| Water | to 130 ml |
| (Solution 5) | |
| $AgNO_3$ | 25 g |
| Water | to 130 ml |
| (Solution 6) | |
| KBr | 0.70 g |
| NaCl | 34.05 g |
| $K_3IrCl_6$ (0.001%) | 2 ml |
| Water | to 285 ml |
| (Solution 7) | |
| $AgNO_3$ | 100 g |
| Water | to 285 ml |

Solution 1 was heated at 60° C. and Solutions 2 and 3 were added thereto. Then, Solutions 4 and 5 were simultaneously added to the resultant solution over 60 minutes. Solutions 6 and 7 were simultaneously added thereto over 25 minutes, 10 minutes after the addition of Solutions 4 and 5 was completed. After 5 minutes, the resultant solution was desalted by lowering the temperature thereof. Water and a gelatin dispersion were added and the pH value was adjusted to 6.0 to form a monodisperse silver chlorobromide emulsion (average grain size=1.0 micron; coefficient of variation (the value of standard deviation divided by the average grain size: $s/\bar{d}$)=0.11; AgBr content=1 mole %). This emulsion was subjected to an optimum chemical sensitization by adding triethylthiourea thereto. Thereafter, the following spectral sensitizing dye (Sen-1) was added to the emulsion in an amount of $7\times10^{-4}$ moles per mole of silver halide.

A silver halide emulsion (2) for green-sensitive silver halide emulsion layer and that (3) for red-sensitive silver halide emulsion layer were also prepared in the same manner as that described above except that the kind and the amount of chemicals used, the temperature and the time for addition thereof were changed.

In this connection, a spectral sensitizing dye (Sen-2) for the silver halide emulsion (2) and a spectral sensitizing dye (Sen-3) for the emulsion (3) were used in amounts of $5\times10^{-4}$ moles and $0.9\times10^{-4}$ moles per mole of silver halide respectively.

The shape, average grain size, halogen composition and coefficient of variation of the silver halide grains in the emulsions (1) to (3) were as follows:

| Emulsion | Shape | Average grain size (micron) | Halogen (Br) composition (mole %) | Coefficient of variation |
|---|---|---|---|---|
| (1) | cubic | 1.00 | 1.0 | 0.11 |
| (2) | cubic | 0.45 | 1.0 | 0.09 |
| (3) | cubic | 0.34 | 1.8 | 0.10 |

-continued (Sen-1)

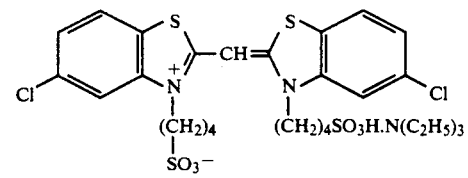

(Sen-2)

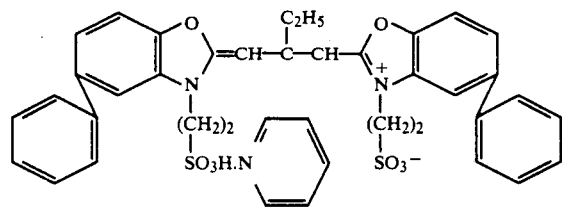

(Sen-3)

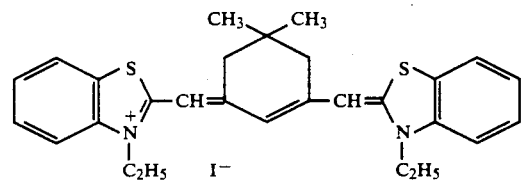

A multilayered color photographic light-sensitive material having the following layer structure was prepared using the silver halide emulsions (1) to (3) prepared above. Coating liquids used were prepared as follows:

Coatign Liquid for 1st Layer

A yellow coupler (ExY; 19.1 g) was dissolved in 27.2 cc of ethyl acetate and 3.8 cc of a solvent (Sovl-1) and the resultant solution was emulsified and dispersed in 185 cc of 10% aqueous gelatin solution containing 8 cc of 10% sodium dodecylbenzene sulfonate. On the other hand, an emulsion was prepared by adding a blue-sensitive sensitizing dye (Sen-1) to the silver halide emulsion (1) in an amount of $5.0\times10^{-4}$ moles per mole of silver halide. These two emulsions were admixed with and dispersed in one another so as to be consistent with the following composition to form the coating liquid for 1st layer.

Coating liquids for 2nd to 7th layers were also prepared in the same manner as that for the 1st layer.

In each layer, sodium salt of 1-oxy-3,5-dichloro-s-triazine was used as a gelatin-hardening agent.

The following compound was added to the red-sensitive light-sensitive emulsion layer in an amount of $1.9\times10^{-3}$ moles per mole of silver halide:

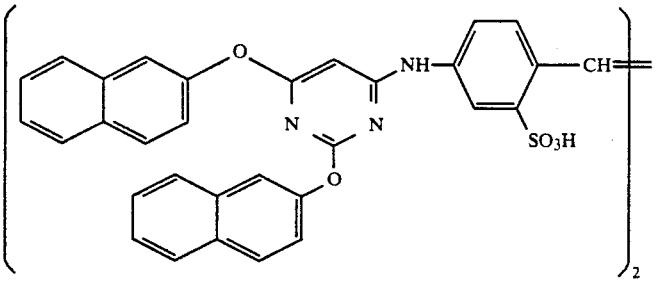

To the blue-sensitive light-sensitive emulsion layer 4-hydroxy-6-methyl-1,3,3a-7-tetrazaindene was added in an amount of $1.0\times10^{-2}$ mole per mole of silver halide.

To the blue-sensitive and green-sensitive light-sensitive emulsion layers 1-(5-methylureidophenyl)-5-mercaptotetrazole was added in amounts of $1.0\times10^{-3}$ and $1.5\times10^{-3}$ moles per mole of silver halide respectively.

In addition, 2-amino-5-mercapto-1,3,4-thiadiazole was added to the red-sensitive light-sensitive layer in an amount of $2.5\times10^{-4}$ moles per mole of silver halide.

The composition of each layer was as follows (numerical values are expressed in gram per 1 $m^2$ of the layer):

Layer Structure

Substrate: A paper substrate both sides of which were laminated with polyethylene films (the polyethylene film situated at the side of 1st layer contained a white pigment ($TiO_2$:2.7 g/$m^2$) and a blueing dye (Ultramarine Blue)).

| | |
|---|---|
| 1st Layer: | |
| Blue-sensitive Emulsion Layer | |
| Silver halide emulsion (1) | 0.26 |
| Gelatin | 1.13 |
| Yellow coupler (ExY) | 0.66 |
| Solvent (Solv-1) | 0.28 |
| 2nd Layer: | |
| Color Mixing Inhibition Layer | |
| Gelatin | 0.89 |
| Color mixing inhibitior (Cpd-1) | 0.08 |
| Solvent (Solv-1) | 0.20 |
| Solvent (Solv-2) | 0.20 |
| Dye (T-1) | 0.005 |
| 3rd Layer: | |
| Green-sensitive Emulsion Layer | |
| Silver halide emulsion (2) | 0.15 |
| Gelatin | 0.99 |
| Magenta coupler (ExM-1) | 0.25 |
| Dye-image stabilizer (Cpd-2) | 0.10 |
| Dye-image stabilizer (Cpd-3) | 0.05 |
| Dye-image stabilizer (Cpd-4) | 0.07 |
| Dye-image stabilizer (Cpd-5) | 0.01 |
| Solvent (Solv-2) | 0.19 |
| Solvent (Solv-3) | 0.15 |
| 4th Layer: | |
| Ultraviolet Absorbing Layer | |
| Gelatin | 1.42 |
| Ultraviolet absorber (UV-1) | 0.52 |
| Color mixing inhibitor (Cpd-1) | 0.06 |
| Solvent (Solv-4) | 0.26 |
| Dye (T-2) | 0.015 |
| 5th Layer: | |
| Red-sensitive Emulsion Layer | |
| Silver halide emulsion (3) | 0.22 |
| Gelatin | 1.06 |
| Cyan coupler (ExC-1) | 0.16 |
| Cyan coupler (ExC-2) | 0.13 |
| Dye-image stabilizer (Cpd-6) | 0.32 |

-continued

| | |
|---|---|
| Dye-image stabilizer (Cpd-7) | 0.18 |
| Solvent (Solv-4) | 0.10 |
| Solvent (Solv-5) | 0.10 |
| Solvent (Solv-6) | 0.11 |
| 6th Layer: | |
| Ultraviolet Absorbing Layer | |
| Gelatin | 0.48 |
| Ultraviolet absorber (UV-1) | 0.18 |
| Solvent (Solv-4) | 0.08 |
| Dye (T-2) | 0.005 |
| 7th Layer: | |
| Protective Layer | |
| Gelatin | 1.33 |
| Acrylic modified copolymer of polyvinyl alcohol (degree of modification = 17%) | 0.05 |
| Liquid paraffin | 0.03 |

Yellow Coupler (ExY): Y-21

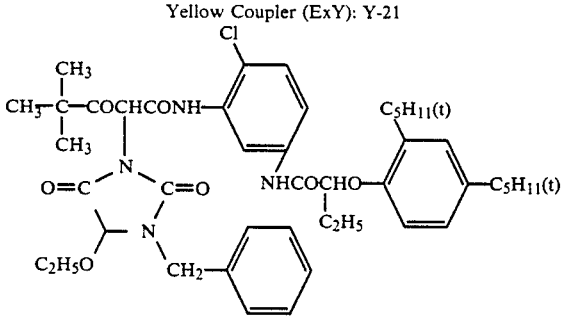

Magenta Coupler: ExM-1

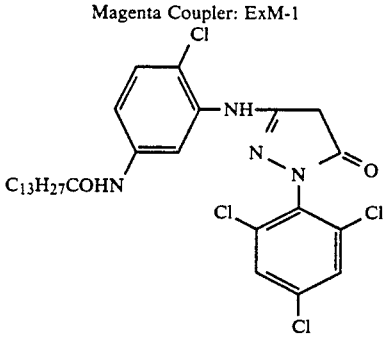

Cyan Coupler: ExC-1

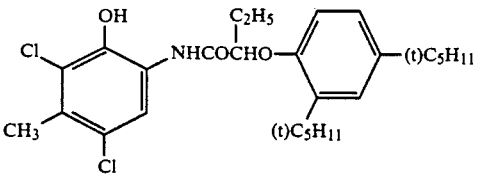

Cyan Coupler: ExC-2

-continued
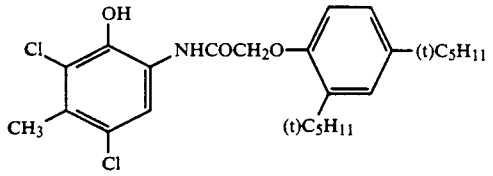
Structural formulas of the compounds used are as follows:
Cpd-1: Color Mixing Inhibitor
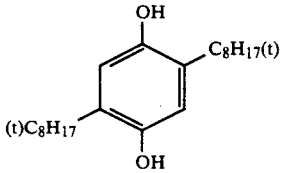
Cpd-2: Dye-image Stabilizer
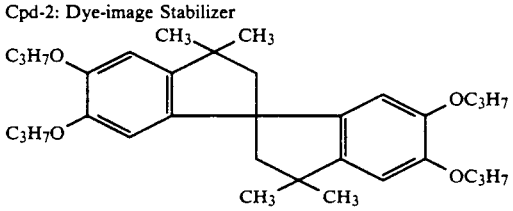
Cpd-3: Dye-image Stabilizer
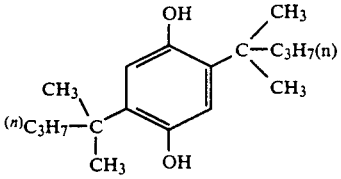
Cpd-4: Dye-image Stabilizer
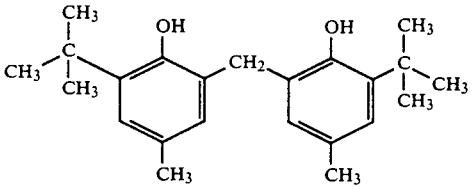
Cpd-5: Dye-image Stabilizer
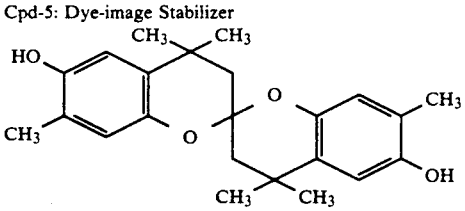
Cpd-6: Dye-image Stabilizer
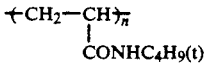
Average molecular weight = 60,000
Cpd-7: Dye-image Stabilizer
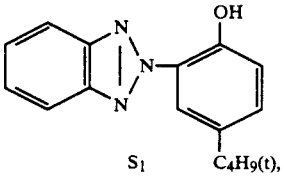

-continued
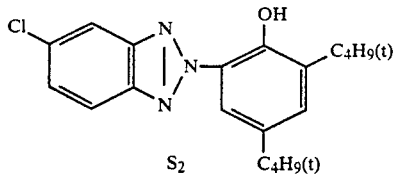
$S_2$
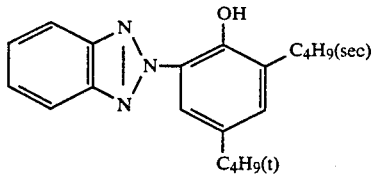
$S_3$
Mixture of $S_1$ to $S_3$ (weight ratio = 4:2:5)
UV-1: Ultraviolet Absorber
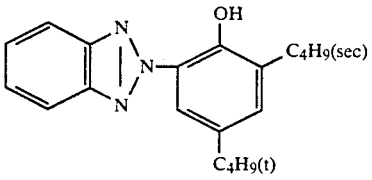
$U_1$
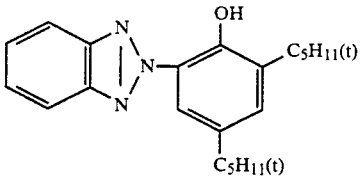
$U_2$
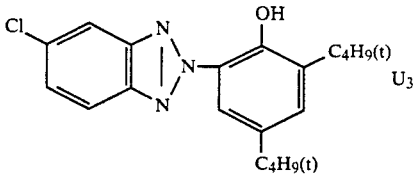
$U_3$
Mixture of $U_1$ to $U_3$ (weight ratio = 12:10:3)
Solv-1: Solvent
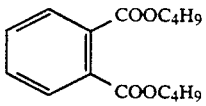
Solv-2: Solvent
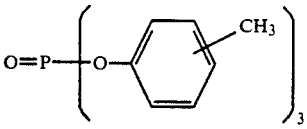
Solv-3: Solvent
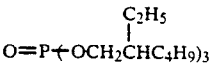
Solv-4: Solvent
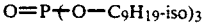
Solv-5: Solvent -continued

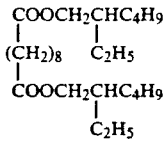

Solv-6: Solvent

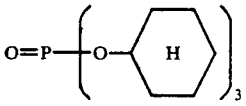

T-1: Dye

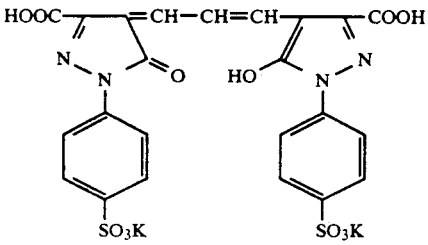

T-2: Dye

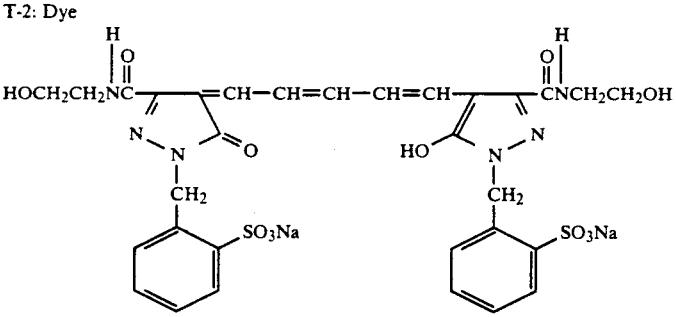

The multilayered color photographic light-sensitive material thus prepared was hereunder referred to as Sample No. 801.

Then, Sample Nos. 802 to 806 were prepared in the same manner as before except for changing yellow, magenta and cyan couplers used as in the following Table:

| Sample No. | Yellow Coupler | Magenta Coupler | Cyan Coupler |
|---|---|---|---|
| 802 | Ex. 1, Y-A | same as Sample 801 | same as Sample 801 |
| 803 | Y-21 | M-8 | C-2 |
| 804 | Y-15 | M-6 | C-2 |
| 805 | Y-26 | M-19 | Ex C-1; C-17 (50 M % each) |
| 806 | Y-21 | m-2 | Ex C-1; C-13 (50 M % each) |

Sample 801 was imagewise exposed to light and then continuously processed by the following processes until the amount of replenisher for color developing process reached two times the voluem of the tank therefor. As the bleach-fixing solution, two solutions having the following compositions were utilized.

| Process | Temp. (°C.) | Time (sec.) | Amount replenished (ml) | Volume of tank (1) |
|---|---|---|---|---|
| Color Development | 37 | 45 | 80 | 10 |
| Bleach-fixing | 30 to 37 | 45 | 161 | 10 |
| Rinse (1) | 30 to 37 | 20 | — | 4 |
| Rinse (2) | 30 to 37 | 20 | — | 4 |
| Rinse (3) | 30 to 37 | 20 | 250 | 4 |
| Drying | 70 to 80 | 60 | | |

*The amount replenished is expressed in the amount per 1 $m^2$ of the light-sensitive material;

**The rinsing processes were carried out by 3-tank countercurrent system from Rinse (3) to (1).

The composition of each processing solution was as follows:

| Color Developer | Tank Soln. (g) | Replenisher (g) |
|---|---|---|
| Water | 800 (ml) | 800 (ml) |
| Ethylenediamine-N,N,N,N-tetra-methylene phosphonic acid | 1.5 | 1.5 |
| Triethanolamine | 10.0 | 10.0 |
| Sodium chloride | 1.4 | |
| Potassium carbonate | 25 | 25 |
| N-Ethyl-N-(beta-methanesulfonamido-ethyl)-3-methyl-4-aminoaniline sulfate | 5.0 | 7.0 |

-continued

| | | |
|---|---|---|
| N,N-Bis(carboxymethyl)-hydrazine | 5.0 | 7.0 |
| Fluorescent brightener (available from Ciba Geigy Co., Ltd. under the trade name of UNI TEX CK) | 2.0 | 2.5 |
| Water | ad. 1000 ml | ad. 1000 ml |
| pH (at 25° C.) | 10.05 | 10.60 |

Bleach-fixing Solution A (Tank Soln. and Replenisher)

| | |
|---|---|
| Water | 400 ml |
| 70% Ammonium thiosulfate solution | 100 ml |
| Sodium sulfite | 17 g |
| Ferric ammonium ethylenediaminetetraacetate | 55 g |
| Disodium ethylenediaminetetraacetate | 5 g |
| Ammonium bromide | 40 g |
| Glacial acetic acid | 9 g |
| Water | ad. 1000 ml |
| pH (at 25° C.) | 10.05 |

Bleach-fixing Solution B (Tank Soln. and Replenisher)

| | |
|---|---|
| Water | 400 ml |
| 70% Ammonium thiosulfate solution | 100 ml |
| Sodium sulfite | 5 g |
| Compound I-1 | 15.6 g |
| Ferric ammonium ethylenediaminetetraacetate | 55 g |
| Disodium ethylenediaminetetraacetate | 5 g |
| Ammonium bromide | 40 g |
| Glacial acetic acid | 9 g |
| Water | ad. 1000 ml |
| pH (at 25° C.) | 5.40 |

Rinse Solution (Tank Soln. and Replenisher)

Deionized Water (Contents of calcium and magnesium were not more than 3 ppm respectively).

As mentioned above, Sample 801 was imagewise exposed to light, was continuously processed using the foregoing two processing solutions and the rinse solutions (1) to (3) were collected after the running was finished and stored at 35° C. to determine days elapsed till floating substances were generated therein. The results obtained are as follows:

| Bleach-fixing Soln. | Rinse (1) | Rinse (2) | Rinse (3) |
|---|---|---|---|
| A | 1.5 | 16 | 18 |
| B | 28 | ≧30 | ≧30 |

As seen from the results shown in the above Table, the stability of the rinsing solutions are remarkably enhanced when the bleach-fixing solution B to which a sulfinic acid had been added was used.

Then, Sample Nos. 801 to 806 were wedge-exposed to light, were processed by the processings A and B using the foregoing running solutions and these processed Samples were left to stand at 60° C./70% RH for 60 days to determine the increase in the minimum density of yellow, magenta and cyan.

The results observed are summarized in Table VII below.

TABLE VII

| Sample No. | Yellow | Magenta | Cyan |
|---|---|---|---|
| (i) Comp. Ex. (Procesing A; bleach-fixing Soln. A) | | | |
| 801 | +0.34 | +0.21 | +0.15 |
| 802 | +0.35 | +0.20 | +0.16 |
| 803 | +0.30 | +0.25 | +0.19 |
| 804 | +0.31 | +0.26 | +0.20 |
| 805 | +0.31 | +0.30 | +0.20 |
| 806 | +0.33 | +0.28 | +0.19 |
| (ii) Present Invention (Processing B; Bleach-fixing Soln. B) | | | |
| 801 | +0.25 | +0.18 | +0.13 |
| 802 | +0.28 | +0.18 | +0.13 |
| 803 | +0.19 | +0.15 | +0.11 |
| 804 | +0.20 | +0.15 | +0.10 |

TABLE VII-continued

| Sample No. | Yellow | Magenta | Cyan |
|---|---|---|---|
| 805 | +0.20 | +0.14 | +0.10 |
| 806 | +0.21 | +0.14 | +0.10 |

In the processing B in which the bleach-fixing solution B was used, the increase in stains of the processed light-sensitive material due to the elapse of time was certainly be suppressed and particularly preferred such effect was achieved by Sample Nos. 803 to 806 in which preferred couplers were incorporated.

EXAMPLE 7

The color photographic light-sensitive material obtained in Example 5 was running treated for 20 days by the following processes while changing the composition of the bleaching-fixing solution.

| Process | Temp. (°C.) | Time (sec.) | Amount replenished (ml) |
|---|---|---|---|
| Color Development | 38 | 90 | 300 |
| Bleach-fixing | 35 | 40 | 300 |
| Water Washing (1) | 30 to 36 | 40 | — |
| Water Washing (2) | 30 to 36 | 40 | — |
| Water Washing (3) | 30 to 36 | 15 | 320 |
| Drying | 70 to 80 | 30 | |

*The amount of the replenisher is expressed in that per 1 $m^2$ of the processed light-sensitive material.

The replenishment of washing water was carried out by replenishing washing water to washing bath (3), feeding the overflow therefrom to washing bath (2) and the overflow from the washing bath (2) to the washing bath (1) (countercurrent replenishing system). In this respect, the volume carried over from the preceding bath was 35 ml and therefore, the magnification of replenishing was 9.1.

| Color Developer | Tank Soln. (g) | Replenisher (g) |
|---|---|---|

-continued

| | | |
|---|---|---|
| Ethylenediaminetetrakismethylene-phosphonic acid | 0.5 | 0.5 |
| Diethylene glycol | 8.0 | 13.0 |
| Benzyl alcohol | 12.0 | 18.5 |
| Sodium bromide | 0.7 | — |
| Sodium chloride | 0.5 | — |
| Sodium sulfite | 2.0 | 2.5 |
| N,N-Diethylhydroxylamine | 3.5 | 4.5 |
| Triethylenediamine-1,4-diaza-bicyclo(2,2,2)octane | 3.5 | 4.5 |
| 3-Methyl-4-amino-N-ethyl-N-(beta-methanesulfonamidoethyl)-aniline | 5.5 | 8.0 |
| Potassium carbonate | 30.0 | 30.0 |
| Fluorescent whitener (stilbene type) | 1.0 | 1.3 |
| Pure water | to 1000 ml | to 1000 ml |
| pH (adjusted by NaOH or HCl) | 10.50 | 10.90 |

| Bleach-fixing Soln. | Tank Soln. and Replenisher |
|---|---|
| Ammonium thiosulfate | 100 g |
| Ferric ammonium ethylenediamine-tetraacetate dihydrate | 50.0 g |
| Disodium ethylenediaminetetraa-cetate dihydrate | 5.0 g |
| Additive | (see Table VIII) |
| Pure water | to 1000 ml |
| pH (adjusted with aqueous ammonia or HCl) | 6.3 |

Washing Water Tank Soln. and Replenisher

The washing water used was pure water obtained by deionizing tap water to reduce the total amount of cations except for hydrogen ions and that of anions except for hydroxide ions to not more than 1 ppm respectively.

After running treatment, 100 ml each of the bleaching-fixing and washing water (1) and (2) were collected in test tubes and allowed to stand at room temperature to determine the days elapsed until floating substances were generated therein. The results obtained are summarized in Table VIII.

TABLE VIII

| No. | Additive (mole/l) | Bleach-fixing Solution | Washing Water (1) | Washing Water (2) |
|---|---|---|---|---|
| 1(*) | Sodium bisulfite (0.2) | 21 | 12 | 15 |
| 2(*) | Formaldehyde/sulfurous acid adduct (0.2) | 3 | 1 | 1 |
| 3(*) | Acetaldehyde (0.2) Sodium sulfite (0.2) | 24 | 15 | 20 |
| 4 | Sodium sulfite (0.1) I-1 (0.1) | 40 | 29 | 33 |
| 5 | I-1 (0.2) | 38 | 25 | 31 |
| 6 | Sodium sulfite (0.1) I-34 (0.1) | 41 | 30 | 34 |
| 7 | Sodium sulfite (0.15) I-2 (0.05) | 36 | 25 | 30 |

*Comparative Example

As seen from Table VIII, the stability of the processing solutions of the present invention were increased by a factor 2 compared with those containing sodium sulfite commonly used. Moreover, the foregoing running treatment provided light-sensitive materials having good photographic properies.

In addition, the same processing was repeated by using the color developer from which benzyl alcohol was removed. As a result, there was not observed the formation of tar and good results were obtained.

EXAMPLE 8

The same procedures as in Example 7 (processing No. 6) were repeated except that equivalent amount of compounds I-5, I-9, I-10, I-14, I-20, I-25 and I-28 were substituted for compound I-34 used therein and the same results were obtained.

What is claimed is:

1. A method for processing a silver halide color photographic light-sensitive material containing at least one yellow coupler which comprises the steps of developing the light-sensitive material with a color developer containing an aromatic primary amine color developing agent, desilvering, washing with water and/or stabilizing the material, in which a washing water and/or a stabilizing solution contains at least one compound selected from the group consisting of sulfinic acids and salts and pecursors thereof, wherein the at least one yellow coupler is selected from compounds represented by the following eneral formula (V):

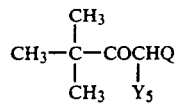

(V)

wherein Q is a substituted or unsubstituted N-phenylcarbamoyl group and $Y_5$ is a halogen atom or a group capable of being eliminated through a coupling reaction with an oxidized form of the developing agent.

2. A method according to claim 1 wherein the sulfinic acid is selected from the group consisting of compounds composed of linear, branched or cyclic aliphatic groups to which at least one —$SO_2H$ group is bound, which may be substituted with ethyl, tert-butyl, sec-amyl, cyclohexyl and/or benzyl groups; compounds composed of optionally substituted cyclic hydrocarbon type aromatic groups to which at least one —$SO_2$ H group is bound; and compounds composed of heterocyclic aromatic groups to which at least one —$SO_2H$ group is bound, provided that the aromatic and heterocyclic groups may be monocyclic or condensed ring type ones.

3. A method according to claim 2 wherein the heterocyclic groups of the sulfinic acids are heterocyclic groups comprising saturated or unsaturated 3- to 10-membered ring structures composed of carbon, oxygen, nitrogen, sulfur atoms, which may be substituted with cumenyl, pyrrolidyl, pyrrolinyl and/or morpholinyl groups.

4. A method according to claim 1 wherein the salt of the sulfinic acid is selected from the group consisting of alkali metal salts, alkaline earth metal salts, nitrogen-containing organic base salts and ammonium salts thereof.

5. A method according to claim 1 wherein the sulfinic acids and salts thereof are selected from the group consisting of compounds composed of aromatic and heterocyclic groups to which at least one —$SO_2H$ group is bound and alkali metal salts, alkaline earth metal salts, nitrogen-containing organic base salts and ammonium salts thereof.

6. A method according to claim 5 wherein the sulfinic acids and salts thereof are selected from aromatic sulfinic acids and alkali metal and alkaline earth metal salts thereof.

7. A method according to claim 1 wherein the sulfinic acids and and salts and precursors thereof are selected from sulfinic acids and salts thereof of which sum of carbon atoms not more than 20.

8. A method according to claim 1 wherein the sulfinic acids and salts and precursors thereof are also added to at least one solution selected from the group consisting of color developers, monochromatic devlopers, bleaching solutions, fixing solutions, bleach-fixing solutions, promoting solutions, and stop solutions.

9. A method according to claim 8 wherein the sulfinic acids and salts and precursors thereof are added to bleach-fixing solutions in the desilvering process.

10. A method according to claim 1 wherein the amount of sulfinic acids and salts and precursors thereof ranges from $1\times10^{-4}$ to 1 mole per liter of the processing solution.

11. A method according to claim 1 wherein the sulfinic acids and salts and precursors thereof are added directly to a tank for the processing solution or to a replenisher therefor.

12. A method according to claim 1 wherein the amount of washing water or stabilization solution to be replenished is 1.0 to 50 times the volume of the solution carried over from the preceding bath per unit area of the processed light-sensitive material.

13. A method according to claim 1 wherein the washing process is carried out by multistage countercurrent system and the number of steps is 2 to 6.

14. A method according to claim 13 wherein calcium and magnesium are removed from the washing water.

15. A method according to claim 1 wherein at least one magenta couplers contained in the light-sensitive material is selected from compounds represented by the following general formulas (III) and (IV):

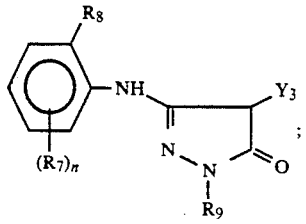

(III)

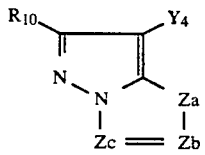

(IV)

wherein $R_7$ represents a substituent on a benzene ring; $R_8$ is a halogen atom, or an alkoxy or alkyl group; $R_9$ is a substituted or unsubstituted phenyl group; $R_{10}$ is a hydrogen atom or a substituent; Q is a substituted or unsubstituted N-phenylcarbamoyl group; Za, Zb and Ac each represents a methine, a substituted methine, =N— or —NH—, provided that one of the bonds Za-Zb and Zb-Zc is a double bond while the other is a single bond, that if Zb-Zc bond is a carbon-carbon double bond, this bond may be a part of an aromatic ring and that if Za, Zb and/or Zc are substituted methines, these may form a dimer or a higher polymer at the positions of the substituted methines; and $Y_3$ and $Y_4$ each represents a halogen atom or a group capable of being eliminated through a coupling reaction with an oxidized form of the developing agent.

16. A method according to claim 1 wherein at least one cyan coupler contained in the light-sensitive material is selected from the group consisting of compounds represented by the following general formulas (I) and (II):

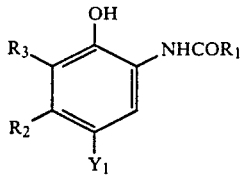

(I)

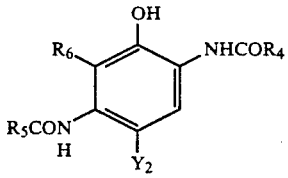

(II)

wherein $R_1$, $R_4$ and $R_5$ each independently represents an aliphatic, aromatic, heterocyclic, aromatic amino or heterocyclic amino group; $R_2$ represents an aliphatic group having at least two carbon atoms; $R_3$ and $R_6$ each independently represent a hydrogen or halogen atom, or an aliphatic, aliphatic oxy or acylamino group; and $Y_1$ and $Y_2$ each represents a halogen atom or a group capable of being eliminated through a coupling reaction with an oxidized form of the developing agent.

17. A method according to claim 1 wherein the light-sensitive material further contains at least one magenta coupler which is selected from compounds represented by the following general formulas (III) and (IV):

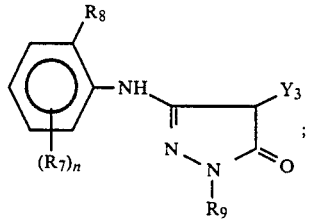

(III)

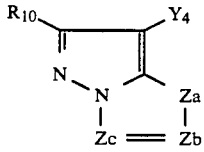

(IV)

wherein $R_7$ represents a substituent on a benzene ring; $R_8$ is a halogen atom, or an alkoxy or alkyl group; $R_9$ is a substituted or unsubstituted phenyl group; $R_{10}$ is a hydrogen atom or a substituent; Q is a substituted or unsubstituted N-phenylcarbamoyl group; Za, Zb and Zc each represents a methine, a substituted methine, =N— or —NH—, provided that one of the bonds Za-Zb and Zb-Zc is a double bond while the other is a single bond, that if Zb-Zc is a carbon-carbon double bond, this bond may be a part of an aromatic ring and that if Za, Zb and/or Zc are substituted methines, these may form a dimer or a higher polymer at the positions of the substituted methines; and $Y_3$ and $Y_4$ each represents a halogen atom or a group capable of being eliminated through a coupling reaction with an oxidized form of the developing agent.

18. A method according to claim 1 wherein the light sensitive material further contains at least one cyan coupler which is selected from the group consisting of compounds represented by the following general formulas (I) and (II):

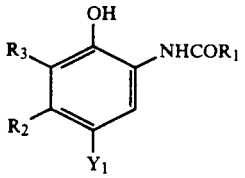

(I)

-continued

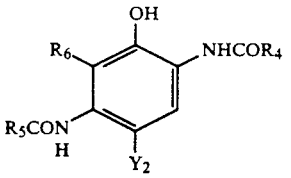

(II)

wherein $R_1$, $R_4$ and $R_5$ each independently represents an aliphatic, aromatic, heterocyclic, aromatic amino or heterocyclic amino group; $R_2$ represents an aliphatic group having at least two carbon atoms; $R_3$ and $R_6$ each independently represent a hydrogen or halogen atom, or an aliphatic, aliphatic oxy or acylamino group; and $Y_1$ and $Y_2$ each represents a halogen atom or a group capable of being eliminated through a coupling reaction with an oxidized form of the developing agent.

* * * * *